US011855357B2

(12) United States Patent
Lee et al.

(10) Patent No.: US 11,855,357 B2
(45) **Date of Patent: *Dec. 26, 2023**

(54) MULTI-BAND ANTENNA DEVICE

(71) Applicant: SAMSUNG ELECTRONICS CO., LTD., Suwon-si (KR)

(72) Inventors: Youngki Lee, Suwon-si (KR); Sunwoo Lee, Suncheon-si (KR); Dooseok Choi, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/881,219

(22) Filed: Aug. 4, 2022

(65) Prior Publication Data

US 2022/0376406 A1 Nov. 24, 2022

Related U.S. Application Data

(63) Continuation of application No. 17/038,883, filed on Sep. 30, 2020, now Pat. No. 11,437,733.

(30) Foreign Application Priority Data

Apr. 1, 2020 (KR) ..... 10-2020-0039942

(51) Int. Cl.

| | |
|---|---|
| ***H01Q 21/06*** | (2006.01) |
| ***H01Q 5/35*** | (2015.01) |
| ***H01Q 5/48*** | (2015.01) |

(52) U.S. Cl.

CPC ..... *H01Q 21/067* (2013.01); *H01Q 5/35* (2015.01); *H01Q 5/48* (2015.01); *H01Q 21/062* (2013.01)

(58) Field of Classification Search

CPC ..... H01Q 21/067; H01Q 5/35; H01Q 21/062; H01Q 1/241; H01Q 1/38; H01Q 5/48;

(Continued)

(56) References Cited

U.S. PATENT DOCUMENTS 7,173,566 B2 2/2007 Cheng
8,994,603 B2 * 3/2015 Harel ..... H01Q 21/26 343/797

(Continued)

FOREIGN PATENT DOCUMENTS

KR 10-2020-0141339 A 12/2020

*Primary Examiner* — Vibol Tan
(74) *Attorney, Agent, or Firm* — Sughrue Mion, PLLC

(57) ABSTRACT

An antenna device includes an antenna space, a barrier, a signal processing device, and a feed space. The antenna space includes first and second antennas that transmit/receive first and second radio frequency (RF) signals in different bands. The barrier includes a penetration region, is disposed adjacent to the antenna space, and reflects the first and second RF signals. The signal processing device adjacent to the barrier, includes first and second RF circuits that process the RF signals. The feed space includes first and second feed layers and is disposed adjacent to and stacked on the signal processing device, and adjacent to the barrier. A first feed line connecting the first RF circuit to the first antenna passes through the first feed layer and the penetration region, and a second feed line connecting the second RF circuit to the second antenna passes through the second feed layer and the penetration region.

20 Claims, 60 Drawing Sheets

(58) Field of Classification Search
CPC ..... H01Q 9/065; H01Q 19/108; H01Q 23/00; H01Q 25/00; H01Q 21/065; H01Q 21/24; H01Q 1/46; H01Q 7/06
See application file for complete search history.

(56) References Cited

U.S. PATENT DOCUMENTS

| | | | |
|---|---|---|---|
| 9,819,084 | B2 | 11/2017 | Zimmerman et al. |
| 10,135,155 | B2 | 11/2018 | Sudo et al. |
| 10,224,639 | B2 | 3/2019 | Chainon et al. |
| 10,312,112 | B2 | 6/2019 | Chuang et al. |
| 10,854,978 | B2 * | 12/2020 | Lim ..... H01Q 1/526 |
| 11,437,733 | B2 * | 9/2022 | Lee ..... H01Q 21/062 |
| 2017/0062952 | A1 | 3/2017 | Sundararajan et al. |
| 2017/0141465 | A1 | 5/2017 | Sharawi |
| 2019/0103682 | A1 | 4/2019 | Thai et al. |
| 2019/0198995 | A1 | 6/2019 | Ryoo et al. |
| 2019/0267710 | A1 | 8/2019 | Jenwatanavet |
| 2019/0319369 | A1 | 10/2019 | Chiang et al. |
| 2020/0388924 | A1 | 12/2020 | Lee et al. |

* cited by examiner

MULTI-BAND ANTENNA DEVICE

CROSS-REFERENCE TO RELATED APPLICATIONS

This application is a continuation of application Ser. No. 17/038,883 filed on Sep. 30, 2020, which claims priority under 35 U.S.C. § 119 to Korean Patent Application No. 10-2020-0039942 filed on Apr. 1, 2020, in the Korean Intellectual Property Office, the entire contents of each of which are incorporated by reference herein in their entireties.

BACKGROUND

1. Field

The present disclosure relates to wireless communication, and more particularly, to a multi-band antenna device.

2. Description of Related Art

A wireless communication device such as a smartphone or a smart watch may communicate with any other device by using an antenna device. To increase the throughput of data, the antenna device may be used in communication using a radio frequency (RF) signal in a high frequency band. For example, the antenna device may transmit/receive a signal in a millimeter wave (mmWave) frequency band that is used in a wireless communication system such as a $5^{th}$ generation (5G) communication system.

Meanwhile, as a size of a wireless communication device is limited and a space that the antenna device occupies is limited, an antenna providing the good performance of communication may be required even when other modules or circuits are placed adjacent to the antenna device. For example, an antenna device that includes radiators transmitting/receiving an RF signal in a multi-band may be required. In addition, an antenna device in which sizes of radiators are miniaturized and the placement of the radiators is optimized may be required.

SUMMARY

It is an aspect to provide a multi-band antenna device that transmits/receives a radio frequency signal in a multi-band within a limited space.

According to an aspect of one or more exemplary embodiments, there is provided an antenna device comprising a first antenna configured to transmit/receive a first radio frequency (RF) signal in a first communication band, the first antenna including a first radiator having a size corresponding to the first communication band; and a second radiator having a shape symmetrical to a shape of the first radiator and having the size corresponding to the first communication band; a second antenna configured to transmit/receive a second RF signal in a second communication band, the second antenna including a third radiator having a shape identical to a shape of the first radiator and having a size corresponding to the second communication band; and a fourth radiator having a shape identical to that of the second radiator and having the size corresponding to the second communication band; a barrier including a penetration region, the barrier reflecting the first RF signal and the second RF signal; and a signal processing device, wherein a center frequency of the second communication band is higher than a center frequency of the first communication band, and wherein the first antenna and the second antenna are connected with the signal processing device through the penetration region of the barrier.

According to another aspect of one or more exemplary embodiments, there is provided an antenna device comprising a first antenna configured to transmit/receive a first radio frequency (RF) signal in a first communication band, the first antenna including a first radiator; a second antenna configured to transmit/receive a second RF signal in a second communication band; a barrier including a penetration region, the barrier reflecting the first RF signal and the second RF signal; and a signal processing device, wherein a center frequency of the second communication band is lower than a center frequency of the first communication band, wherein the first antenna and the second antenna are connected with the signal processing device through the penetration region of the barrier, and wherein the first radiator includes a first shape extended from the penetration region of the barrier in a first direction perpendicular to the barrier; a second shape extended in a second direction perpendicular to the first direction and having a size corresponding to the first communication band; and a third shape connecting the first shape to the second shape and extended in a third direction rotated from the first direction to the second direction by an acute angle.

According to yet another aspect of one or more exemplary embodiments, there is provided an antenna device comprising a barrier reflecting a radio frequency (RF) signal, the barrier including a penetration region; a first antenna adjacent to the penetration region of the barrier in a first direction perpendicular to the barrier, and configured to transmit/receive an RF signal in a first communication band; a second antenna adjacent to the penetration region of the barrier in the first direction, and configured to transmit/receive an RF signal in a second communication band; and a patch antenna spaced apart from the barrier in a direction facing away from the first direction and including at least one radiator of a plate shape configured to transmit/receive the RF signal in the first communication band or the second communication band; and a signal processing device, wherein the first antenna and the second antenna are connected with the signal processing device through the penetration region of the barrier, wherein the patch antenna is placed to be spaced apart from the signal processing device in a second direction perpendicular to the first direction, wherein the first antenna includes a first radiator having a size corresponding to a first frequency of the first communication band; and a second radiator having a size corresponding to a second frequency of the first communication band, and wherein the second antenna includes a third radiator having a shape different from a shape of the first radiator and having a size corresponding to a third frequency of the second communication band; and a fourth radiator having a shape different from a shape of the second radiator and having a size corresponding to a fourth frequency of the second communication band.

According to yet another aspect of one or more exemplary embodiments, there is provided an antenna device comprising an antenna space including a first antenna configured to transmit/receive a first radio frequency (RF) signal in a first communication band and a second antenna configured to transmit/receive a second RF signal in a second communication band different from the first communication band; a barrier including a penetration region, the barrier disposed adjacent to the antenna space and reflecting the first RF signal and the second RF signal; a signal processing device disposed adjacent to the barrier, the signal processing device including a first RF circuit configured to process the first RF signal and a second RF circuit configured to process the second RF signal; and a feed space comprising a first feed layer and a second feed layer, the feed space being disposed adjacent to and stacked on the signal processing device and adjacent to the barrier, wherein a portion of a feed line connecting the first RF circuit to the first antenna passes through the first feed layer and the penetration region of the barrier, and a portion of a feed line connecting the second RF circuit to the second antenna passes through the second feed layer and the penetration region of the barrier.

BRIEF DESCRIPTION OF THE FIGURES

The above and other aspects will be more clearly understood from the following detailed description taken in conjunction with the accompanying drawings, in which.

DETAILED DESCRIPTION

Figure 1:
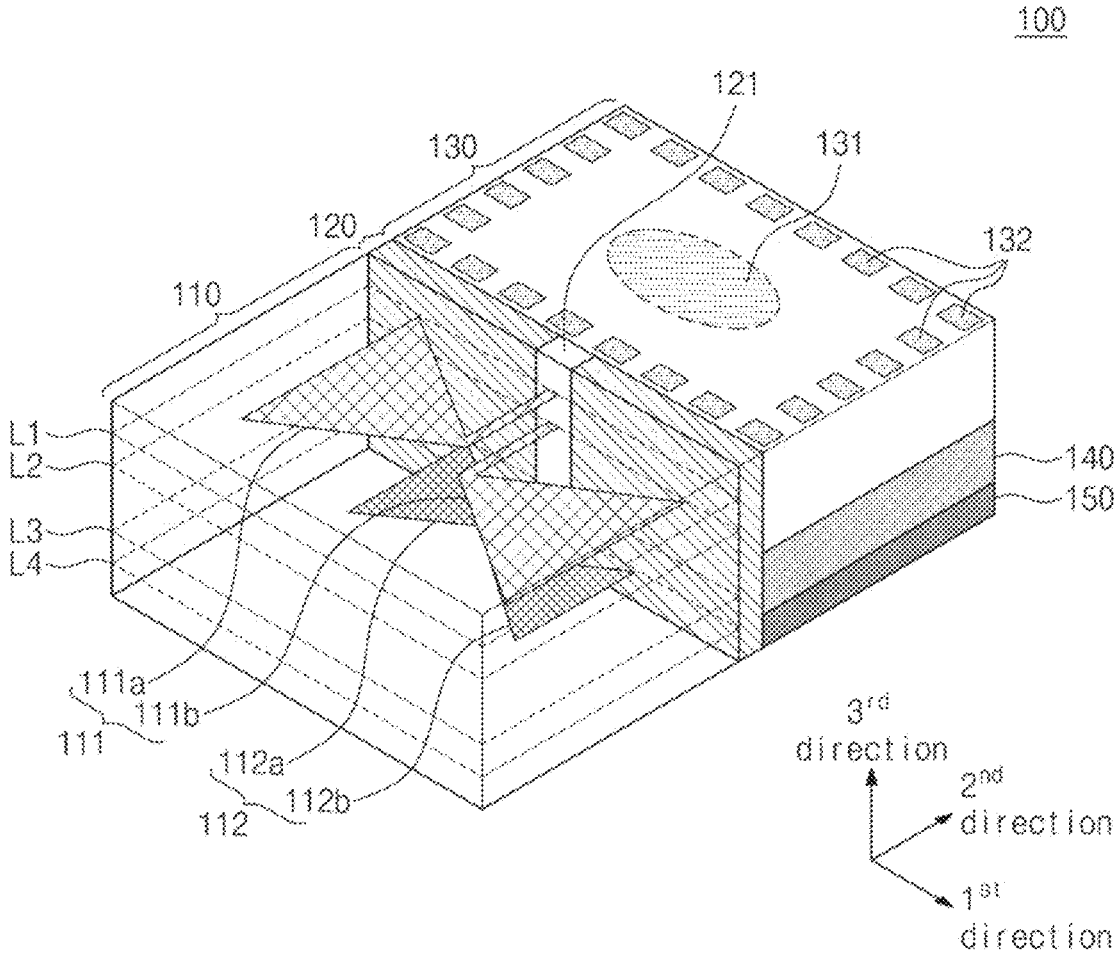
FIG. 1 is a perspective view illustrating an antenna device according to an embodiment.

Below, various embodiments may be described in detail and clearly to such an extent that an ordinary one in the art may easily implement the inventive concept. Below, for convenience of description, similar components are expressed by using the same or similar reference numerals. It is noted that various features illustrated in the accompanying drawings may be modified in scale for increasing clarity and for better understanding of the inventive concept, and components or elements may be illustrated as being enlarged or reduced in some cases for similar reasons.

FIG. 1 is a perspective view illustrating an antenna device according to an embodiment. Referring to FIG. 1, a perspective view of an antenna device 100 according to an embodiment is illustrated. The antenna device 100 may be a device included in a wireless communication device such as a smartphone or a smart watch. The antenna device 100 may communicate with any other wireless communication device or a base station by using a radio frequency (RF) signal.

For better understanding, first to third directions are defined as illustrated in FIG. 1. The first direction may be a direction parallel to a barrier 120. The second direction may be a direction perpendicular to the first direction. The third direction may be a direction perpendicular to a plane defined by the first and second directions. However, the first to third directions may be only any directions defined for distinction, and exemplary embodiments are not limited thereto. For example, the first to third directions may be defined as different directions together with the detailed description.

The antenna device 100 may include an endfire antenna space 110, the barrier 120, a patch antenna space 130, and a feed space 140. The feed space 140 of the antenna device 100 may be connected with a signal processing device 150. The endfire antenna space 110 may include a first endfire antenna 111 and a second endfire antenna 112. An endfire antenna may be an antenna in which a radiation pattern corresponding to the intensity of an RF signal is intensively formed in a single direction. Because the endfire antenna radiates electromagnetic waves corresponding to the RF signal in a specific direction, the endfire antenna may be an antenna that is appropriate for a low-power or small-size RF communication device.

The first endfire antenna 111 may be a dipole antenna configured to transmit/receive an RF signal in a first communication band. The first endfire antenna 111 may include a first radiator 111*a* and a second radiator 111*b*. The second endfire antenna 112 may be a dipole antenna configured to transmit/receive an RF signal in a second communication band. The second communication band may be different than the first communication band, and thus a size of the first endfire antenna 111 may be different from a size of the second endfire antenna 112. The second endfire antenna 112 may include a third radiator 112*a* and a fourth radiator 112*b*. Since the first and second endfire antennas 111 and 112 have different sizes, the first and second endfire antennas 111 and 112 may transmit/receive RF signals in different communication bands.

The first to fourth radiators 111*a*, 111*b*, 112*a*, and 112*b* may be radiators formed at different conductive layers. In detail, the endfire antenna space 110 may include the first to fourth radiators 111*a*, 111*b*, 112*a*, and 112*b* respectively formed at a first conductive layer L1, a second conductive layer L2, a third conductive layer L3, and a fourth conductive layer L4. The first to fourth conductive layers L1 to L4 may be stacked in a direction facing away from the third direction (i.e., in a direction opposite to the arrow indicating the 3$^{rd}$ direction in FIG. 1).

The barrier 120 may be interposed between the endfire antenna space 110 and the patch antenna space 130. The barrier 120 may be a barrier of a metal material reflecting an RF signal such that a radiation pattern of the first and second endfire antennas 111 and 112 is formed in a direction facing away from the second direction. In some exemplary embodiments, the barrier 120 may be a barrier of a copper (Cu) material.

The barrier 120 may include at least one penetration region 121. The penetration region 121 may be a region through which a first feed line, a second feed line, a third feed line, and a fourth feed line that are respectively connected with the first to fourth radiators 111*a*, 111*b*, 112*a*, and 112*b* penetrate the barrier 120. A feed line may be a conductive line that connects the signal processing device 150 with a radiator (e.g., the first radiator 111*a*) transmitting/receiving an RF signal of an endfire antenna and transfers the RF signal.

The patch antenna space 130 may include a patch antenna 131 and a plurality of electromagnetic band gap (EBG) structures 132. The patch antenna 131 may include at least one plate-shaped radiator transmitting/receiving an RF signal. The plurality of EBG structures 132 are metal patterns regularly disposed on a substrate of a dielectric material, and may be structures that block an RF signal in a specific frequency band. In some exemplary embodiments, the patch antenna 131 may include at least one plate-shaped radiator transmitting/receiving an RF signal in the first communication band or the second communication band. In some embodiments, the patch antenna 131 may include two plate-shaped radiators, a first plate-shaped radiator transmitting/receiving an RF signal in the first communication band and a second plate-shaped radiator transmitting/receiving an RF signal in the second communication band.

The feed space 140 may be a space that feeds an RF signal to be transmitted or received through an antenna. For example, the first to fourth radiators 111*a*, 111*b*, 112*a*, and 112*b* may be connected with the signal processing device 150 through the first to fourth feed lines passing through the penetration region 121 and the feed space 140. The feed space 140 will be more fully described with reference to FIG. 38. For example, in some exemplary embodiments, the plate-shaped radiator of the patch antenna 131 may be connected with the signal processing device 150 through a fifth feed line passing through the feed space 140.

The signal processing device 150 may be a module that processes an RF signal to be transmitted or received through an antenna. In some exemplary embodiments, the signal processing device 150 may be a module that is manufactured independently of the antenna device 100. For example, the signal processing device 150 may be a module that processes an RF signal in the first communication band to be transmitted or received through the first endfire antenna 111 and an RF signal in the second communication band to be transmitted or received through the second endfire antenna 112.

As described above, according to various embodiments, an antenna device that processes RF signals in a multi-band within a limited space may be provided. For example, an antenna device that supports a plurality of millimeter wave (mmWave) frequency bands used in a 5th generation (5G) wireless communication system may be provided. Table 1 below shows operating bands of the 5G wireless communication system, that is, a new radio (NR).

TABLE 1

| Band Number | Up-Link | Down-Link | Duplex Mode |
|---|---|---|---|
| N257 | 26.50~29.50 GHz | 26.50~29.50 GHz | TDD |
| N258 | 24.25~27.50 GHz | 24.25~27.50 GHz | TDD |
| N259 | 27.50~28.35 GHz | 27.50~28.35 GHz | TDD |
| N260 | 37.00~40.00 GHz | 37.00~40.00 GHz | TDD |

An up-link operating band, a down-link operating band, and a duplex mode for each band number of the NR will be described with reference to Table 1 above. In Table 1 above, a time division duplexing (TDD) scheme may denote a scheme to use the same frequency band for an up-link and a down-link and to transmit data at different time slots.

In the description below, an N257 band using a frequency between 26.5 GHz and 29.5 GHz may be referred to as the "first communication band", an N260 band using a frequency between 37.0 GHz and 40.0 GHz may be referred to as the "second communication band", and a structure of an antenna device operating in a dual-band will be described as an example. For example, a center frequency of the first communication band may be 28 GHz. A center frequency of the second communication band may be 39 GHz. It is noted that this example is merely by way of illustration and other communication bands may be used in various other embodiments.

Figure 2:
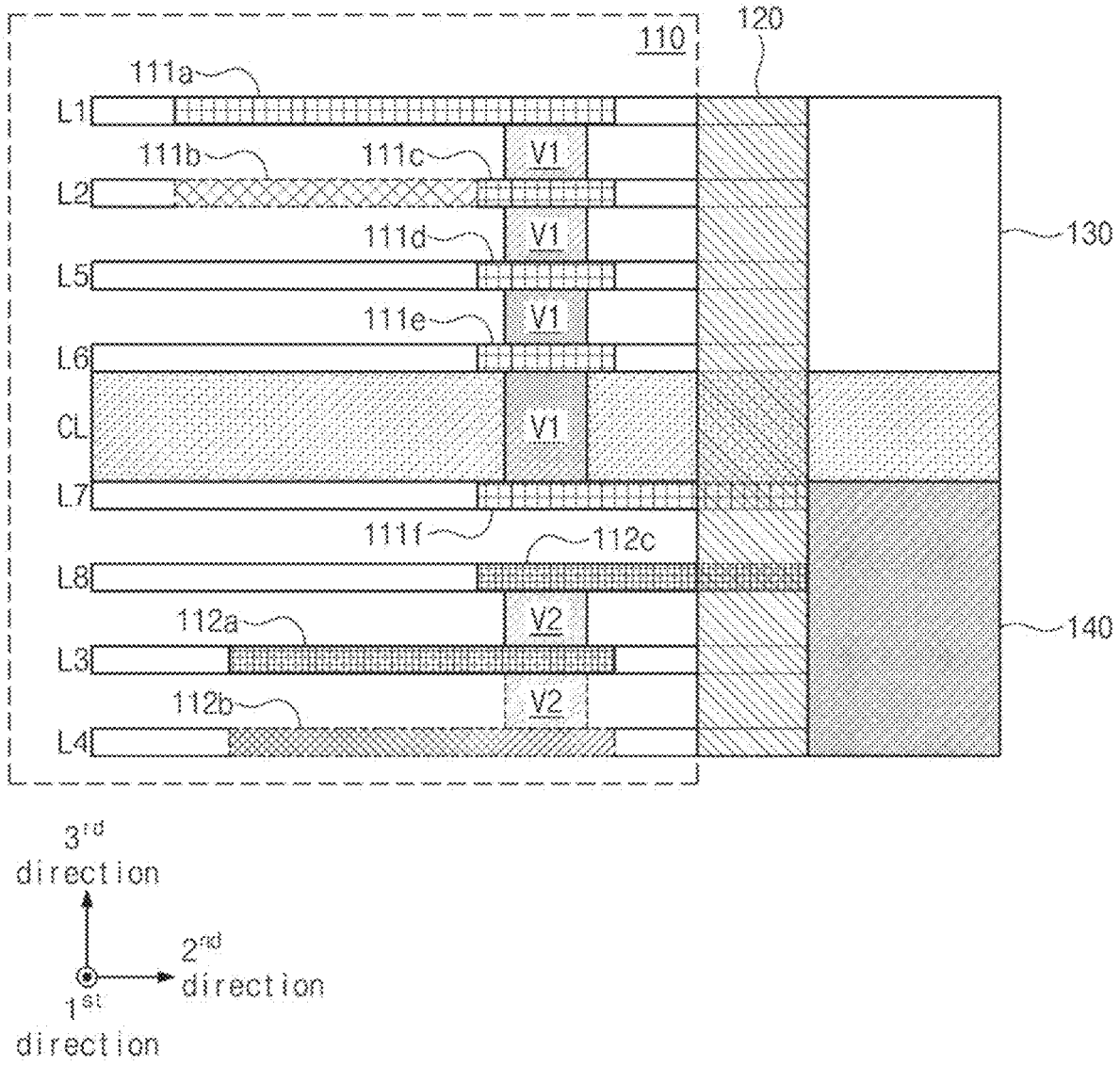
FIG. 2 is a cross-sectional view illustrating the antenna device of FIG. 1 in detail.

FIG. 2 is a cross-sectional view illustrating the antenna device of FIG. 1 in detail. For better understanding, the endfire antenna space 110 that is depicted in FIG. 2 has a scale different from that of FIG. 1.

The endfire antenna space 110 may include a plurality of conductive layers L1 to L8 and a core layer CL. The core layer CL may be a layer that is used as the center of an antenna device in a manufacturing process. For example, the core layer CL may be disposed perpendicular to the barrier 120 and may be interposed between the first endfire antenna 111 and the second endfire antenna 112. A conductive layer may be a layer where a radiator is formed. An example is illustrated as the endfire antenna space 110 includes eight conductive layers L1 to L8, but exemplary embodiments are not limited thereto. For example, the number of conductive layers may be more or fewer than that illustrated in FIG. 2.

The first and second radiators 111*a* and 111*b* respectively formed at the first and second conductive layers L1 and L2 may transmit/receive an RF signal in the first communication band. An RF signal to be transmitted or received at the first radiator 111*a* may be transferred from or to the feed space 140 through first vias V1 and radiators 111*c*, 111*d*, 111*e*, and 111*f* In this case, a via may be a component that connects conductive layers spaced from each other in the third direction and transfers an RF signal. The radiators 111*c*, 111*d*, and 111*e* may be radiators that are not associated with transmission/reception of an RF signal and are formed at conductive layers in the manufacturing process. The radiator 111*f* may operate as a circuit that transfers an RF signal to the feed space 140.

In some exemplary embodiments, at least a portion of a feed line that transfers an RF signal may be implemented with vias and radiators. For example, the first feed line may include the first vias V1 and the radiators 111*c*, 111*d*, 111*e*, and 111*f*.

For better understanding, the second radiator 111*b* is together illustrated in the cross-sectional view of FIG. 2, but the second radiator 111*b* may be placed to be spaced apart from the first radiator 111*a* in the first direction (see FIG. 1). An RF signal to be transmitted or received at the second radiator 111*b* may be transferred from or to the feed space 140 through different first vias and different radiators. That is, each of the first and second radiators 111*a* and 111*b* may be connected with the feed space 140 through at least one via and at least one radiator, and a feed line that at least one via and at least one radiator of the first radiator 111*a* constitute may be different from a feed line that at least one via and at least one radiator of the second radiator 111*b* constitute.

The third and fourth radiators 112*a* and 112*b* respectively formed at the third and fourth conductive layers L3 and L4 may transmit/receive an RF signal in the second communication band. An RF signal to be transmitted or received at the third radiator 112*a* may be transferred from or to the feed space 140 through second vias V2 and a radiator 112*c*. The radiator 112*c* may operate as a circuit that transfers an RF signal to the feed space 140.

For better understanding, the fourth radiator 112*b* is together illustrated in the cross-sectional view of FIG. 2, but the fourth radiator 112*b* may be placed to be spaced apart from the third radiator 112*a* in the first direction (see FIG. 1). An RF signal to be transmitted or received at the fourth radiator 112*b* may be transferred from or to the feed space 140 through different second vias and different radiators. That is, each of the third and fourth radiators 112*a* and 112*b* may be connected with the feed space 140 through at least one via and at least one radiator, and a feed line that at least one via and at least one radiator of the third radiator 112*a* constitute may be different from a feed line that at least one via and at least one radiator of the fourth radiator 112*b* constitute. The feed space 140 may be connected with any other module (e.g., the signal processing device 150) placed in the direction facing away from the third direction.

In some exemplary embodiments, the patch antenna included in the patch antenna space 130 may be an antenna that is in the shape of a plate and is formed at a conductive layer stacked above the core layer CL in the third direction. For example, the second conductive layer L2 may be extended in the second direction, such that a portion of the second conductive layer L2 may be placed within the patch antenna space 130 (not shown). A radiator of a plate shape corresponding to the patch antenna 130 may be formed of the portion of the second conductive layer L2 included in the patch antenna space 130.

Figure 3:
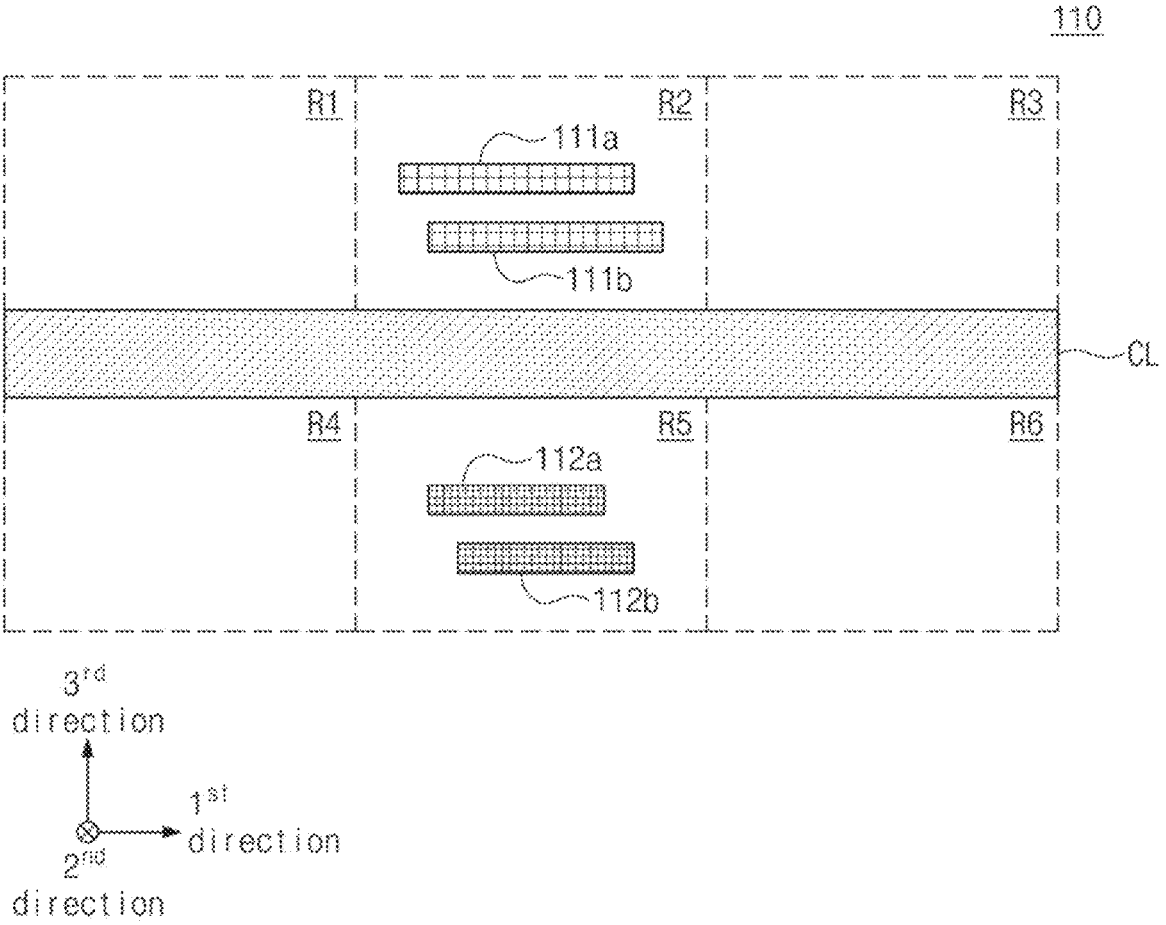
FIG. 3 is a view illustrating an endfire antenna space of the antenna device of FIG. 1.

FIG. 3 is a view illustrating the endfire antenna space of FIG. 1. The endfire antenna space 110 of FIG. 1 is illustrated in FIG. 3. The endfire antenna space 110 may include a plurality of regions, for example, a first region R1, a second region R2, a third region R3, a fourth region R4, a fifth region R5, and a sixth region R6. A region may be a region where one endfire antenna, that is, a pair of radiators is capable of being placed. The first to third regions R1 to R3 that are regions placed above the core layer CL in the third direction may be regions that are placed in parallel with the first direction. The fourth to sixth regions R4 to R6 that are regions placed below the core layer CL in the direction facing away from the third direction may be regions that are placed in parallel with the first direction.

According to some exemplary embodiments, locations of endfire antennas included in an antenna device operating in a dual-band may be provided. In detail, the first and second radiators 111*a* and 111*b* of the first endfire antenna may be placed to be spaced from the core layer CL in the third direction. The third and fourth radiators 112*a* and 112*b* of the second endfire antenna may be placed to be spaced from the core layer CL in the direction facing away from the third direction.

In some exemplary embodiments, the first and second endfire antennas may overlap each other in the third direction. For example, the first and second radiators 111*a* and 111*b* included in the first endfire antenna may be placed in the second region R2. The third and fourth radiators 112*a* and 112*b* included in the second endfire antenna may be placed in the fifth region R5.

In some exemplary embodiments, the first and second endfire antennas may be placed to be spaced from each other in the first direction. For example, in some exemplary embodiments, unlike the example illustrated in FIG. 3, the first and second radiators 111*a* and 111*b* included in the first endfire antenna may be placed in the first region R1, and the third and fourth radiators 112*a* and 112*b* included in the second endfire antenna may be placed in the sixth region R6.

Alternatively, in some exemplary embodiments, the first and second radiators 111*a* and 111*b* included in the first endfire antenna may be placed in the third region R3, and the third and fourth radiators 112*a* and 112*b* included in the second endfire antenna may be placed in the fourth region R4.

Figure 4:
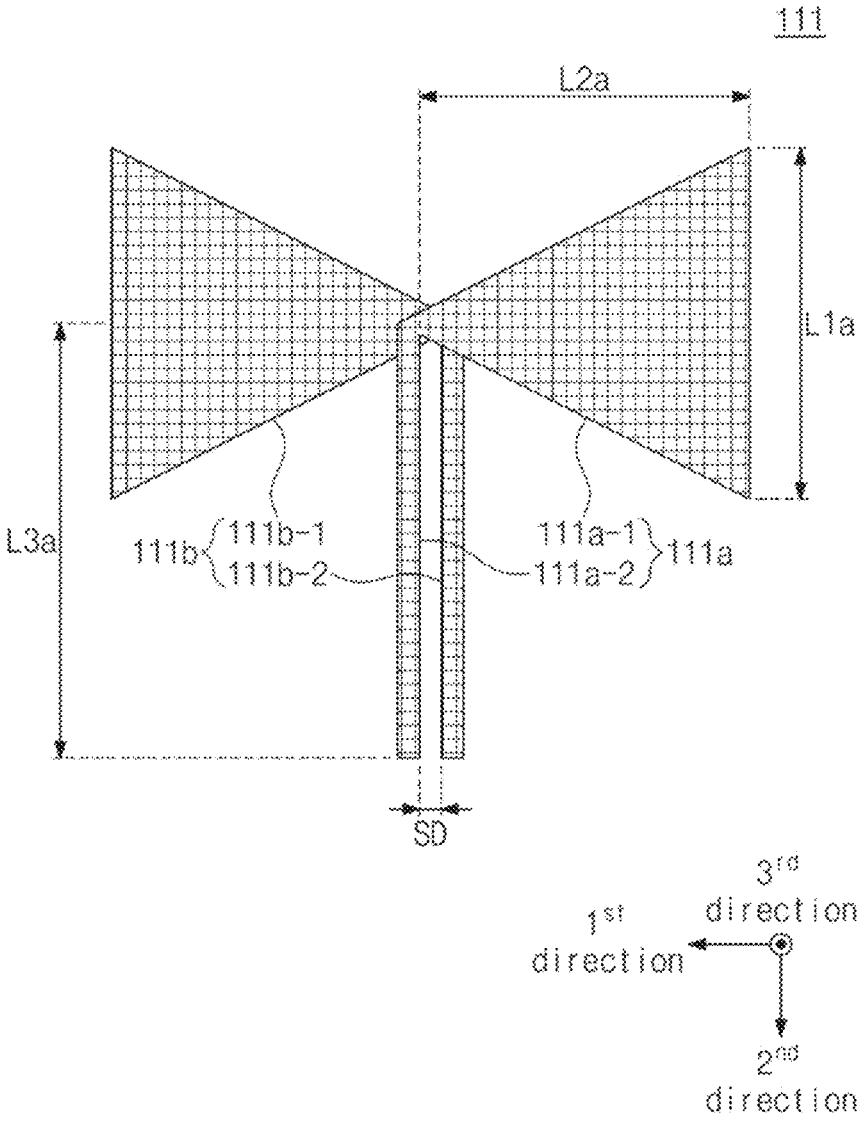
FIG. 4 is a view illustrating an endfire antenna of the antenna device of FIG. 1 in detail.

FIG. 4 is a view illustrating the endfire antenna of FIG. 1 in detail. The first endfire antenna 111 of FIG. 1 is illustrated in FIG. 4. The first endfire antenna 111 may be a dipole antenna operating in the first communication band. The first endfire antenna 111 may include the first and second radiators 111*a* and 111*b*.

The first radiator 111*a* may include a first shape 111*a*-1 and a second shape 111*a*-2 that are connected continuously (or seamlessly). The first shape 111*a*-1 may be a shape in which a width in the second direction widens in a direction facing away from the first direction. The second shape 111*a*-2 may be a shape that is extended from the penetration region of the barrier, which the first feed line penetrates, in the direction facing away from the second direction and is connected with the first shape 111*a*-1. For example, as a distance from the second shape 111*a*-2 increases in the direction facing away from the first direction, a width of the first shape 111*a*-1 in the second direction is widening. In other words, the first shape 111*a*-1 may be a triangular shape in which a vertex of the triangle is connected to an end of the second shape 111*a*-2.

The second radiator 111*b* may include a first shape 111*b*-1 and a second shape 111*b*-2 that are connected continuously (or seamlessly). The first shape 111*b*-1 may be a shape in which a width in the second direction widens in the first direction. The second shape 111*b*-2 may be a shape that is extended from the penetration region of the barrier, which the second feed line penetrates, in the direction facing away from the second direction and is connected with the first shape 111*b*-1. For example, as a distance from the second shape 111*b*-2 increases in the first direction, a width of the first shape 111*b*-1 in the second direction is widening. In other words, the first shape 111*b*-1 may be a triangular shape in which a vertex of the triangle is connected to an end of the second shape 111*b*-2. Additionally, when viewed from the third direction, the first and second radiators 111*a* and 111*b* may have a combined shape similar to a bow-tie.

In some exemplary embodiments, the first and second radiators 111*a* and 111*b* may have a size corresponding to the first communication band. For example, the first shape 111*a*-1, in which a width in the second direction is a first length L1*a* and a width in the first direction is a second length L2*a*, may resonate with a signal in the first communication band. In some exemplary embodiments, the first shape 111*b*-1 may be a shape that is identical in size to the first shape 111*a*-1 and is symmetrical to the first shape 111*a*-1.

In some exemplary embodiments, an antenna device having a coupling characteristic in which a bandwidth of a specific communication band increases may be provided based on the shapes of the first and second radiators 111*a* and 111*b*. For example, since an RF signal is fed through the second shapes 111*a*-2 and 111*b*-2 that are respectively formed at conductive layers spaced apart from each other in the third direction and are extended in the second direction as much as a third length L3*a*, an antenna device having a coupling characteristic in which a bandwidth of the first communication band increases may be provided.

In some exemplary embodiments, the first and second radiators 111*a* and 111*b* may be spaced from each other in the first direction by a separation distance SD. For example, the second shape 111*b*-2 of the second radiator 111*b* may be spaced from the second shape 111*a*-2 of the first radiator 111*a* in the first direction by the separation distance SD. As such, the first shape 111*a*-1 of the first radiator 111*a* and the first shape 111*b*-1 of the second radiator 111*b* may partially overlap each other in the third direction. In this case, communication characteristics of the antenna device such as a bandwidth, a gain, and a center frequency may vary depending on the separation distance SD.

In some exemplary embodiments, the second endfire antenna 112 may include shapes similar to those of the first endfire antenna 111. Thus, repeated detailed description thereof is omitted for conciseness. For example, the third and fourth radiators of the second endfire antenna may include shapes that have a size corresponding to the second communication band and are similar to the first shapes 111*a*-1 and 111*b*-1. The shape included in the third radiator may be connected with the third feed line. The shape included in the fourth radiator may be connected with the fourth feed line.

As described above, according to various exemplary embodiments, the endfire antenna of a bow tie type, which includes the first radiator 111*a* where a width in the second direction widens in the direction facing away from the first direction and the second radiator 111*b* where a width in the second direction widens in the direction facing away from the second direction may be provided.

Figure 5:
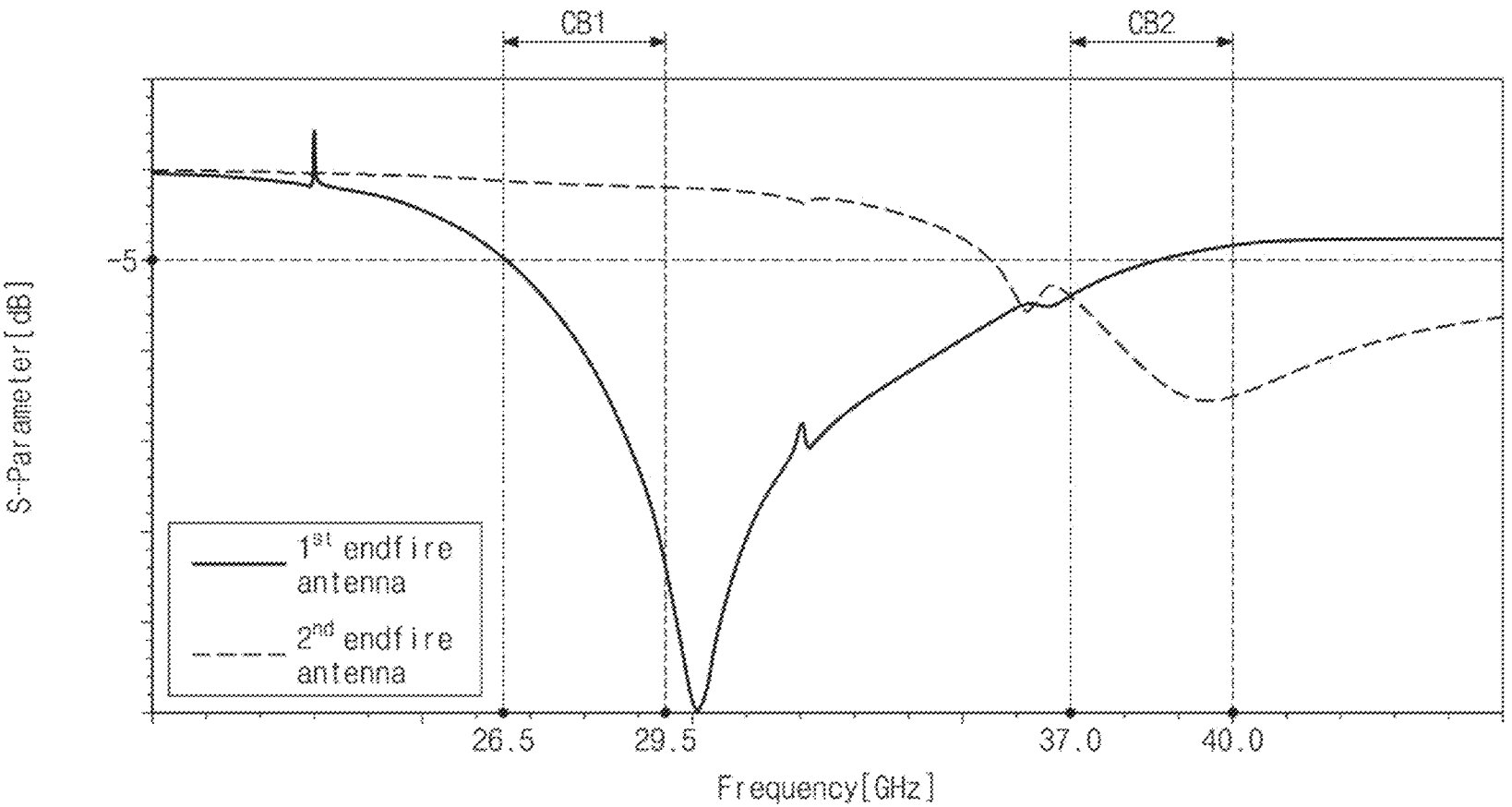
FIG. 5 is a graph illustrating an S-parameter of the antenna device of FIG. 1.

FIG. 5 is a graph illustrating an S-parameter of the antenna device of FIG. 1. The S-parameter of the antenna device 100 of FIG. 1 is illustrated in FIG. 5. A horizontal axis of the graph represents a frequency of an RF signal, which an antenna device transmits/receives, in units of Gigahertz (GHz). A vertical axis of the graph represents the S-parameter in units of decibel (dB). The S-parameter is a magnitude ratio of an output signal to an input signal of the antenna device and may mean a parameter indicating a radiation characteristic of the antenna device according to a frequency band.

A solid line indicates the S-parameter according to a frequency band of the first endfire antenna 111. A broken line indicates the S-parameter according to a frequency band of the second endfire antenna 112.

According to various exemplary embodiments, the antenna device 100 may operate in a frequency band having the S-parameter of a threshold value or less. For example, the first endfire antenna 111 may have the S-parameter lower than −5 dB being the threshold value in a first communication band CB1 between 26.5 GHz and 29.5 GHz. As such, the first endfire antenna 111 may operate in the first communication band CB1.

For example, the second endfire antenna 112 may have the S-parameter lower than −5 dB being the threshold value in a second communication band CB2 between 37.0 GHz and 40.0 GHz. As such, the second endfire antenna 112 may operate in the second communication band CB2.

As described above, according to various exemplary embodiments, a multi-band antenna device transmitting/receiving an RF signal in the first communication band CB1 and the second communication band CB2 may be provided.

Figure 6:
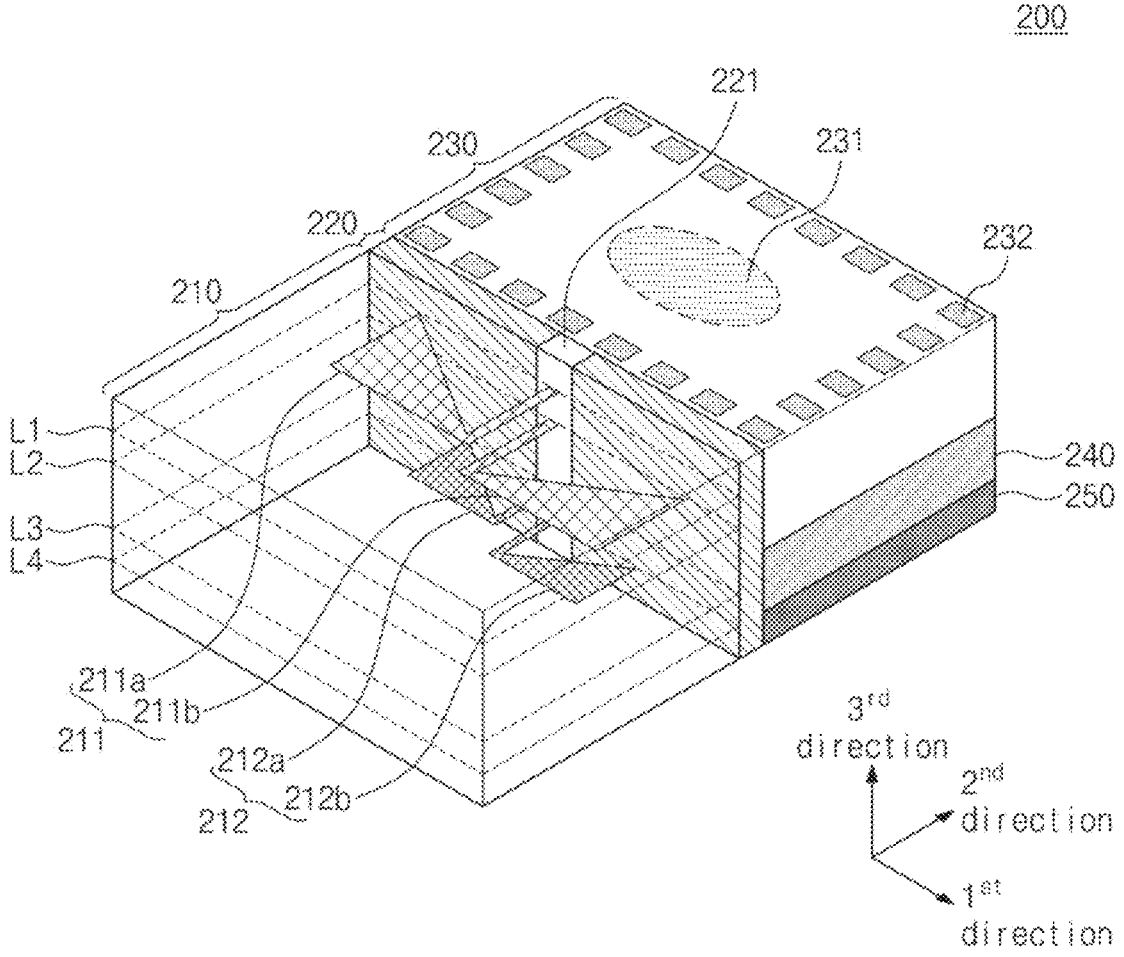
FIG. 6 is a perspective view illustrating an antenna device according to an embodiment.

FIG. 6 is a perspective view illustrating an antenna device according to an embodiment. Referring to FIG. 6, a perspective view of an antenna device 200 according to various exemplary embodiments is illustrated. A barrier 220, a penetration region 221, a patch antenna space 230, a patch antenna 231, a feed space 240, and a signal processing device 250 are similar to the barrier 120, the penetration region 121, the patch antenna space 130, the patch antenna 131, the feed space 140, and the signal processing device 150, and thus, repeated description will be omitted for conciseness and to avoid redundancy.

An endfire antenna space 210 may include first and second endfire antennas 211 and 212. The first endfire antenna 211 may include first and second radiators 211*a* and 211*b*. The second endfire antenna 212 may include third and fourth radiators 212*a* and 212*b*. In this case, the first to fourth radiators 211*a*, 211*b*, 212*a*, and 212*b* may have a different shape that is narrower in terms of a width in the second direction than the first to fourth radiators 111*a*, 111*b*, 112*a*, and 112*b*.

According to various exemplary embodiments, the first to fourth radiators 211*a*, 211*b*, 212*a*, and 212*b* may have a radiation characteristic similar to that of the first to fourth radiators 111*a*, 111*b*, 112*a*, and 112*b*. For example, the first radiator 111*a* of FIG. 1 may have a radiation pattern symmetrical around an axis parallel to the first direction. Because the radiation pattern is symmetrical, an original radiation pattern may be generated even though only half the radiator 111*a* exists. As such, the first radiator 211*a* may have a radiation characteristic similar to that of the first radiator 111*a* of FIG. 1.

As described above, according to various exemplary embodiments, the first and second endfire antennas 211 and 212 of a half bow tie type, which are smaller in size than the endfire antennas of the bow tie type illustrated in FIG. 1, may be provided by reducing a size of a radiator based on the symmetrical characteristic of the radiation pattern.

Figure 7:
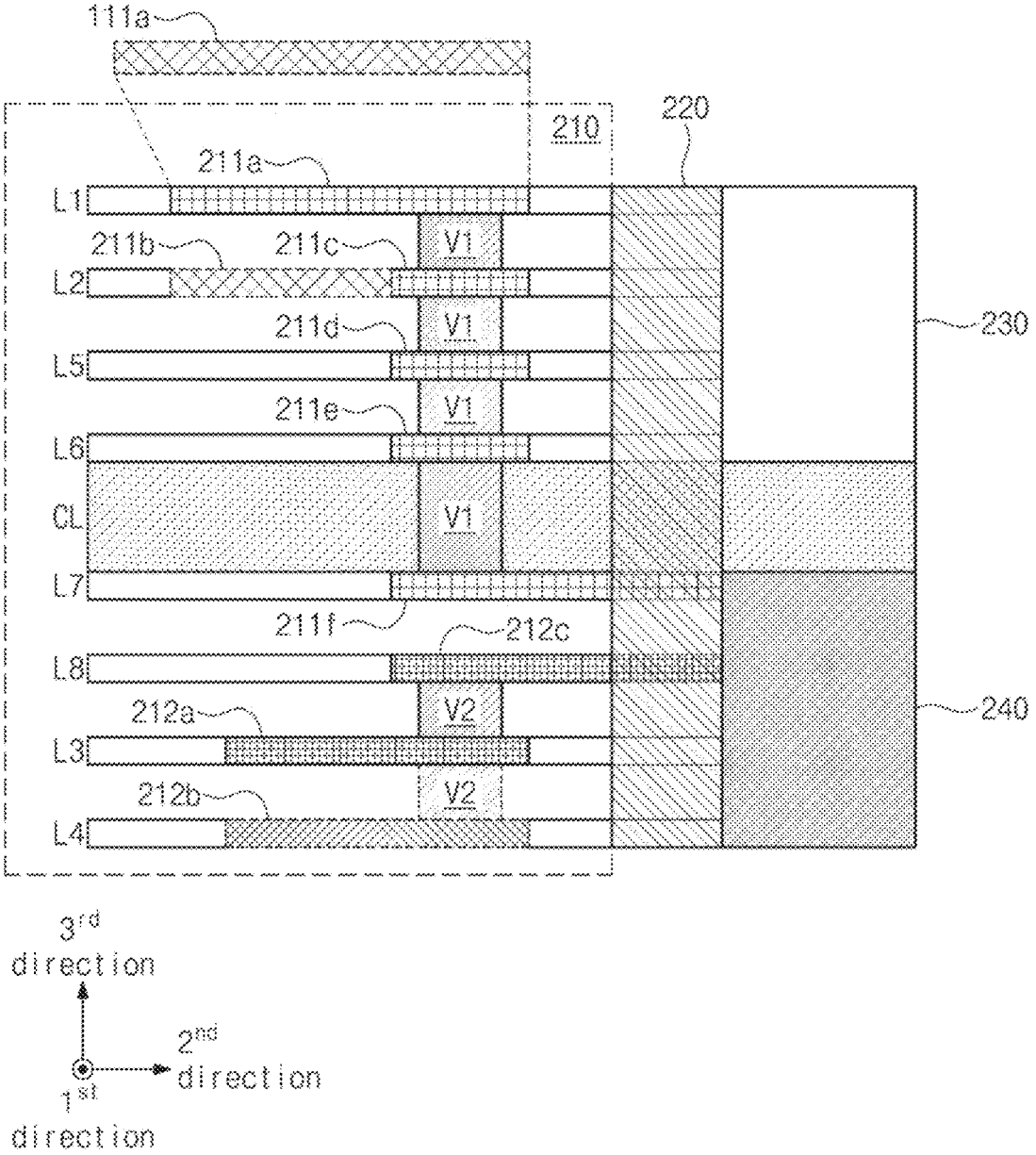
FIG. 7 is a cross-sectional view illustrating the antenna device of FIG. 6 in detail.

FIG. 7 is a cross-sectional view illustrating the antenna device of FIG. 6 in detail. For better understanding, the endfire antenna space 210 is depicted in FIG. 7 has a scale different from that of FIG. 6.

Widths of the first to fourth radiators 211*a*, 211*b*, 212*a*, and 212*b* in the second direction may be narrower than the widths of the first to fourth radiators 111*a*, 111*b*, 112*a*, and 112*b* (refer to FIG. 2), respectively, in the second direction. It is noted that the first radiator 111*a* is illustrated for comparison purposes only in FIG. 7 and is not actually included in the antenna device illustrated in FIG. 7. For example, the width of the first radiator 211*a* in the second direction may be narrower than the width of the first radiator 111*a* (refer to FIG. 2) in the second direction. As such, a size of the endfire antenna space 210 may be smaller than a size of the endfire antenna space 110 of FIG. 2.

Figure 8A:
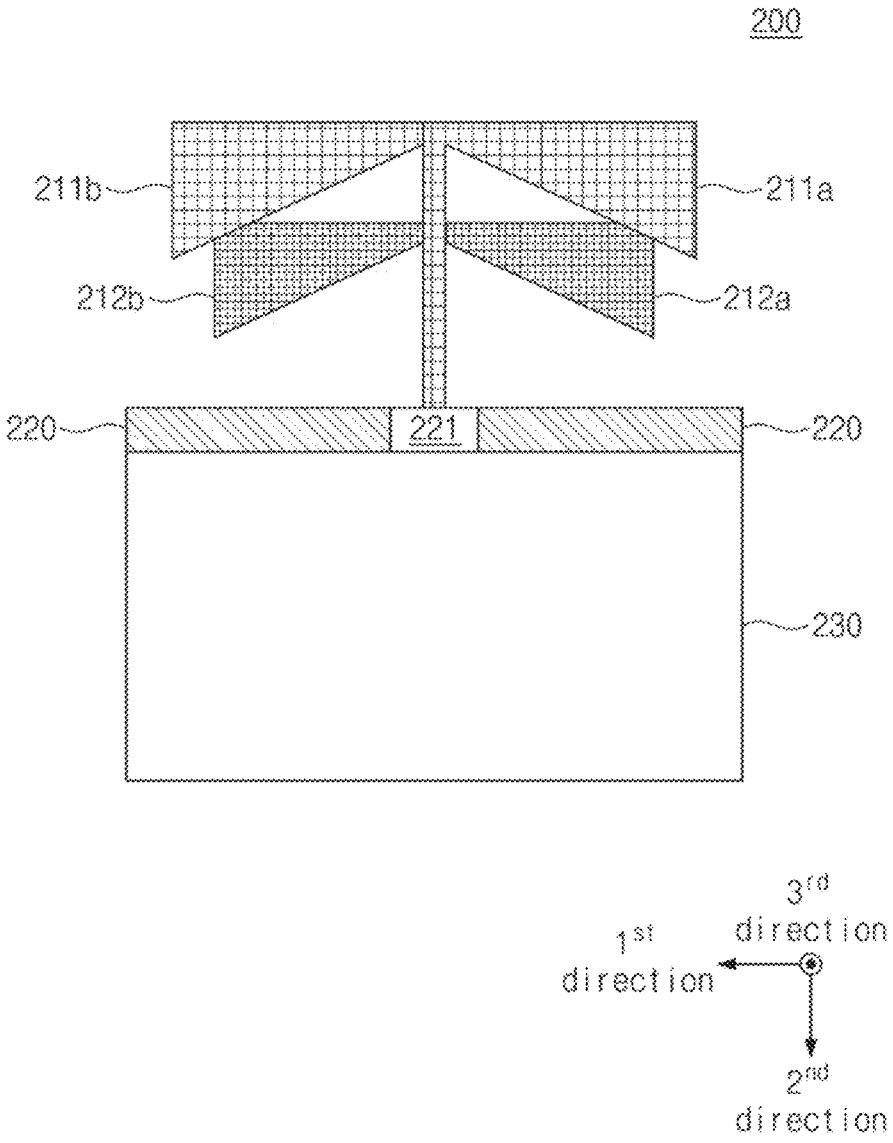
FIG. 8A is a plan view illustrating the antenna device of FIG. 6.

FIG. 8A is a plan view illustrating the antenna device of FIG. 6. Shapes and placement of the first and second radiators 211*a* and 211*b* of the first endfire antenna and the third and fourth radiators 212*a* and 212*b* of the second endfire antenna are illustrated in FIG. 8A. In some exemplary embodiments, the first and second radiators 211*a* and 211*b* may be extended to be longer in the direction facing away from the second direction than the third and fourth radiators 212*a* and 212*b*.

Figure 8B:
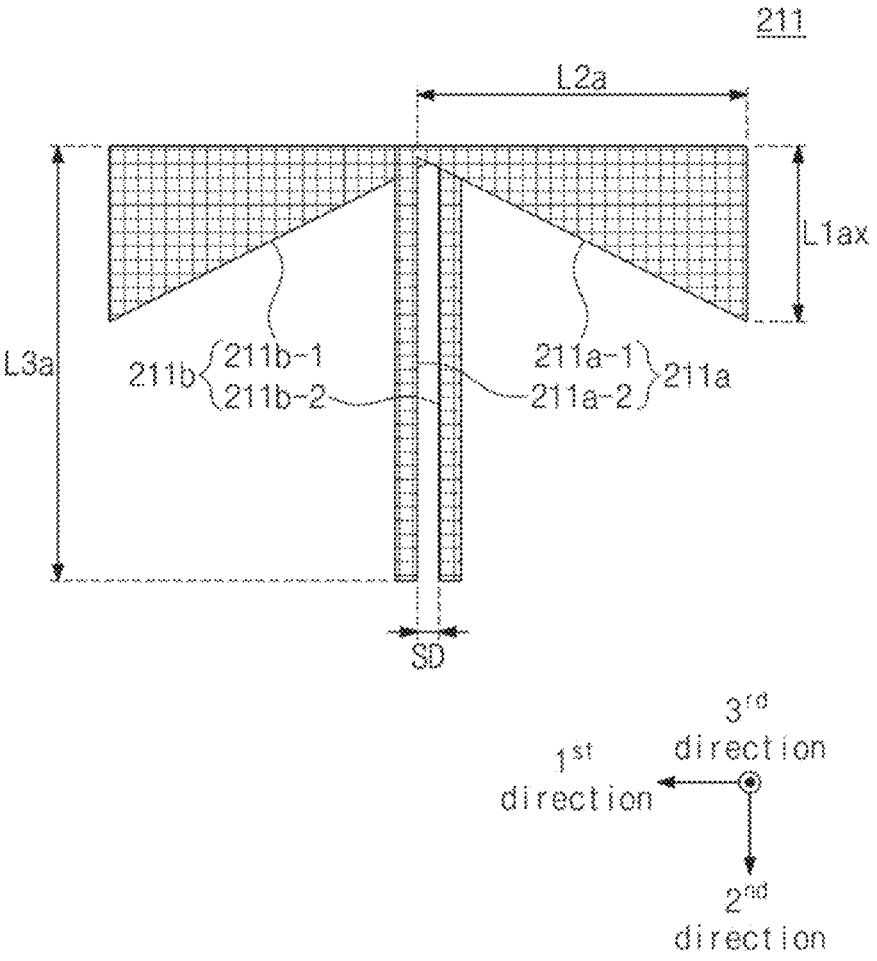
FIG. 8B is a view illustrating an endfire antenna of the antenna device of FIG. 6 in detail.

FIG. 8B is a view illustrating the endfire antenna of the antenna device of FIG. 6 in detail. The first endfire antenna 211 of FIG. 6 is illustrated in FIG. 8B. The first endfire antenna 211 may be a dipole antenna operating in the first communication band. The first endfire antenna 211 may include the first and second radiators 211*a* and 211*b*. The second shape 211*b*-2 may be spaced from the second shape 211*a*-2 in the first direction as much as the separation distance SD.

The first radiator 211*a* may include a first shape 211*a*-1 and a second shape 211*a*-2 that are connected continuously (or seamlessly). The second shape 211*a*-2 may be similar to the second shape 111*a*-2 of FIG. 4. The first shape 211*a*-1 may be a shape in which a width in the second direction widens in the direction facing away from the first direction. The first shape 211*a*-1 may be a shape including a first side, a second side, and at least one side connecting the first and second sides. In this case, the first side may be a side extended from the connected second shape 211*a*-2 in the direction facing away from the first direction, and the second side may be a side extended from one end of the first side, which faces the direction opposite to the first direction, in the second direction. The shape of the second radiator 211*b* and the shape of the first radiator 211*a* may be symmetrical with respect to an axis parallel to the second direction.

In some exemplary embodiments, the first shape 211*a*-1 may be narrower in a width in the second direction than the first shape 111*a*-1 of FIG. 4. For example, in some exemplary embodiments, a first length L1*ax* being the width of the first shape 211*a*-1 in the second direction may be half the first length L1*a* being the width of the first shape 111*a*-1 (refer to FIG. 4) in the second direction. As such, an endfire antenna that is implemented within a narrow space may be provided.

In some exemplary embodiments, the second endfire antenna may include shapes similar to those of the first endfire antenna. For example, the third and fourth radiators of the second endfire antenna may include shapes that have a size corresponding to the second communication band but with a shapes that are similar to the first shapes 211*a*-1 and 211*b*-1.

Figure 9A:
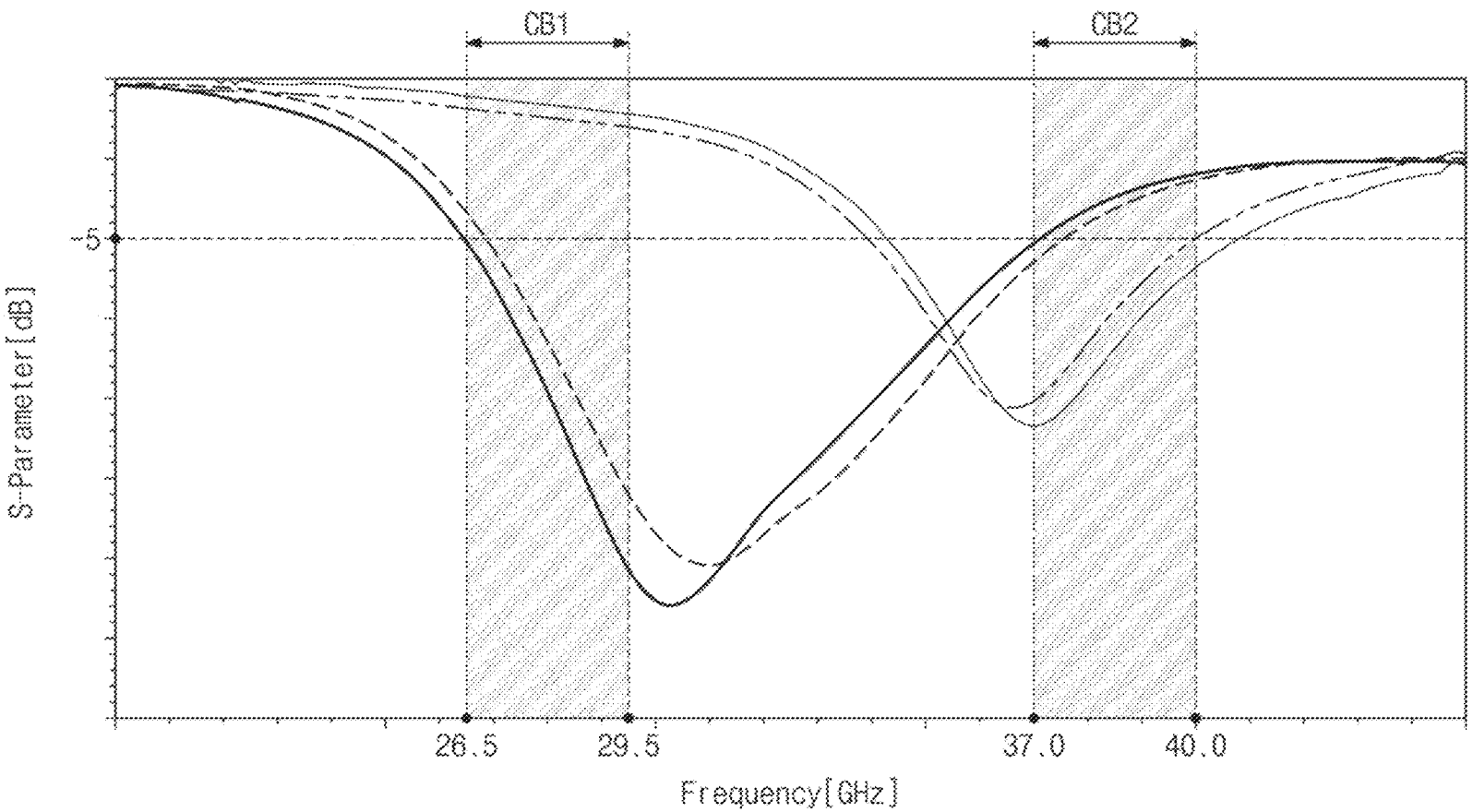
FIGS. 9A to 9C are graphs illustrating communication characteristics of the antenna device of FIG. 6, to which carrier aggregation is not applied.
Figure 9B:
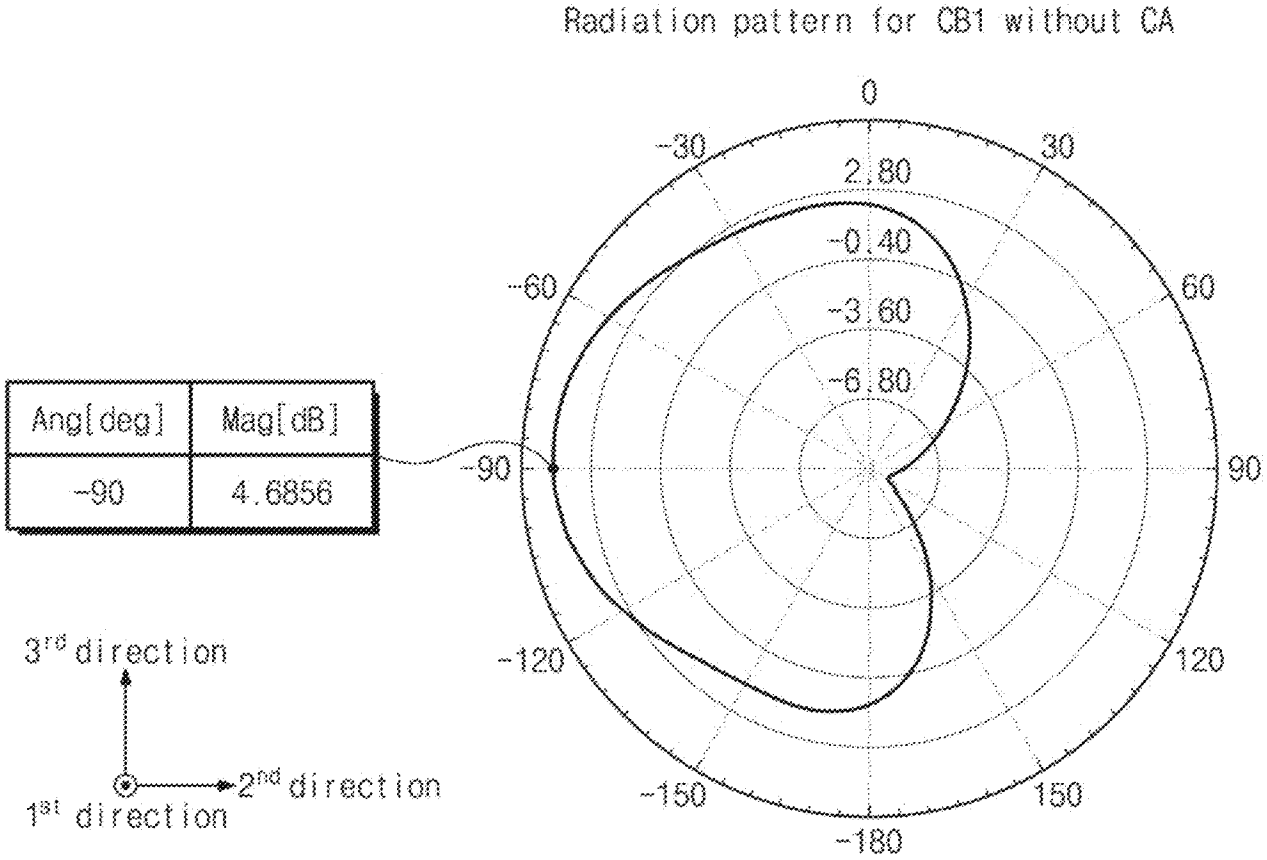
Figure 9C:
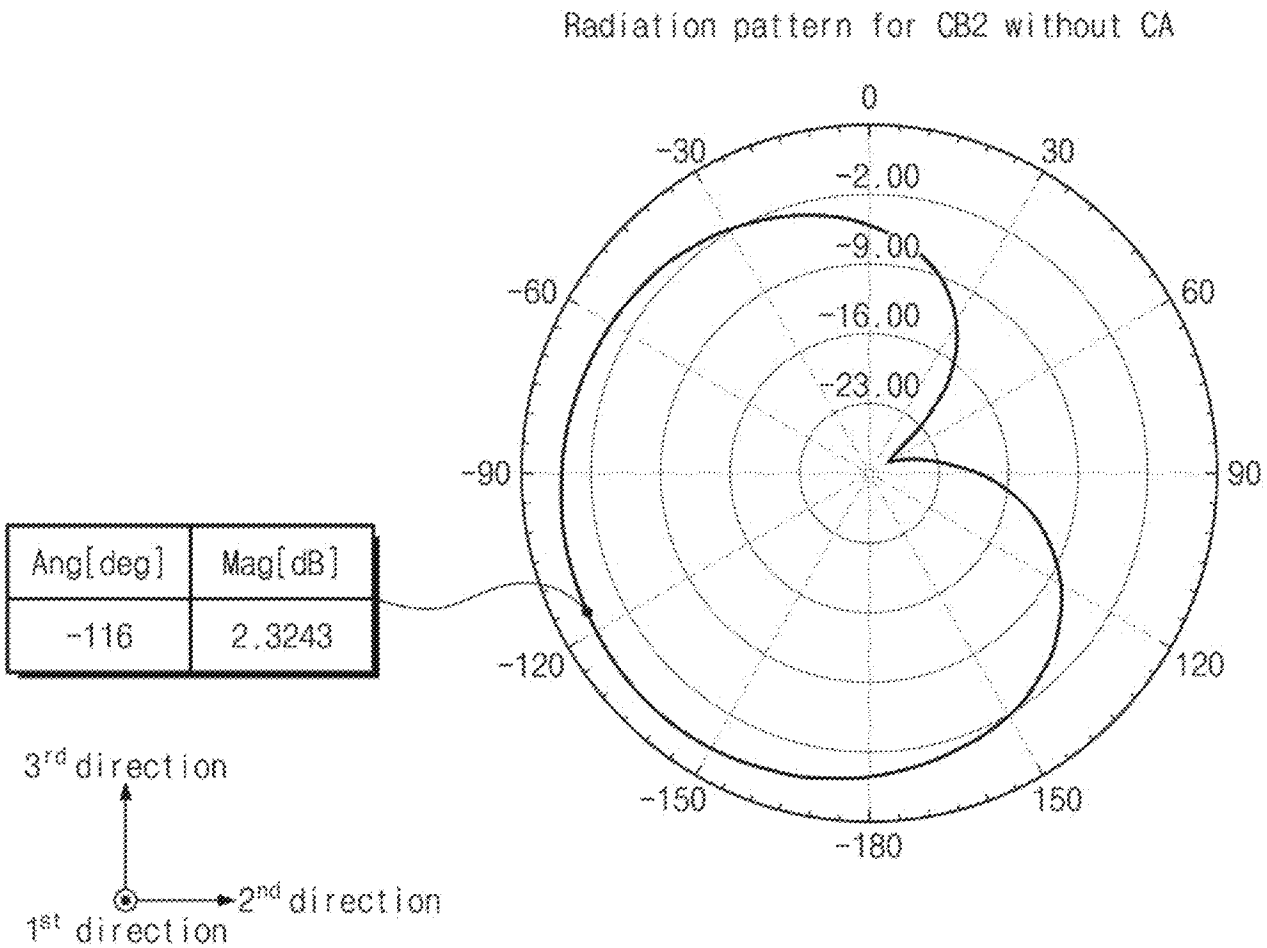

FIGS. 9A to 9C are graphs illustrating communication characteristics of the antenna device of FIG. 6, to which carrier aggregation is not applied. An S-parameter of the antenna device 200 of FIG. 6, to which carrier aggregation (CA) is not applied, is illustrated in FIG. 9A with regard to embodiments in which port conditions of an antenna are different. Different types of lines may mean embodiments in which port conditions of an antenna are different, respectively. For example, a thick solid line may indicate an S-parameter for a first endfire antenna 211 with a first input port and a first output port, a dashed line may indicate an S-parameter for a first endfire antenna 211 with a second input port and a second output port, a thin solid line may indicate an S-parameter for a second endfire antenna 212 with a third input port and a third output port, and a two-dot chain line may indicate an S-parameter for a second endfire antenna 212 with a fourth input port and a fourth output port. However, exemplary embodiments are not limited thereto. The different port conditions for the endfire antenna with the input port and the output port may be clearly understood by referring to FIG. 37, described further below.

In this case, the S-parameter may indicate a ratio of a voltage magnitude of an output port to a voltage magnitude of an input port. That port conditions are different may mean to differently set a radiator of an endfire antenna connected with an input port and a radiator of an endfire antenna connected with an output port.

In this case, the CA may mean that different frequency bands are aggregated and used. For example, in the case of applying the CA, the first endfire antenna 211 corresponding to the first communication band CB1 and the second endfire antenna 212 corresponding to the second communication band CB2 may operate at the same time.

For example, in the case wherein the CA is not applied, the first endfire antenna 211 corresponding to the first communication band CB1 and the second endfire antenna 212 corresponding to the second communication band CB2 may operate one by one (i.e., the communication using the first communication band and the communication using the second communication band may be performed separately from each other and thus not at the same time).

An S-parameter waveform of antennas having the S-parameter of the threshold value (e.g., −5 dB) in the first communication band CB1 is illustrated in FIG. 9A. Also, an S-parameter waveform of antennas having the S-parameter of the threshold value in the second communication band CB2 is illustrated in FIG. 9A. That is, according to various exemplary embodiments, a multi-band antenna device transmitting/receiving RF signals in the first and second communication bands CB1 and CB2 without the CA may be provided.

Referring to FIGS. 6 and 9B, a radiation pattern in the first communication band CB1 associated with the antenna device 200 to which the CA is not applied is illustrated. A radiation pattern may be a pattern indicating a space in which the intensity of electromagnetic waves corresponding to an RF signal is greater than a reference magnitude sensed at an antenna. The antenna device 200 may be placed at the center of the graph. The second direction may be a direction in which an RF signal in the first communication band CB1 is reflected by the barrier 220. The direction facing away from the second direction may be a direction in which the RF signal in the first communication band CB1 is intensively radiated by the first endfire antenna 211.

Referring to FIGS. 6 and 9C, a radiation pattern in the second communication band CB2 associated with the antenna device 200 to which the CA is not applied is illustrated. In some exemplary embodiments, a point at which a radiation pattern is maximized may be finely tuned. Through the fine tuning, a point at which a radiation pattern is maximized may be adjusted by tuning a shape of a radiator constituting an antenna.

For example, the radiation pattern in the second communication band CB2 associated with the antenna device 200 may be maximized at −116 degrees. Through the fine tuning, an angle at which the radiation pattern in the second communication band CB2 is maximized may be changed from −116 degrees to −90 degrees. As illustrated in FIGS. 9A to 9C, the antenna device 200 of FIG. 6, to which the CA is not applied, may operate in the first and second communication bands CB1 and CB2.

Figure 10A:
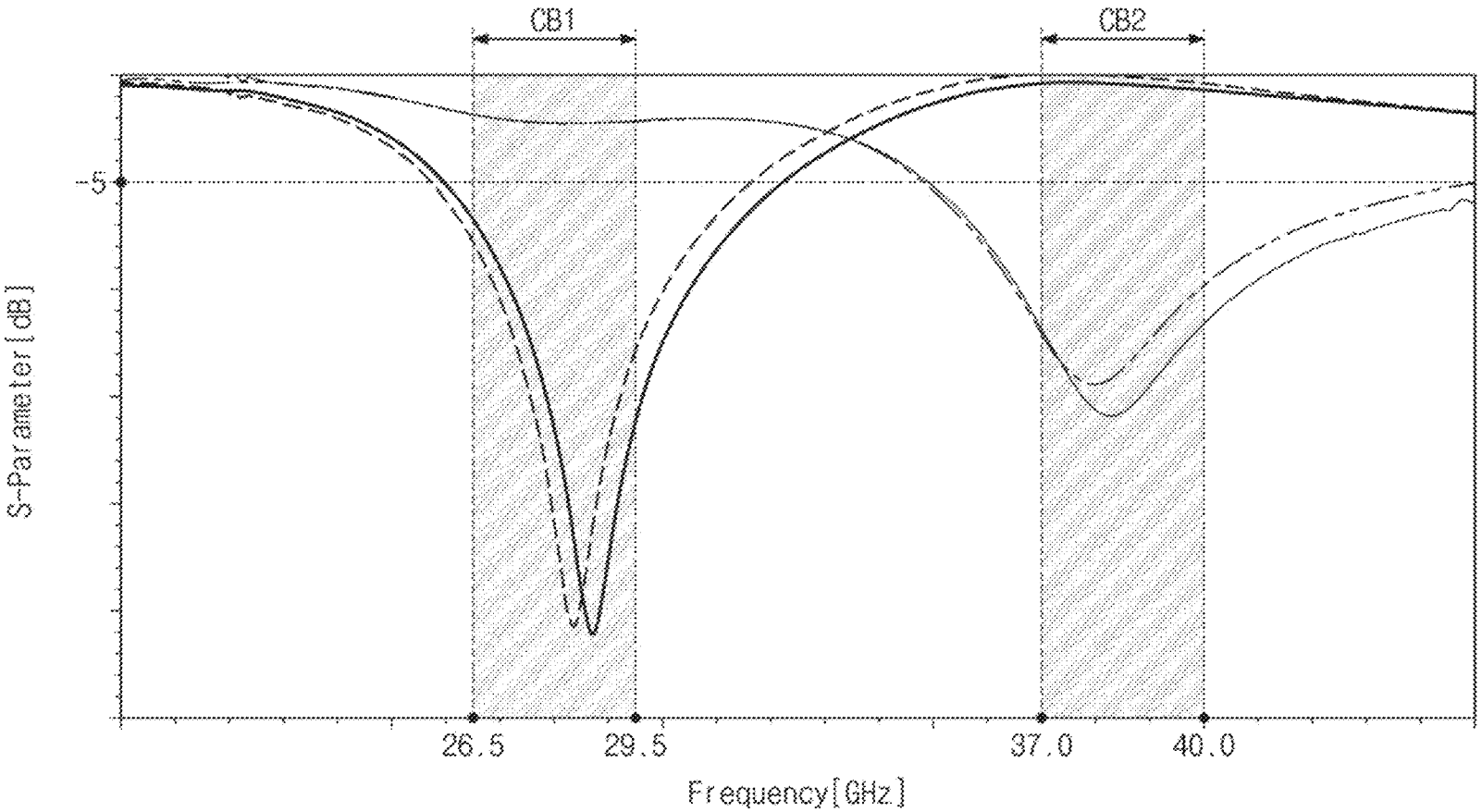
FIGS. 10A to 10C are graphs illustrating communication characteristics of the antenna device of FIG. 6, to which carrier aggregation is applied.
Figure 10B:
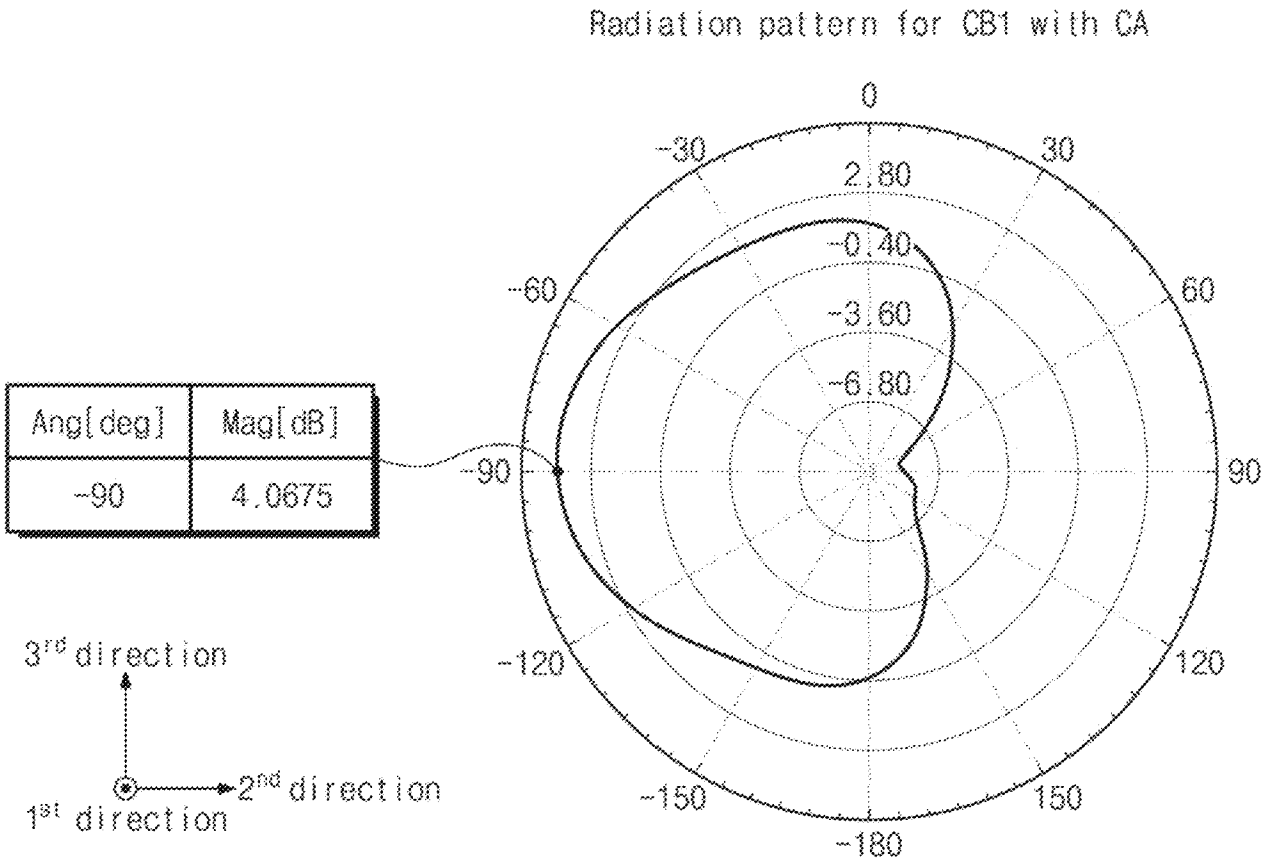
Figure 10C:
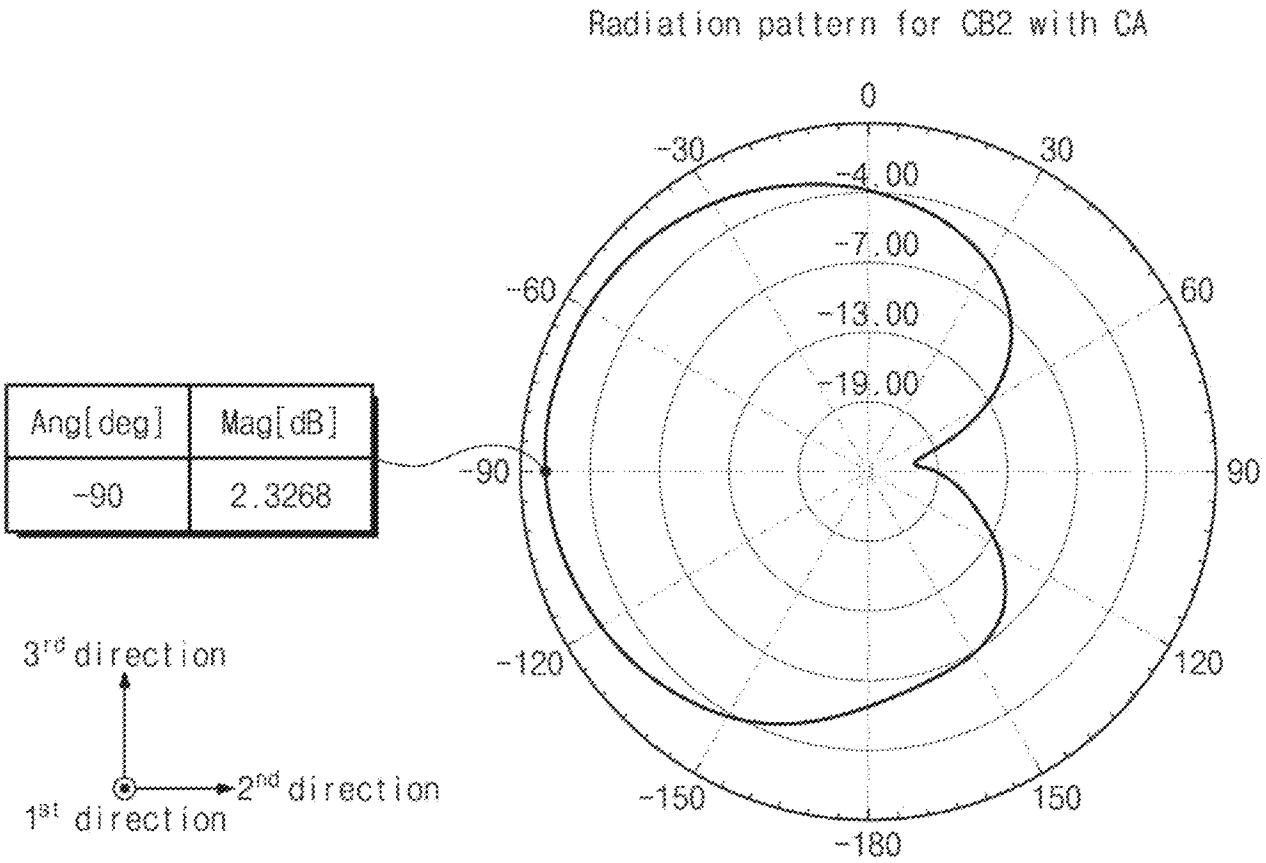

FIGS. 10A to 10C are graphs illustrating communication characteristics of the antenna device of FIG. 6, to which carrier aggregation is applied. An S-parameter of the antenna device 200 of FIG. 6, to which the CA is applied, is illustrated in FIG. 10A. In detail, an S-parameter waveform of antennas having the S-parameter of the threshold value (e.g., −5 dB) in the first communication band CB1 and an S-parameter waveform of antennas having the S-parameter of the threshold value in the second communication band CB2 are illustrated as an example. That is, according to various exemplary embodiments, a multi-band antenna device transmitting/receiving RF signals in the first and second communication bands CB1 and CB2 with the CA applied may be provided.

Referring to FIGS. 6 and 10B, a radiation pattern in the first communication band CB1 associated with the antenna device 200 to which the CA is applied is illustrated. Referring to FIGS. 6 and 10C, a radiation pattern in the second communication band CB2 associated with the antenna device 200 to which the CA is applied is illustrated. As illustrated in FIGS. 10A to 10C, the antenna device 200 of FIG. 6, to which the CA is applied, may operate in the first and second communication bands CB1 and CB2.

Figure 11:
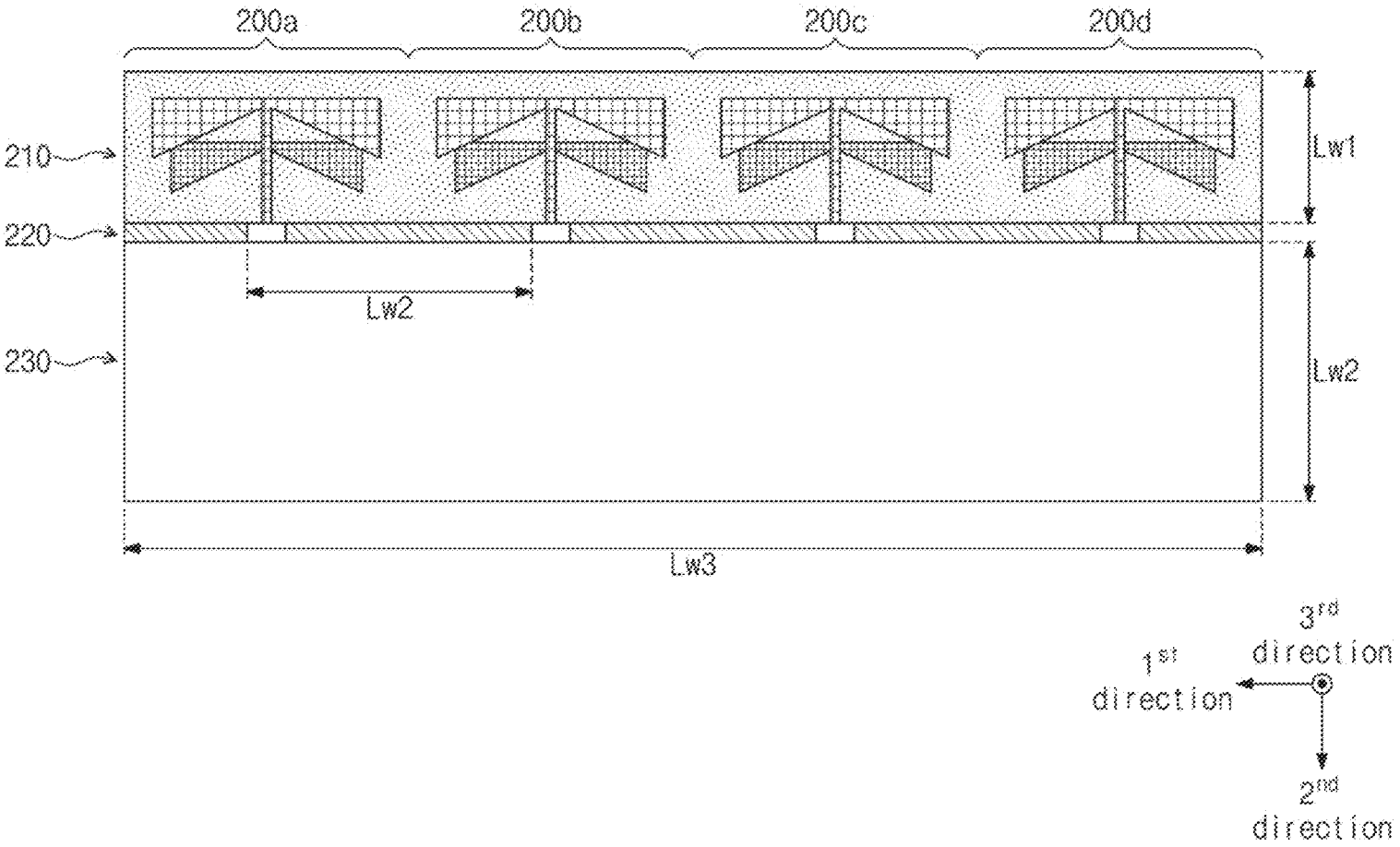
FIG. 11 is a plan view illustrating a 4-bay antenna device according to an embodiment.

FIG. 11 is a plan view illustrating a 4-bay antenna device according to an embodiment. A 4-bay antenna device of a half bow tie type is illustrated in FIG. 11. Each of antenna devices 200*a* to 200*d* included in the 4-bay antenna device may have a configuration similar to that of the antenna device 200 of FIG. 6.

According to various exemplary embodiments, an endfire antenna space of the 4-bay antenna device may have a width Lw1 in the second direction. Adjacent endfire antennas included in the endfire antenna space may be spaced apart from each other in the first direction by a width Lw2. A patch antenna space of the 4-bay antenna device may have the width Lw2 in the second direction and a width Lw3 in the first direction. For example, the width Lw1 may be about 2 mm, the width Lw2 may be about 5 mm, and the width Lw3 may be about 20 mm.

Figure 12A:
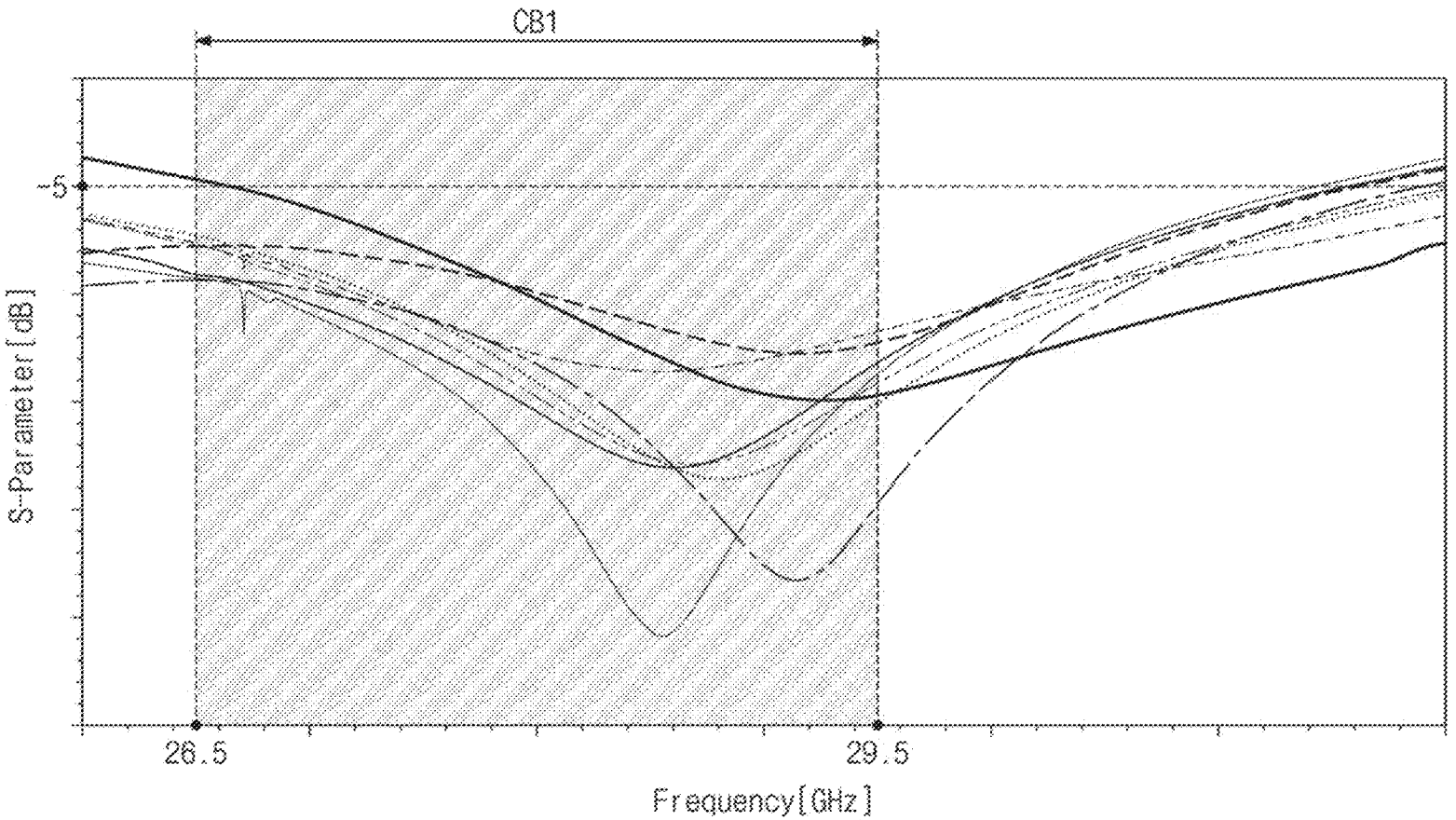
FIGS. 12A to 12C are graphs illustrating communication characteristics of the 4-bay antenna device of FIG. 11 in a first communication band.
Figure 12B:
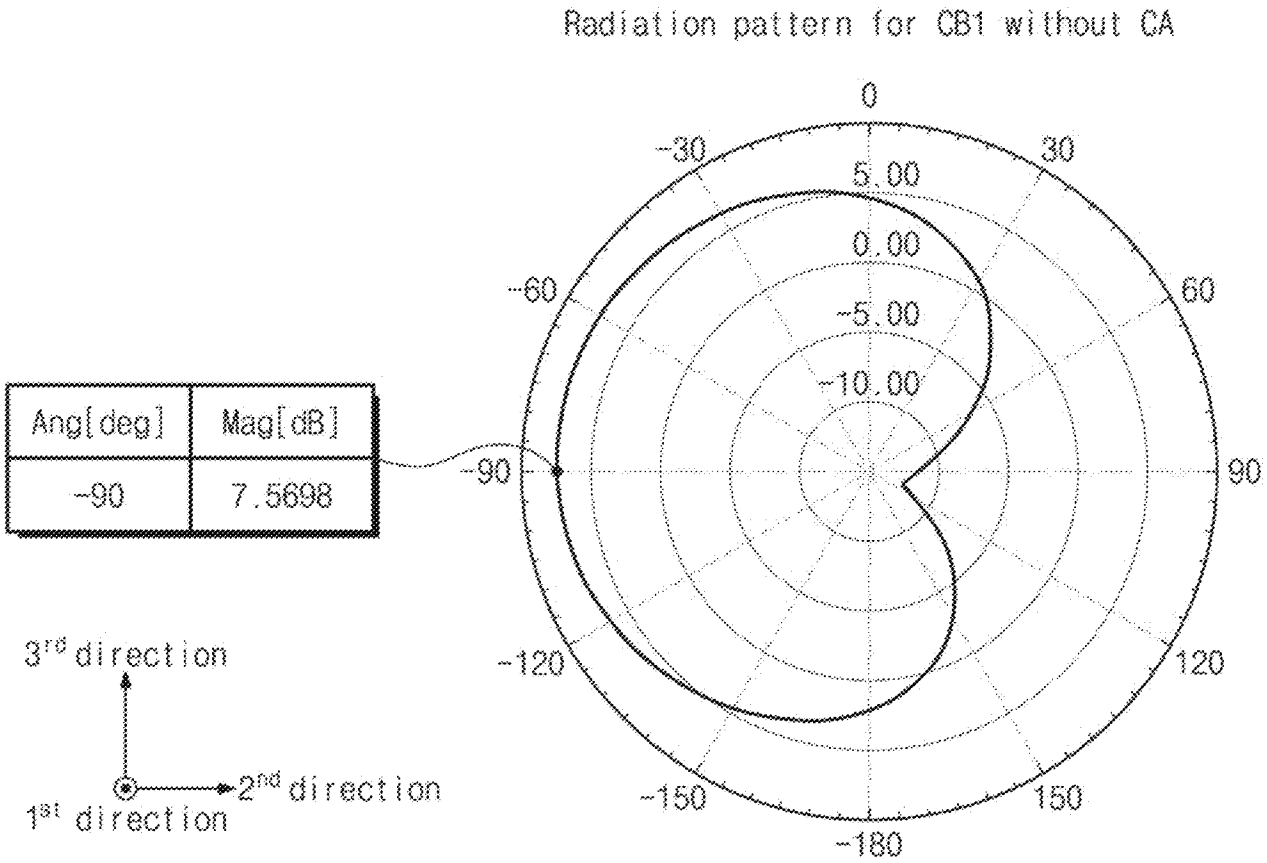
Figure 12C:
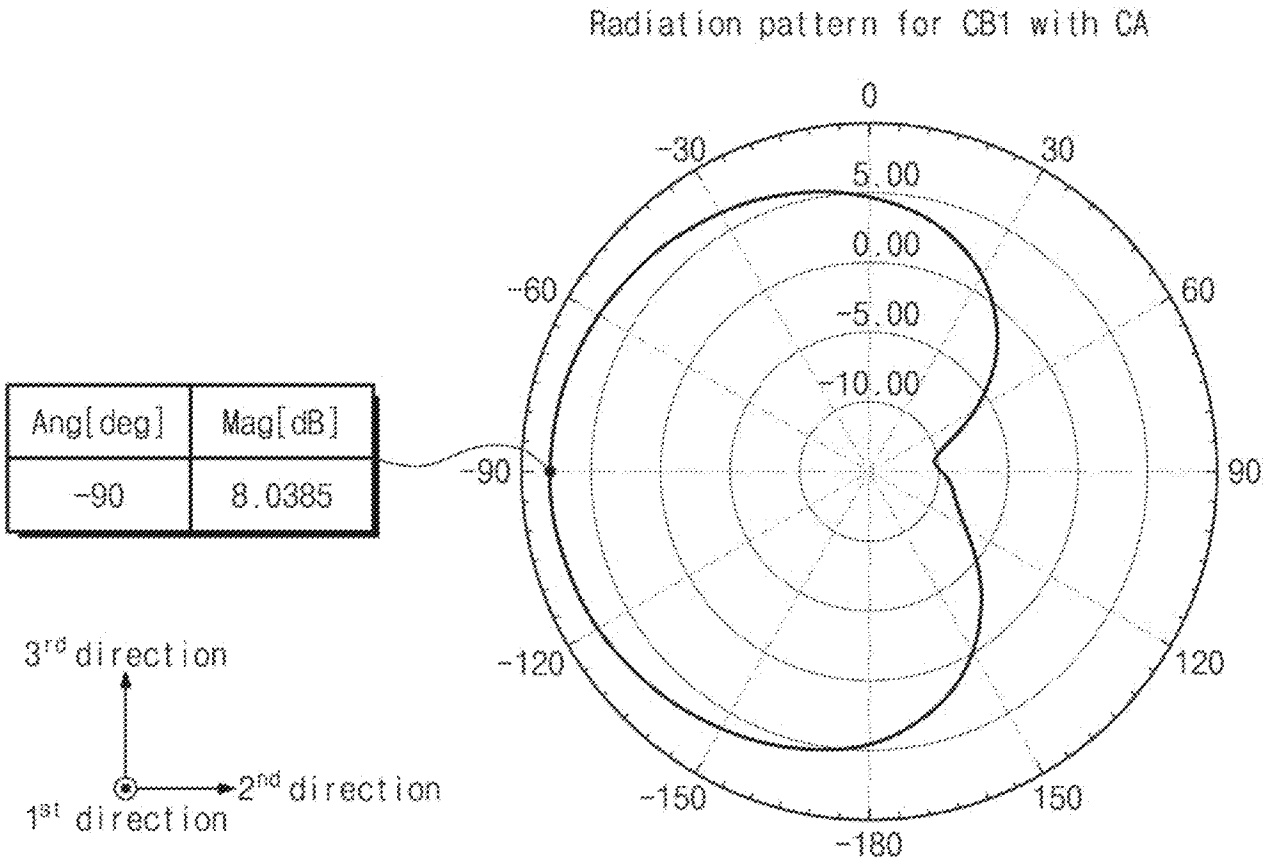

FIGS. 12A to 12C are graphs illustrating communication characteristics of the 4-bay antenna device of FIG. 11 in the first communication band. An S-parameter in the first communication band CB1 associated with the 4-bay antenna device of FIG. 11 is illustrated in FIG. 12A. A radiation pattern in the first communication band CB1 associated with the 4-bay antenna device of FIG. 11, to which the CA is not applied, is illustrated in FIG. 12B. A radiation pattern in the first communication band CB1 associated with the 4-bay antenna device of FIG. 11, to which the CA is applied, is illustrated in FIG. 12C.

In some exemplary embodiments, an antenna device may operate in a frequency band having the S-parameter of the threshold value or less. For example, referring to FIG. 12A, an antenna having the S-parameter of −5 dB or less in the first communication band CB1 may be used for the communication using the first communication band CB1.

Figure 13A:
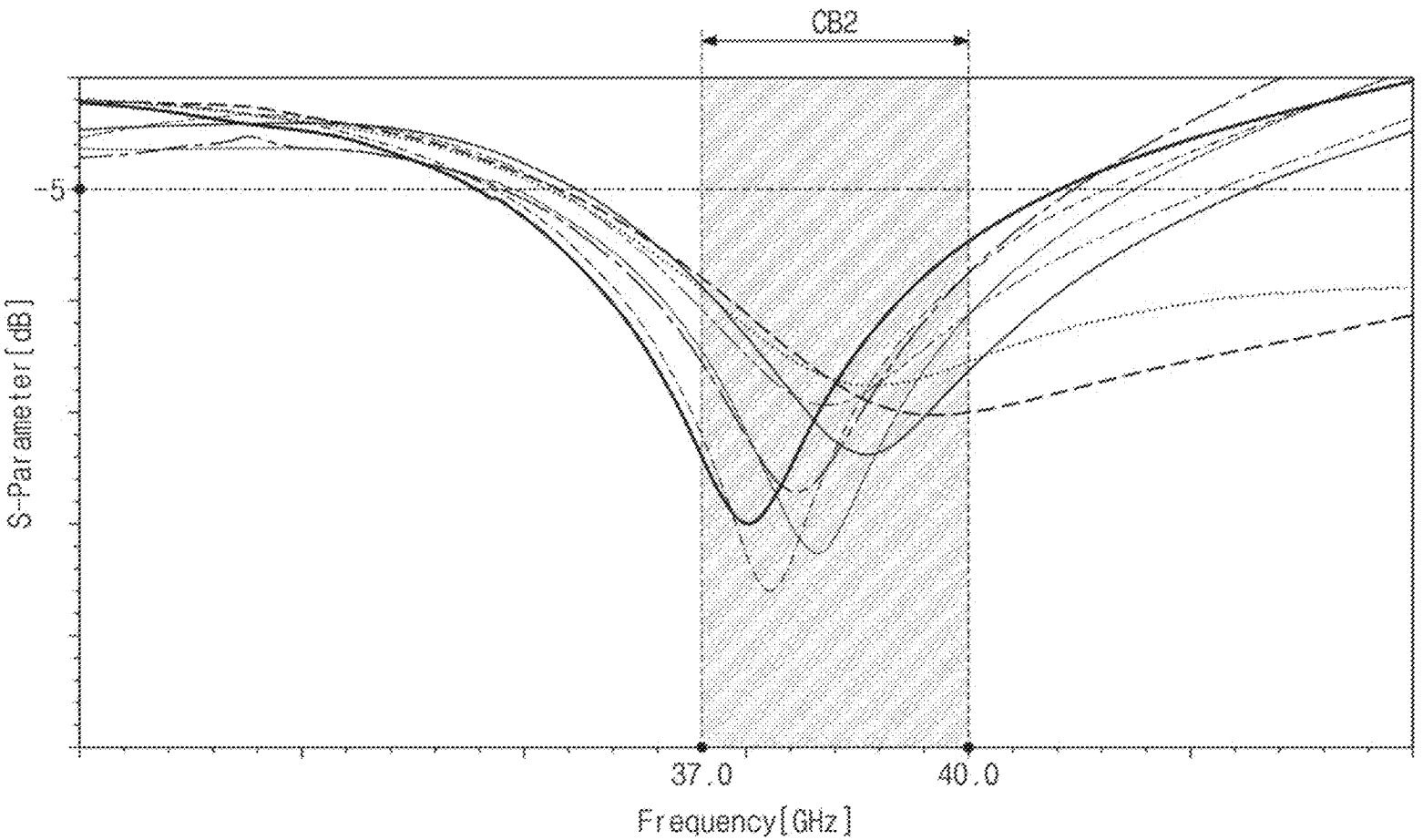
FIGS. 13A to 13C are graphs illustrating communication characteristics of the 4-bay antenna device of FIG. 11 in a second communication band.
Figure 13B:
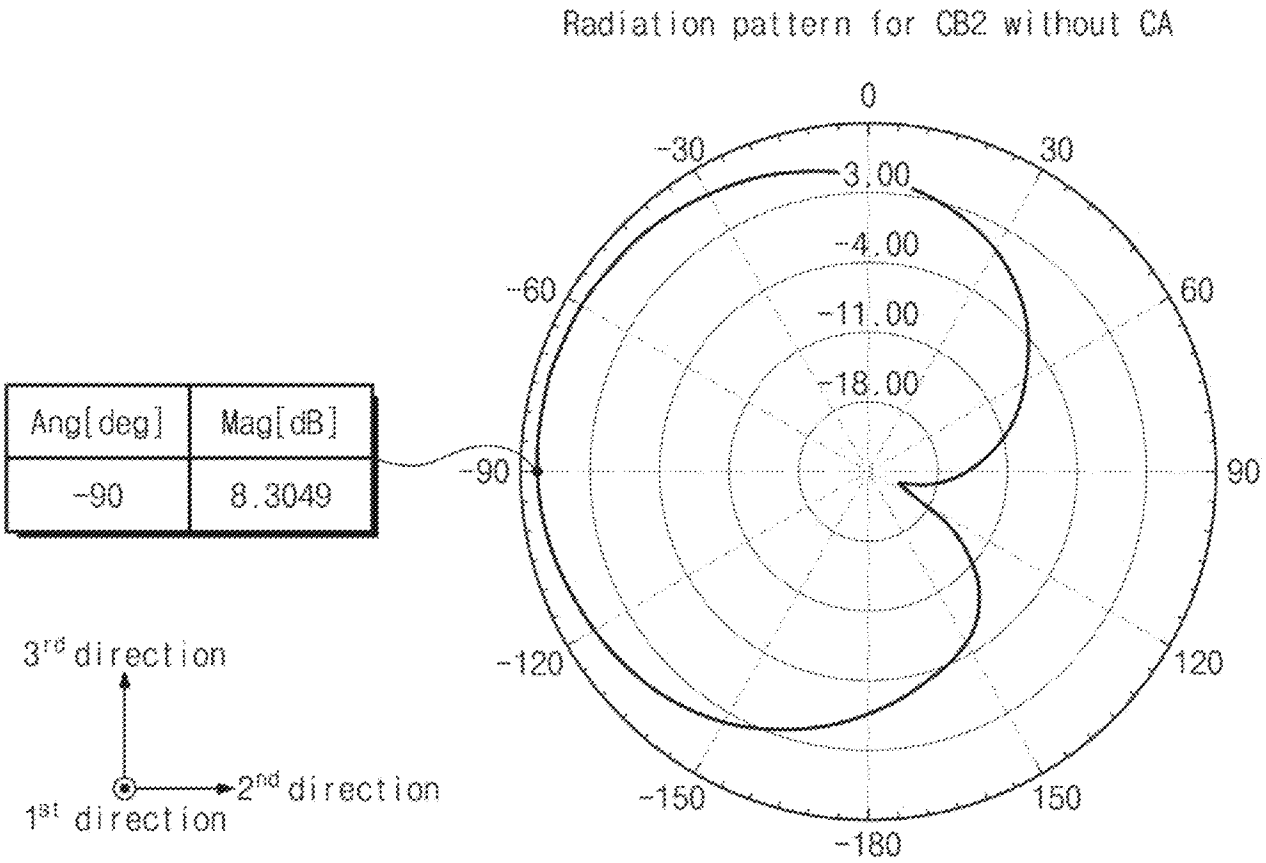
Figure 13C:
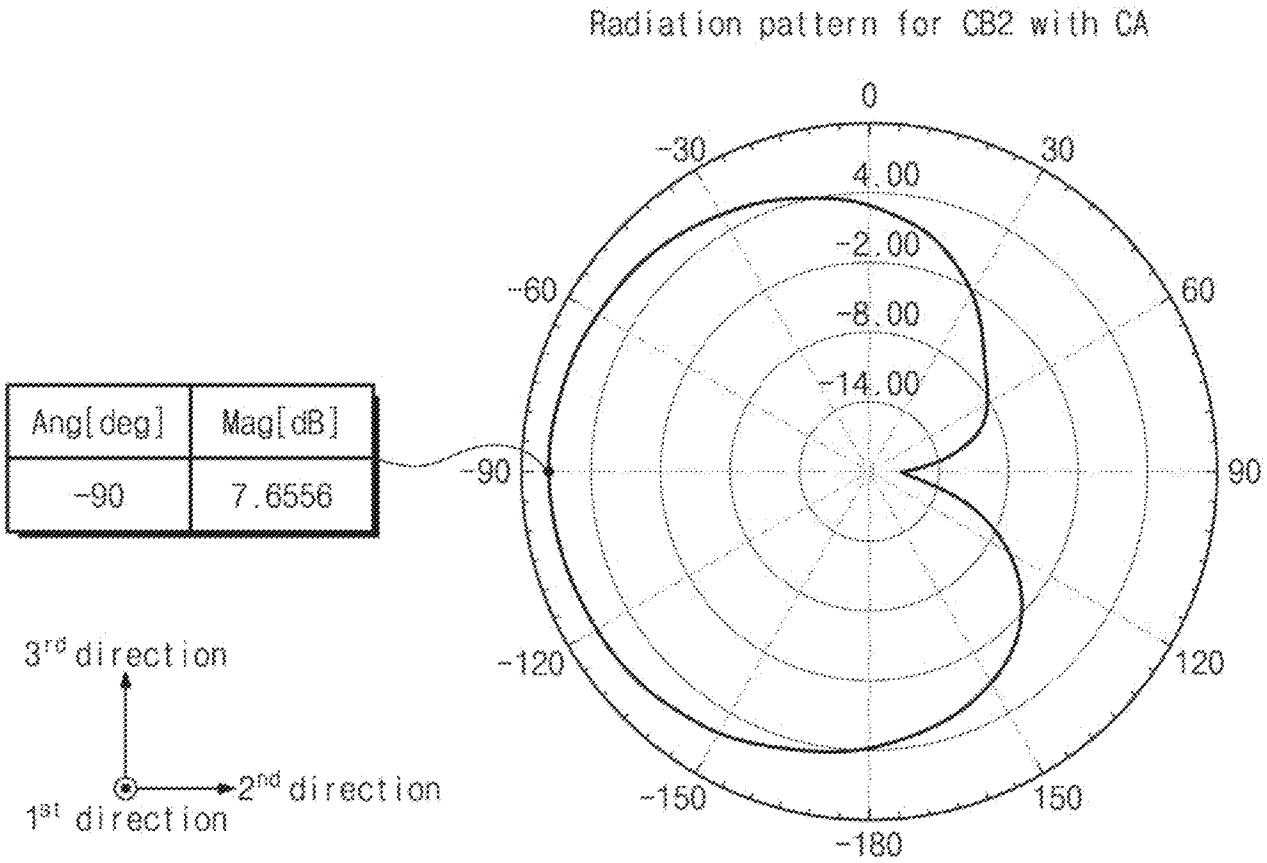

FIGS. 13A to 13C are graphs illustrating communication characteristics of the 4-bay antenna device of FIG. 11 in the second communication band. An S-parameter in the second communication band CB2 associated with the 4-bay antenna device of FIG. 11 is illustrated in FIG. 13A. A radiation pattern in the second communication band CB2 associated with the 4-bay antenna device of FIG. 11, to which the CA is not applied, is illustrated in FIG. 13B. A radiation pattern in the second communication band CB2 associated with the 4-bay antenna device of FIG. 11, to which the CA is applied, is illustrated in FIG. 13C.

In some exemplary embodiments, an antenna device may operate in a frequency band having the S-parameter of the threshold value or less. For example, referring to FIG. 13A, an antenna having the S-parameter of −5 dB or less in the second communication band CB2 may be used for the communication using the second communication band CB2.

Figure 14:
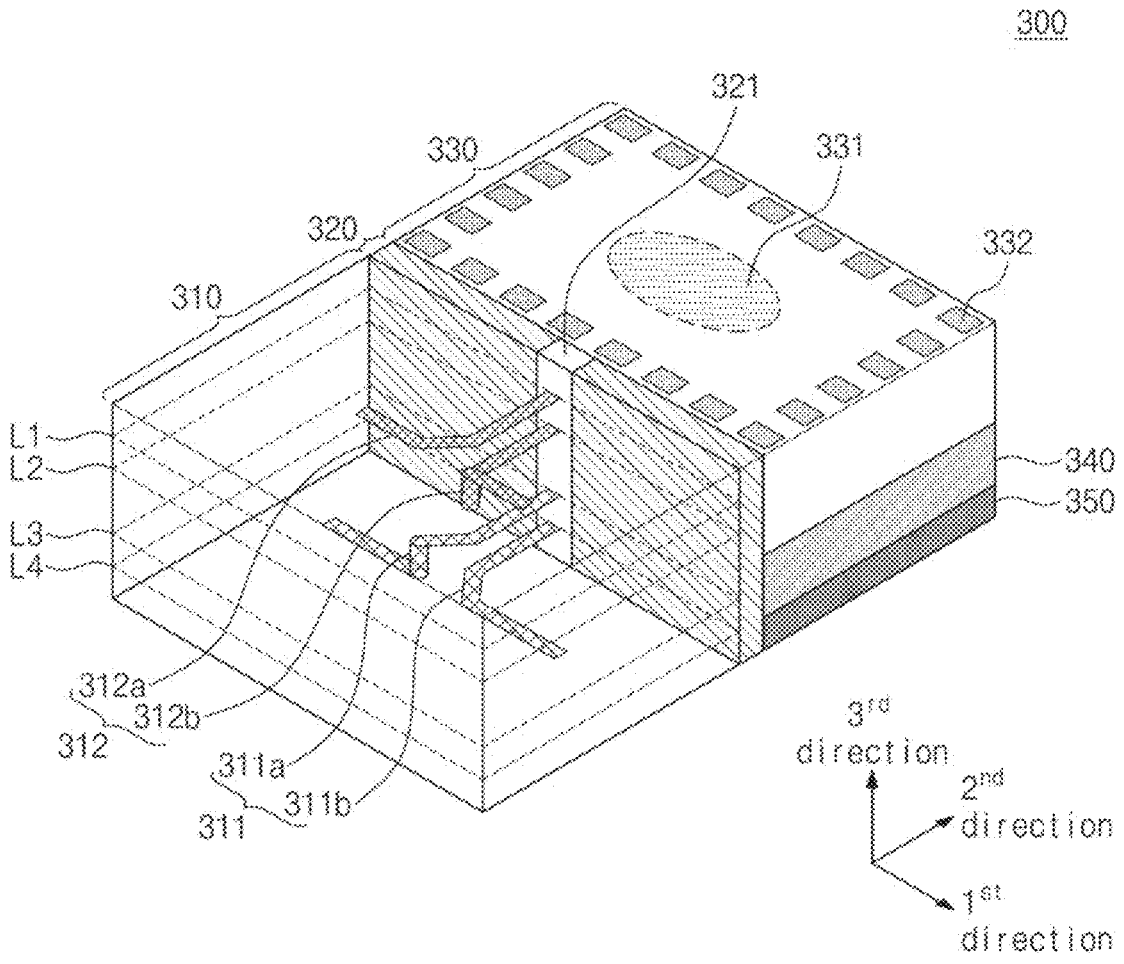
FIG. 14 is a perspective view illustrating an antenna device according to an embodiment.

FIG. 14 is a perspective view illustrating an antenna device according to an embodiment. Referring to FIG. 14, a perspective view of an antenna device 300 according to various exemplary embodiments is illustrated. A barrier 320, a penetration region 321, a patch antenna space 330, a patch antenna 331, a feed space 340, and a signal processing device 350 are similar to the barrier 120, the penetration region 121, the patch antenna space 130, the patch antenna 131, the feed space 140, and the signal processing device 150, respectively, and thus, repeated description will be omitted for conciseness and to avoid redundancy.

An endfire antenna space 310 may include first and second endfire antennas 311 and 312. The first endfire antenna 311 may be a dipole antenna configured to transmit/receive an RF signal in the first communication band. The first endfire antenna 311 may include first and second radiators 311*a* and 311*b*. The first radiator 311*a* may include radiators formed at the third and fourth conductive layers L3 and L4 and a via connecting the radiators. The second radiator 311*b* may be a radiator formed at the fourth conductive layer L4.

The second endfire antenna 312 may be a dipole antenna configured to transmit/receive an RF signal in the second communication band. The second endfire antenna 312 may include third and fourth radiators 312*a* and 312*b*. The third radiator 312*a* may be a radiator formed at the first conductive layer L1. The fourth radiator 312*b* may include radiators formed at the first and second conductive layers L1 and L2 and a via connecting the radiators.

According to various exemplary embodiments, a dipole antenna in which radiators transmitting/receiving an RF signal are formed may be provided at the same conductive layer. For example, the first endfire antenna 311 may transmit/receive an RF signal in the first communication band CB1 through a pair of shapes that are respectively included in the first and second radiators 311*a* and 311*b* and are extended in the first direction at the fourth conductive layer L4. The second endfire antenna 312 may transmit/receive an RF signal in the second communication band CB2 through a pair of shapes that are respectively included in the third and fourth radiators 312*a* and 312*b* and are extended in the first direction at the first conductive layer L1.

As described above, according to various exemplary embodiments, since the radiators 311*a*, 311*b*, 312*a*, and 312*b* transmit/receive RF signals in the first and second communication bands CB1 and CB2 through the shapes extended in the first direction with a given width, there may be provided the endfire antennas 311 and 312 of a strip type, which are implemented with a reduced size.

Figure 15:
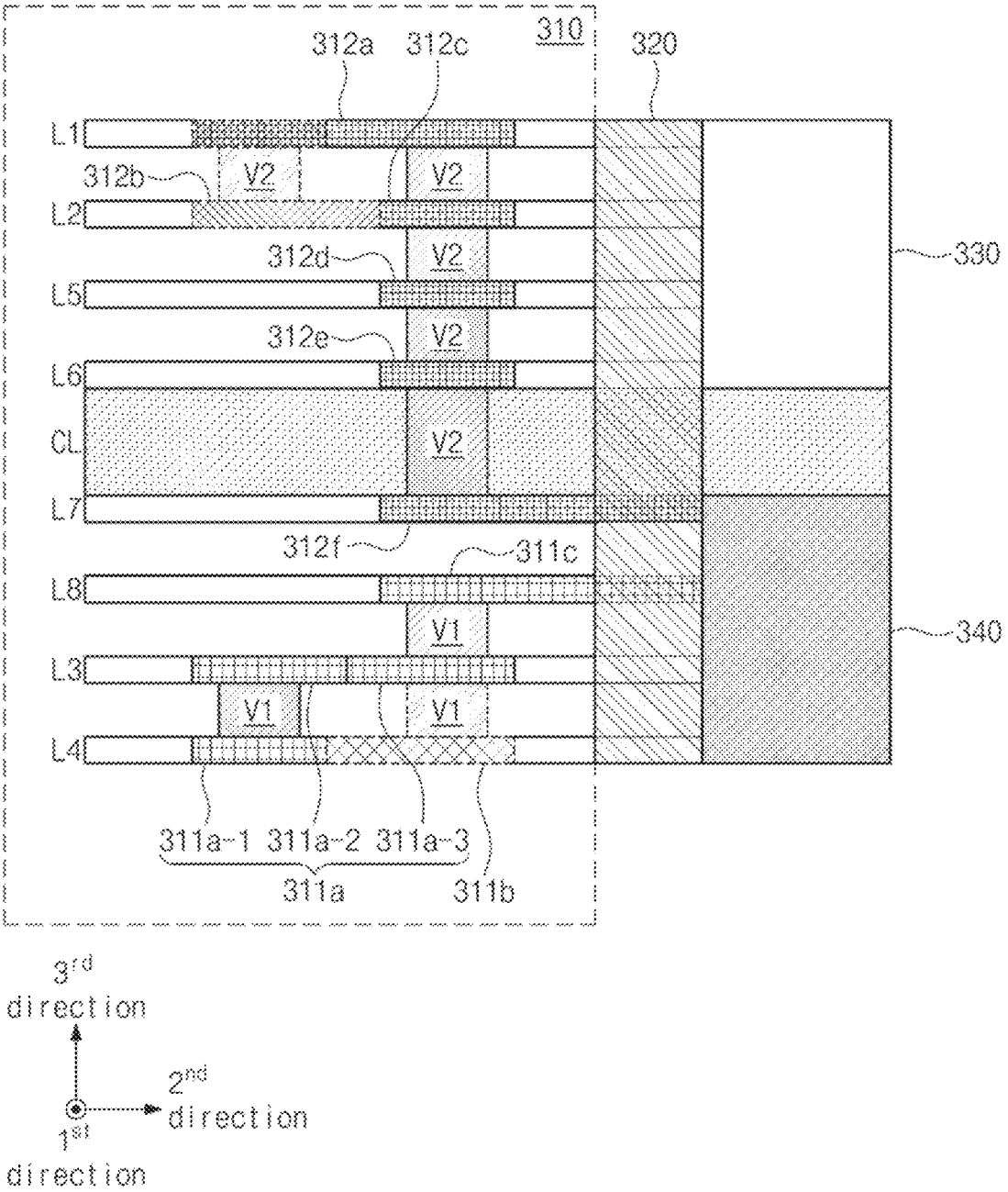
FIG. 15 is a cross-sectional view illustrating the antenna device of FIG. 14 in detail.

FIG. 15 is a cross-sectional view illustrating the antenna device of FIG. 14 in detail. For better understanding, the endfire antenna space 310 that is depicted in FIG. 15 has a scale different from that of FIG. 14.

The first radiator 311*a* may include a radiator of the third conductive layer L3 and a radiator of the fourth conductive layer L4. For example, the first radiator 311*a* may include a first shape 311*a*-1, a second shape 311*a*-2, and a third shape 311*a*-3 that are connected continuously (or seamlessly). A radiator corresponding to the first shape 311*a*-1 may be included in the fourth conductive layer L4. A radiator corresponding to the second and third shapes 311*a*-2 and 311*a*-3 that are connected may be included in the third conductive layer L3. The radiator corresponding to the first shape 311*a*-1 and the radiator corresponding to the second and third shapes 311*a*-2 and 311*a*-3 that are connected may be connected through a first via V1. The shape of the first radiator 311*a* will be more fully described with reference to FIGS. 17A and 17B. The first radiator 311*a* may be connected with the feed space 340 through a first via V1 and a radiator 311*c*.

The second radiator 311*b* may be formed at the fourth conductive layer L4. For better understanding, the second radiator 311*b* is together illustrated in the cross-sectional view of FIG. 15, but the second radiator 311*b* may be placed to be spaced apart from the first radiator 311*a* in the first direction.

The third radiator 312*a* may be formed at the first conductive layer L1. The third radiator 312*a* may be connected with the feed space 340 through second vias V2 and radiators 312*c* to 312*f*.

The fourth radiator 312*b* may include a radiator of the first conductive layer L1 and a radiator of the second conductive layer L2, which are connected through a second via V2. For better understanding, the fourth radiator 312*b* is together illustrated in the cross-sectional view of FIG. 15, but the fourth radiator 312*b* may be placed to be spaced apart from the third radiator 312*a* in the first direction. A shape of the fourth radiator 312*b* will be more fully described with reference to FIGS. 18A and 18B.

Figure 16:
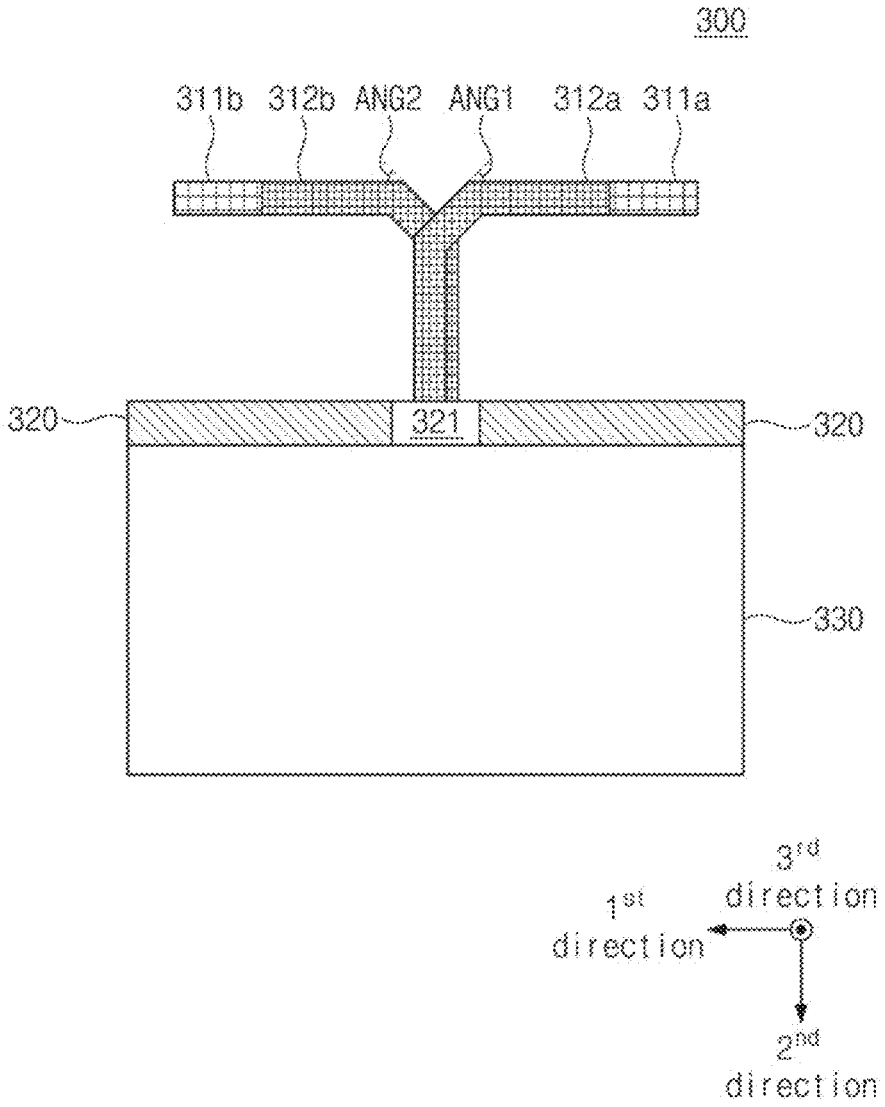
FIG. 16 is a plan view illustrating the antenna device of FIG. 14.

FIG. 16 is a plan view illustrating the antenna device of FIG. 14. Shapes and placement of the first and second radiators 311*a* and 311*b* of the first endfire antenna and the third and fourth radiators 312*a* and 312*b* of the second endfire antenna are illustrated in FIG. 16.

Each of the first and third radiators 311*a* and 312*a* may include a shape extended in the direction facing away from the second direction, a shape extended in a direction in which a slope is formed at a first angle ANG1, and a shape extended in the direction facing away from the first direction. In this case, the first angle ANG1 may be an acute angle. The first radiator 311*a* may further include a via extended in the third direction.

Each of the second and fourth radiators 311*b* and 312*b* may include a shape extended in the direction facing away from the second direction, a shape extended in a direction in which a slope is formed at a second angle ANG2, and a shape extended in the first direction. In this case, the second angle ANG2 may be the acute angle. In other words, in some exemplary embodiments, the first angle ANG1 may be the same as the second angle ANG2. The fourth radiator 312*b* may further include a via extended in the third direction.

In some exemplary embodiments, the first angle ANG1 and the second angle ANG2 may be symmetrical with respect to an axis parallel to the second direction. For example, the first angle ANG1 may be identical in magnitude with the second angle ANG2.

Figure 17A:
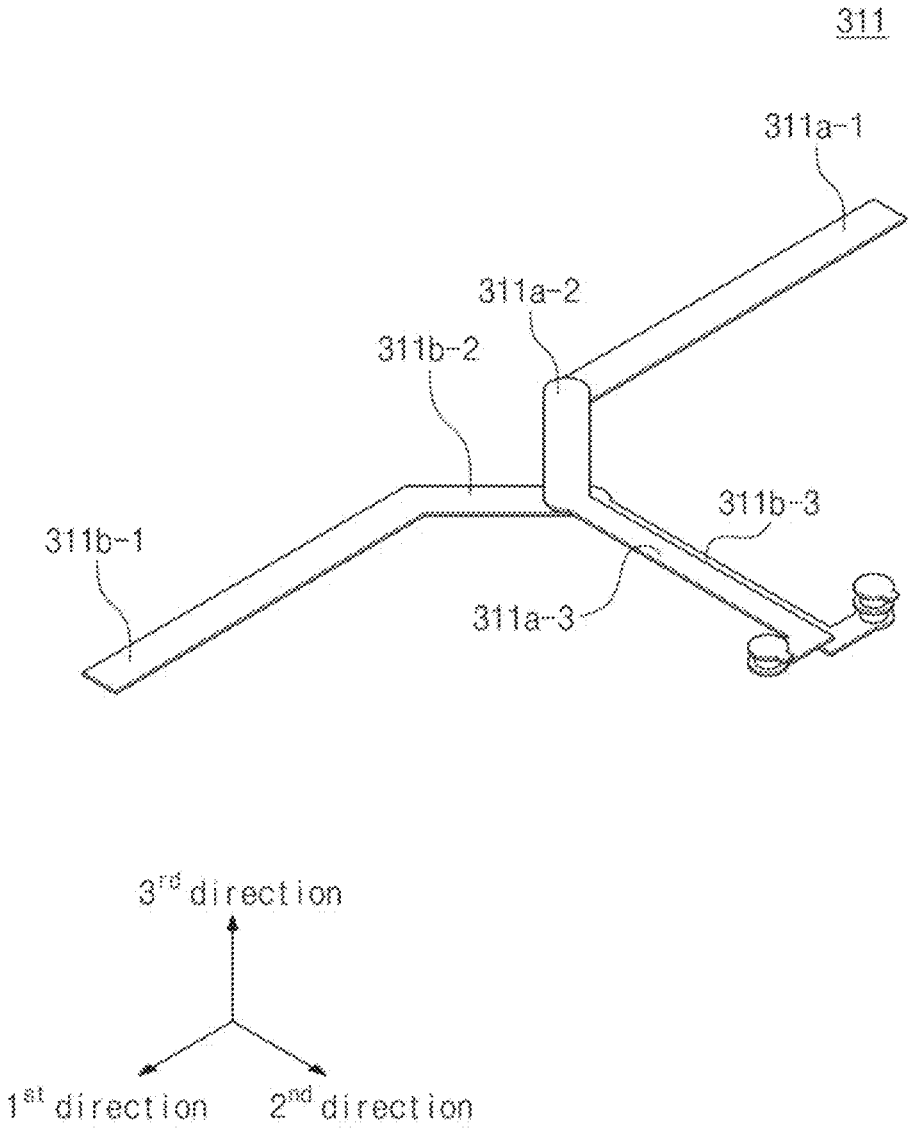
FIGS. 17A and 17B are views illustrating an endfire antenna of the antenna device of FIG. 14 in detail.
Figure 17B:
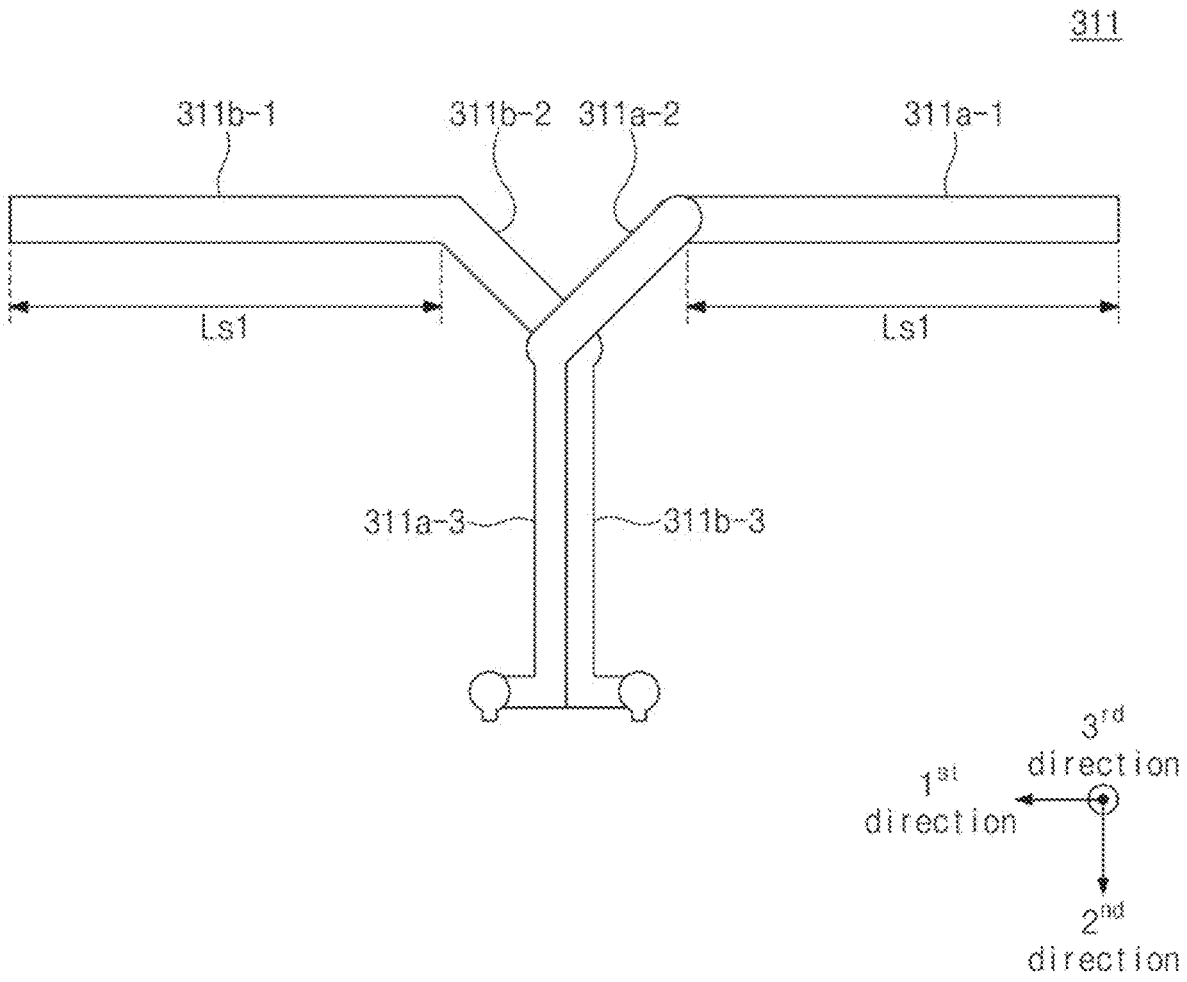

FIGS. 17A and 17B are views illustrating the endfire antenna of FIG. 14 in detail. A perspective view of the first endfire antenna 311 of FIG. 14 is illustrated in FIG. 17B in detail.

The first radiator of the first endfire antenna 311 may include the first to third shapes 311*a*-1, 311*a*-2, and 311*a*-3 that are connected continuously (or seamlessly). The first shape 311*a*-1 may be a shape extended in the first direction. The second shape 311*a*-2 may be a shape that is connected with the first shape 311*a*-1 through a via extended in the third direction and is extended in a direction rotated from the first direction to the second direction as much as the acute angle. The third shape 311*a*-3 may be a shape that is connected with the second shape 311*a*-2 and is extended in the second direction. The third shape 311*a*-3 may be connected with the first feed line.

The second radiator of the first endfire antenna 311 may include first to third shapes 311*b*-1, 311*b*-2, and 311*b*-3 that are connected continuously (or seamlessly). The first shape 311*b*-1 may be a shape extended in the first direction. The second shape 311*b*-2 may be a shape that is connected with the first shape 311*b*-1 and is extended in a direction rotated from the direction facing away from the first direction to the second direction as much as the acute angle. The third shape 311*b*-3 may be a shape that is connected with the second shape 311*b*-2 and is extended in the second direction. The third shape 311*b*-3 may be connected with the second feed line.

In some exemplary embodiments, the first endfire antenna 311 may include a pair of radiators that are formed at the same conductive layer and have a size corresponding to the first communication band. For example, a radiator including the first shape 311*a*-1 and a radiator including the first shape 311*b*-1 may be formed at the same conductive layer.

A plan view of the first endfire antenna 311 of FIG. 14 when viewed in the third direction is illustrated in FIG. 17B in detail. A length Ls1 of each of the first and second shapes 311*a*-1 and 311*b*-1 respectively included in the first and second radiators of the first endfire antenna 311 may be a width in the first direction. In this case, the length Ls1 may be a length corresponding to the first communication band. For example, the first shapes 311*a*-1 and 311*b*-1 having a width in the first direction, which corresponds to the length Ls1, may resonate with a signal in the first communication band.

Figure 18A:
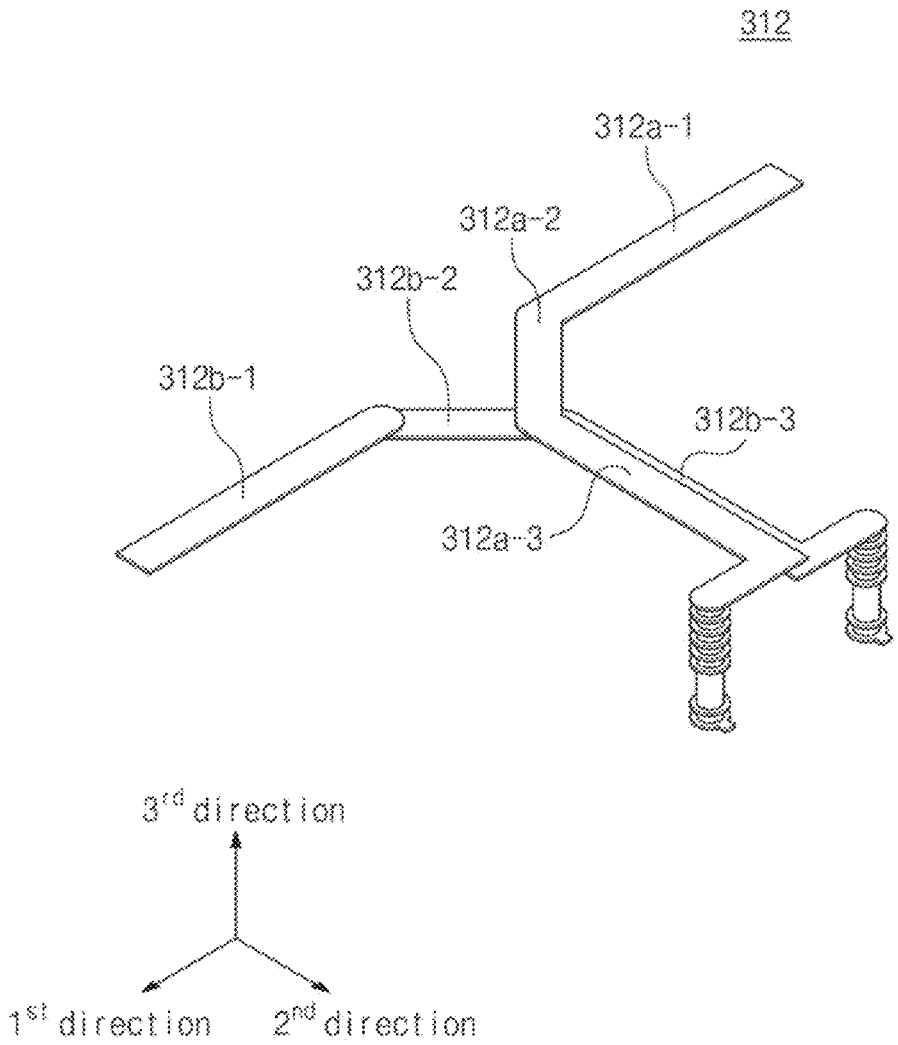
FIGS. 18A and 18B are views illustrating an endfire antenna of the antenna device of FIG. 14 in detail.
Figure 18B:
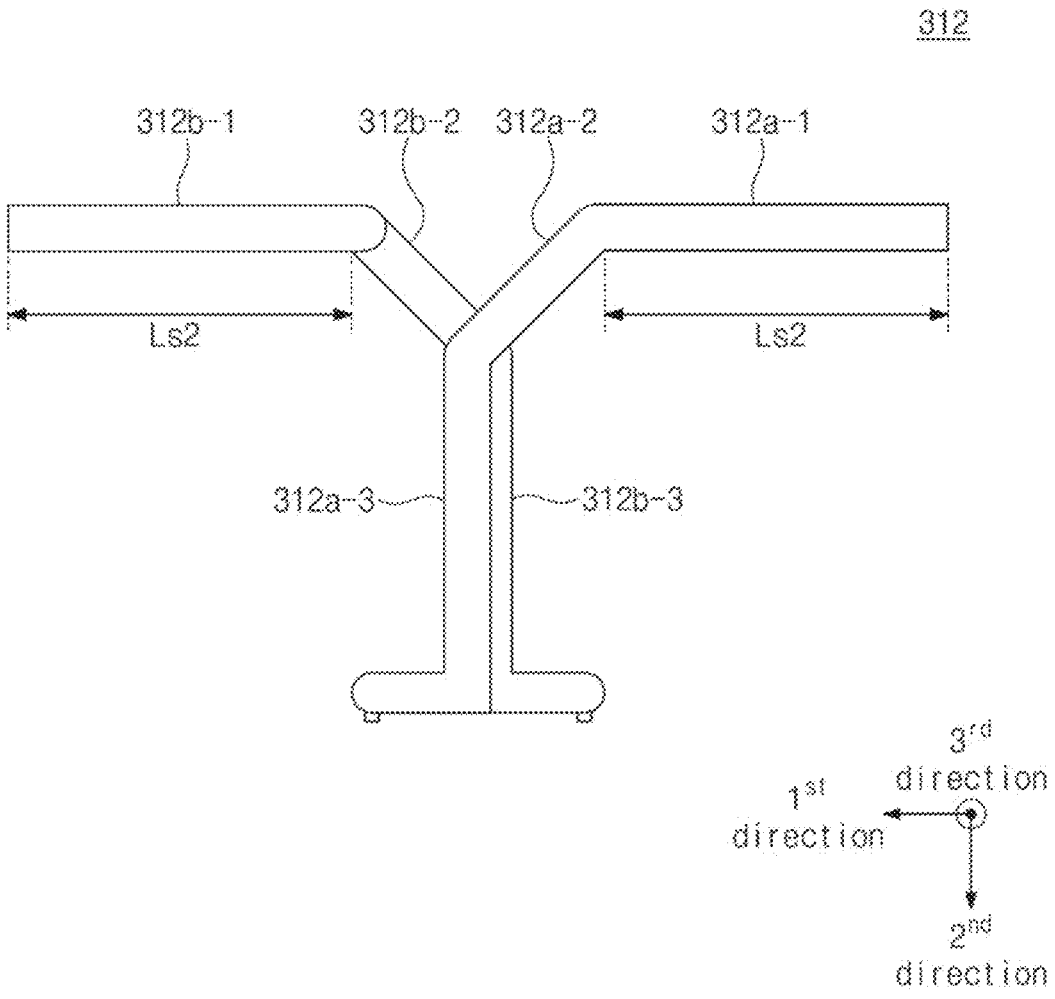

FIGS. 18A and 18B are views illustrating an endfire antenna of FIG. 14 in detail. A perspective view of the second endfire antenna 312 of FIG. 14 is illustrated in FIG. 18B in detail.

The third radiator of the second endfire antenna 312 may include first to third shapes 312*a*-1, 312*a*-2, and 312*a*-3 that are connected continuously (or seamlessly). The first shape 312*a*-1 may be a shape extended in the first direction. The second shape 312*a*-2 may be a shape that is connected with the first shape 312*a*-1 and is extended in a direction rotated from the first direction to the second direction by the acute angle. The third shape 312*a*-3 may be a shape that is connected with the second shape 312*a*-2 and is extended in the second direction. The third shape 312*a*-3 may be connected with the third feed line.

The fourth radiator of the second endfire antenna 312 may include first to third shapes 312*b*-1, 312*b*-2, and 312*b*-3 that are connected continuously (or seamlessly). The first shape 312*b*-1 may be a shape extended in the first direction. The second shape 312*b*-2 may be a shape that is connected with the first shape 312*b*-1 through a via extended in the third direction and is extended in a direction rotated from the first direction to the second direction by the acute angle. The third shape 312*b*-3 may be a shape that is connected with the second shape 312*b*-2 and is extended in the second direction. The third shape 312*b*-3 may be connected with the fourth feed line.

In some exemplary embodiments, the second endfire antenna 312 may include a pair of radiators that are formed at the same conductive layer and have a size corresponding to the second communication band. For example, a radiator including the first shape 312*a*-1 and a radiator including the first shape 312*b*-1 may be formed at the same conductive layer.

A plan view of the second endfire antenna 312 of FIG. 14 when viewed in the third direction is illustrated in FIG. 18B in detail. A length Ls2 of each of the first and second shapes 312*a*-1 and 312*b*-1 respectively included in the third and fourth radiators of the second endfire antenna 312 may be a width in the first direction. In this case, the length Ls2 may be a length corresponding to the second communication band. For example, the first shapes 312*a*-1 and 312*b*-1 having a width in the first direction, which corresponds to the length Ls2, may resonate with a signal in the second communication band.

Figure 19:
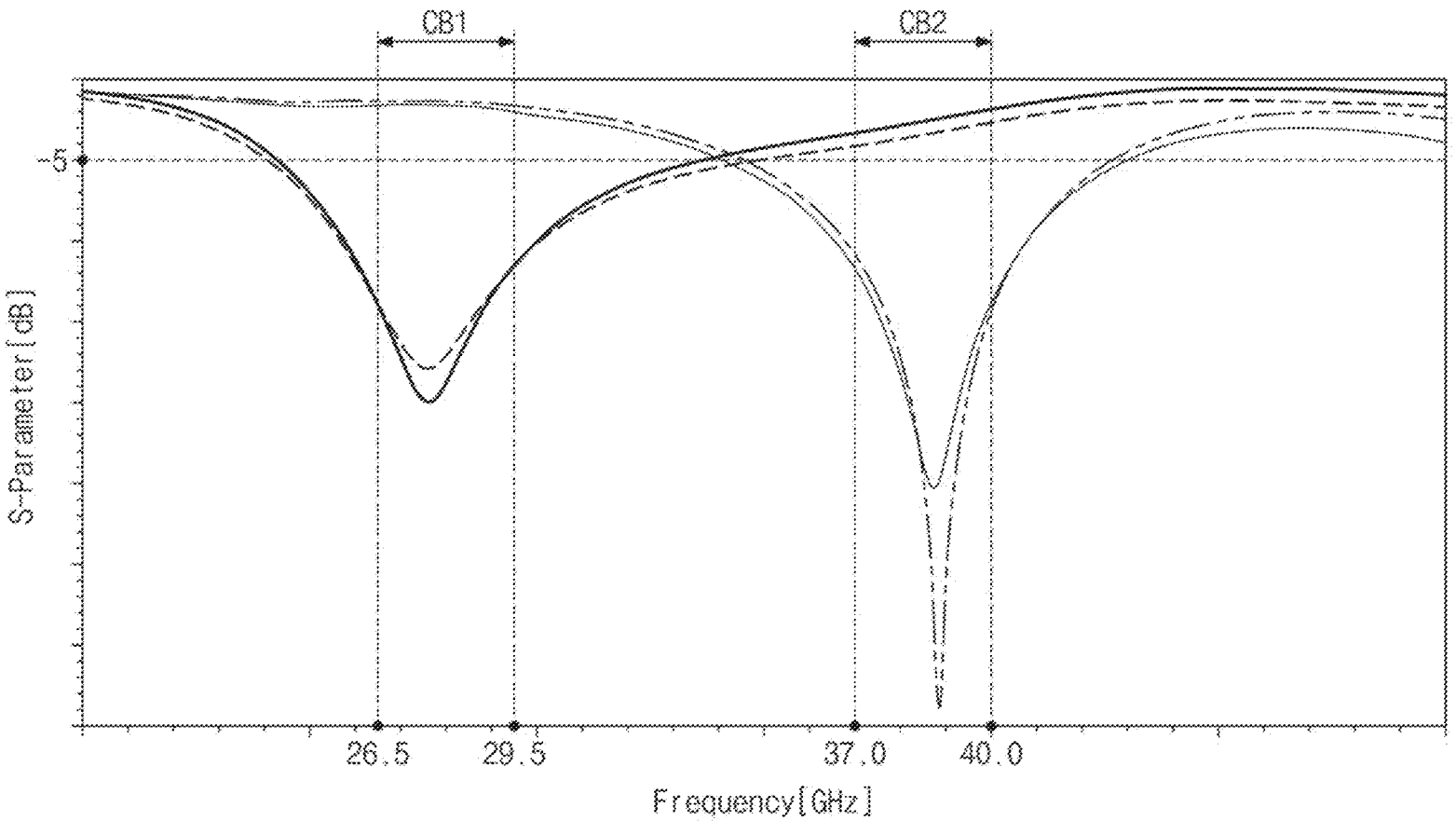
FIGS. 19 to 21 are graphs illustrating communication characteristics of the antenna device of FIG. 14.
Figure 20:
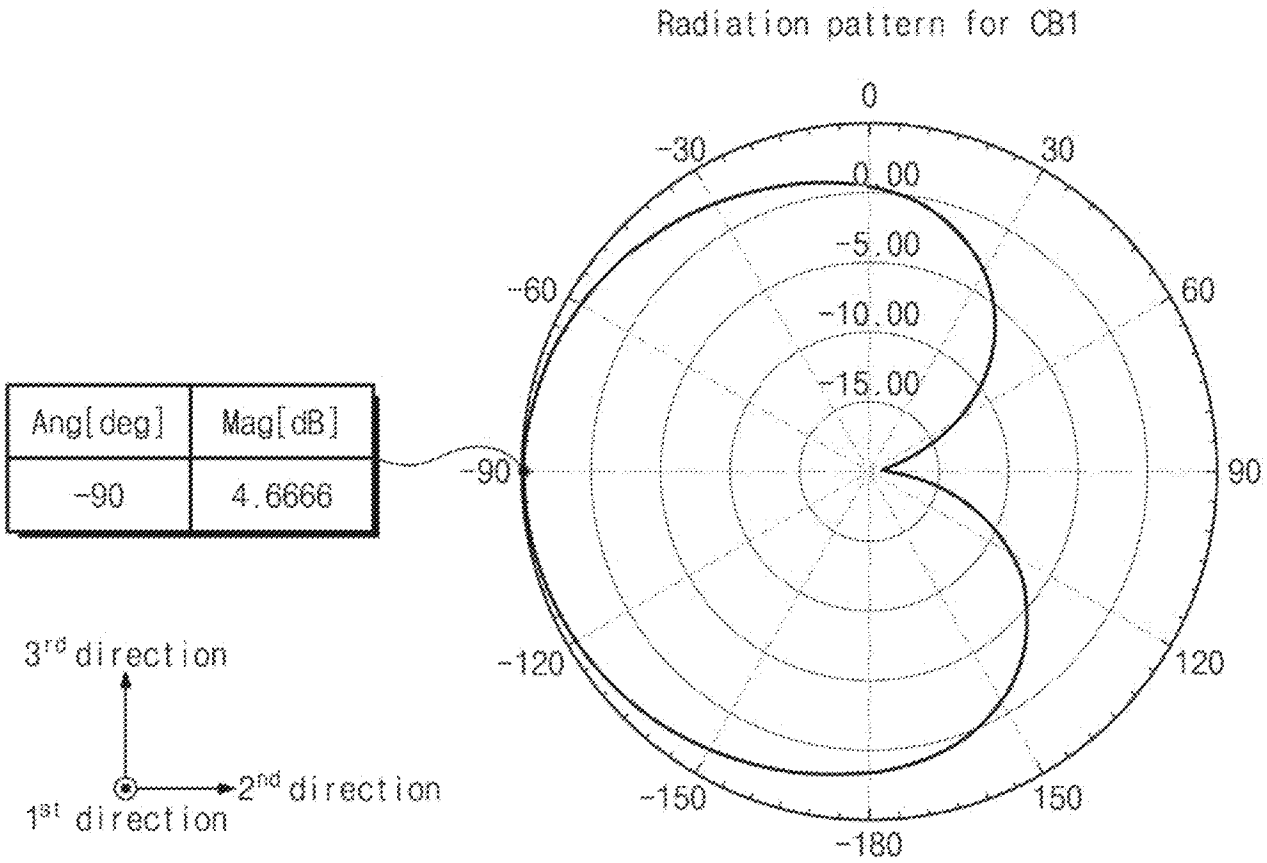
Figure 21:
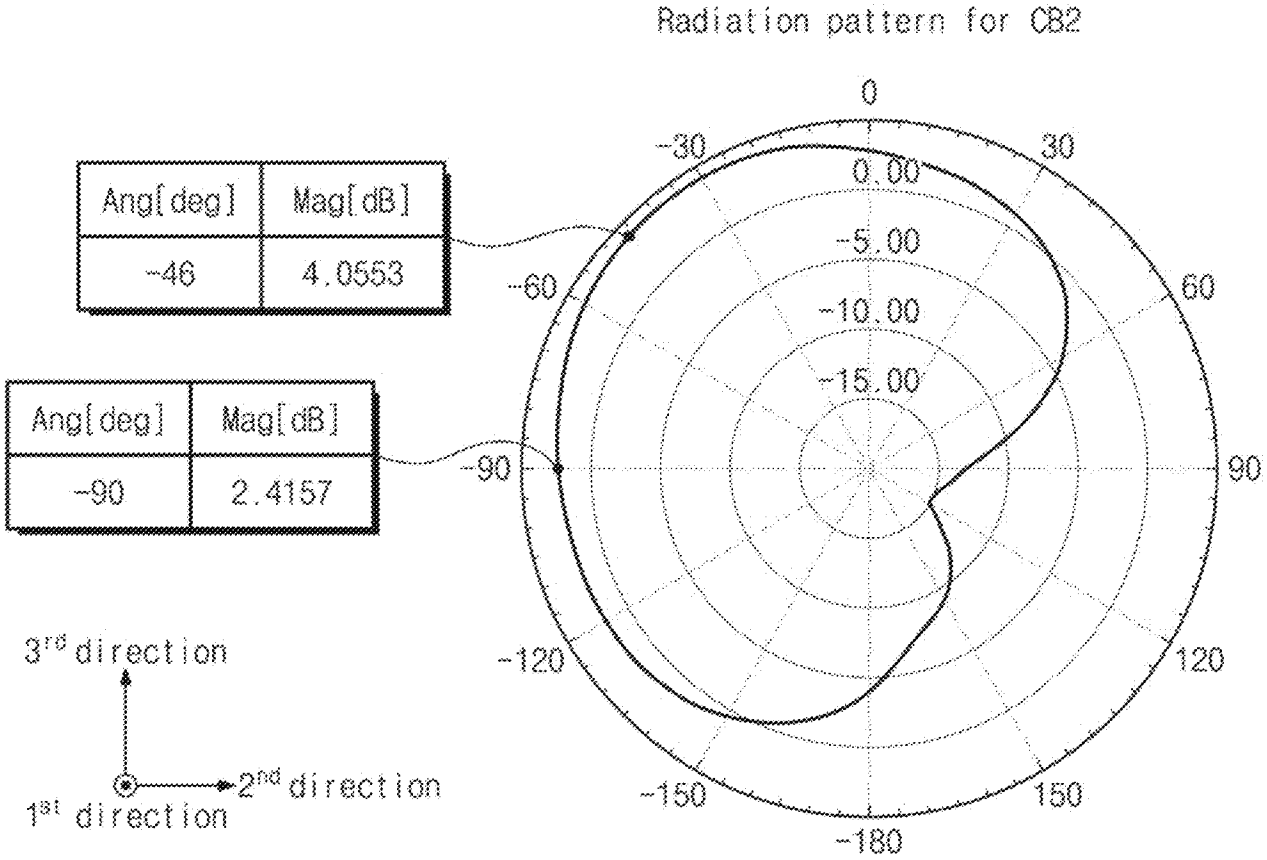

FIGS. 19 to 21 are graphs illustrating communication characteristics of the antenna device of FIG. 14. An S-parameter of the antenna device 300 of FIG. 14 is illustrated in FIG. 19. In some exemplary embodiments, an antenna device may operate in a frequency band having the S-parameter of the threshold value or less. For example, in FIG. 19, the threshold value of the S-parameter with which the antenna device 300 performs communication may be −5 dB.

Referring to FIGS. 14 and 20, a radiation pattern in the first communication band CB1 associated with the antenna device 300 is illustrated. Referring to FIGS. 14 and 21, a radiation pattern in the second communication band CB2 associated with the antenna device 300 is illustrated. In some exemplary embodiments, the radiation pattern in the second communication band CB2 may be maximized at −46 degrees. By finely tuning the antenna device 300, an angle at which the radiation pattern in the second communication band CB2 is maximized may be changed from −46 degrees to −90 degrees. As illustrated in FIGS. 19 to 21, the antenna device 300 of FIG. 14 may operate in the first and second communication bands CB1 and CB2.

Figure 22:
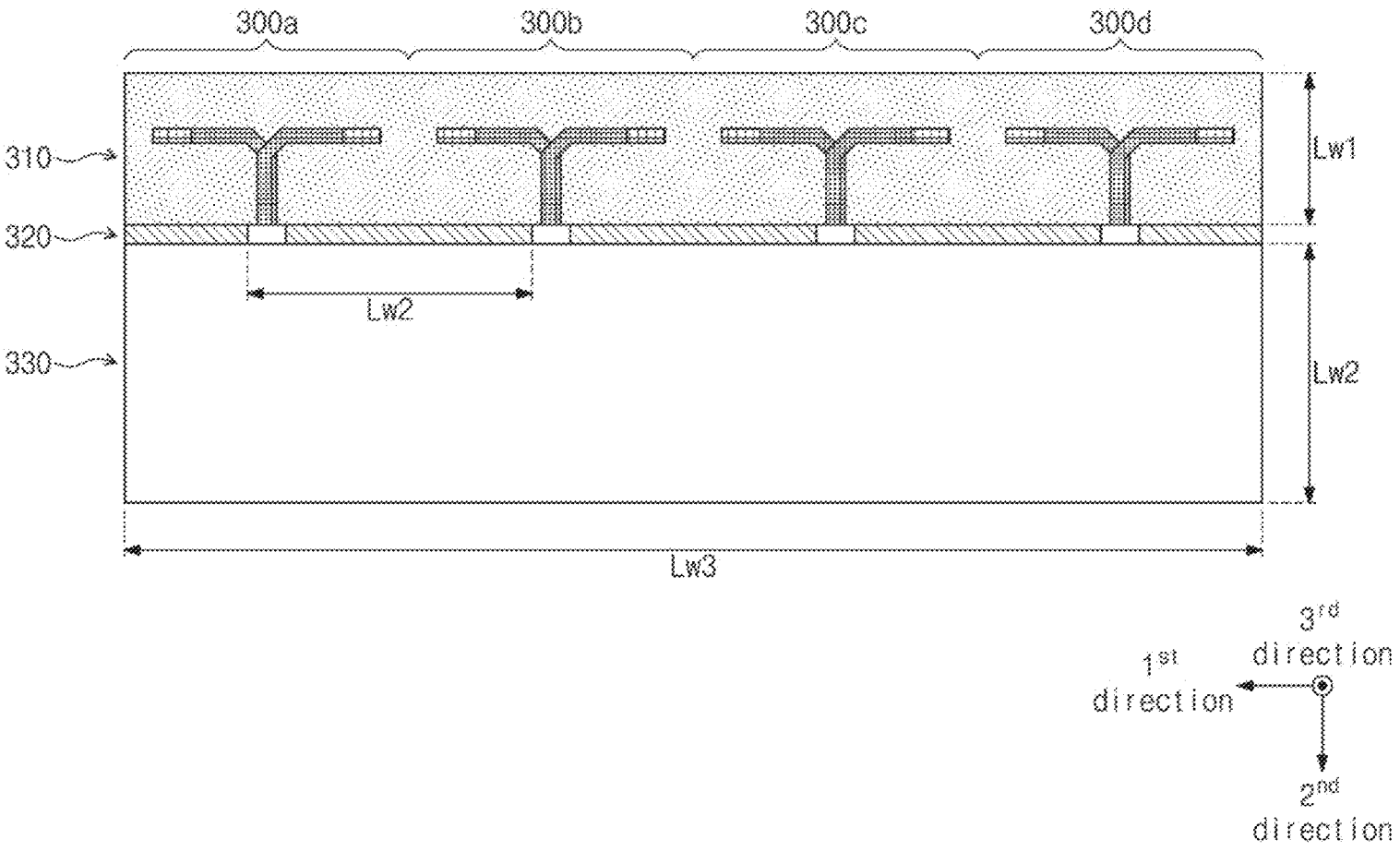
FIG. 22 is a plan view illustrating a 4-bay antenna device according to an embodiment.

FIG. 22 is a plan view illustrating a 4-bay antenna device according to an embodiment. A 4-bay antenna device of a strip type is illustrated in FIG. 22. Each of antenna devices 300*a* to 300*d* included in the 4-bay antenna device may have a configuration similar to that of the antenna device 300 of FIG. 14.

Figure 23A:
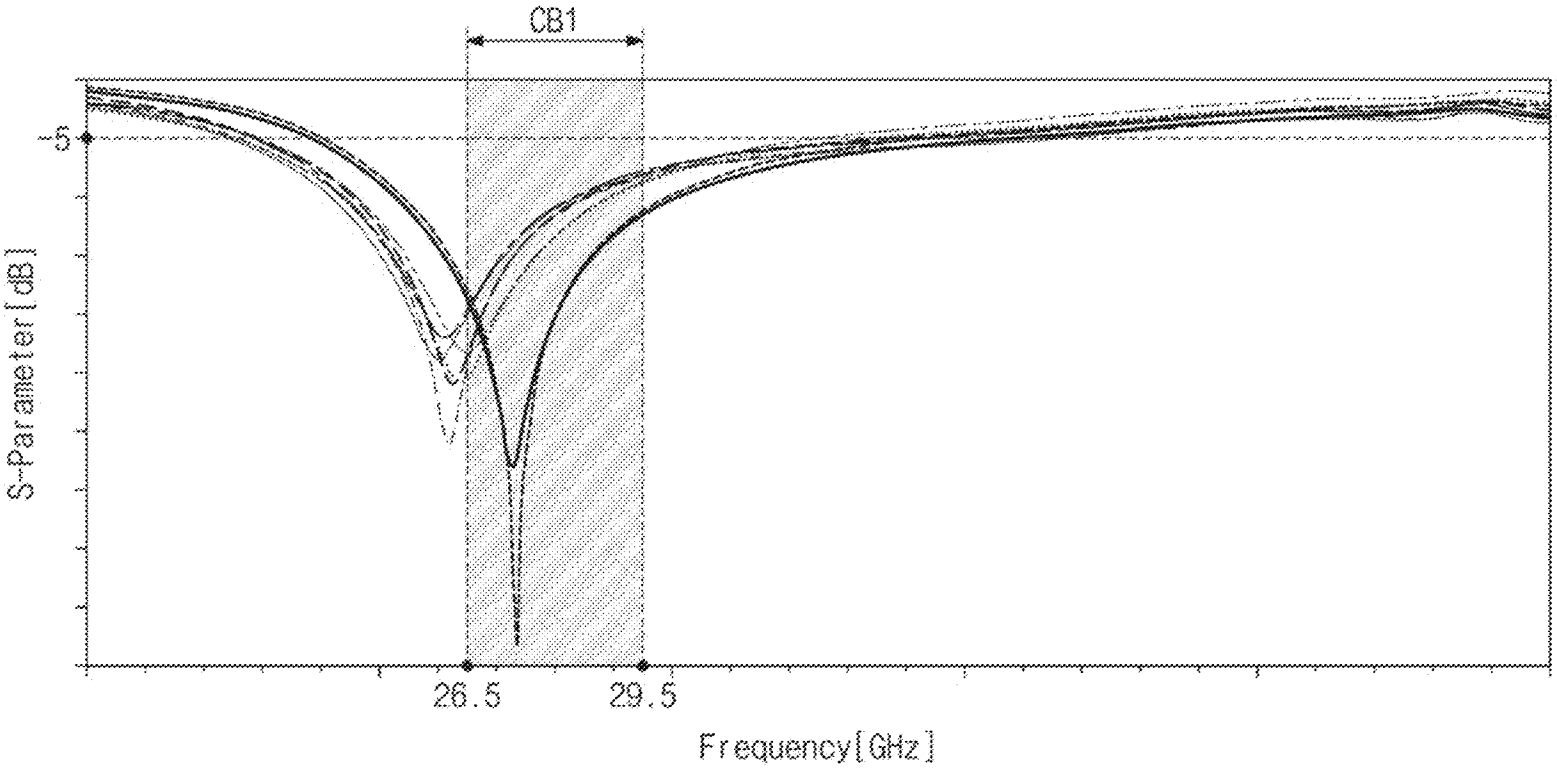
FIGS. 23A and 23B are graphs illustrating communication characteristics of the 4-bay antenna device of FIG. 22 in a first communication band.
Figure 23B:
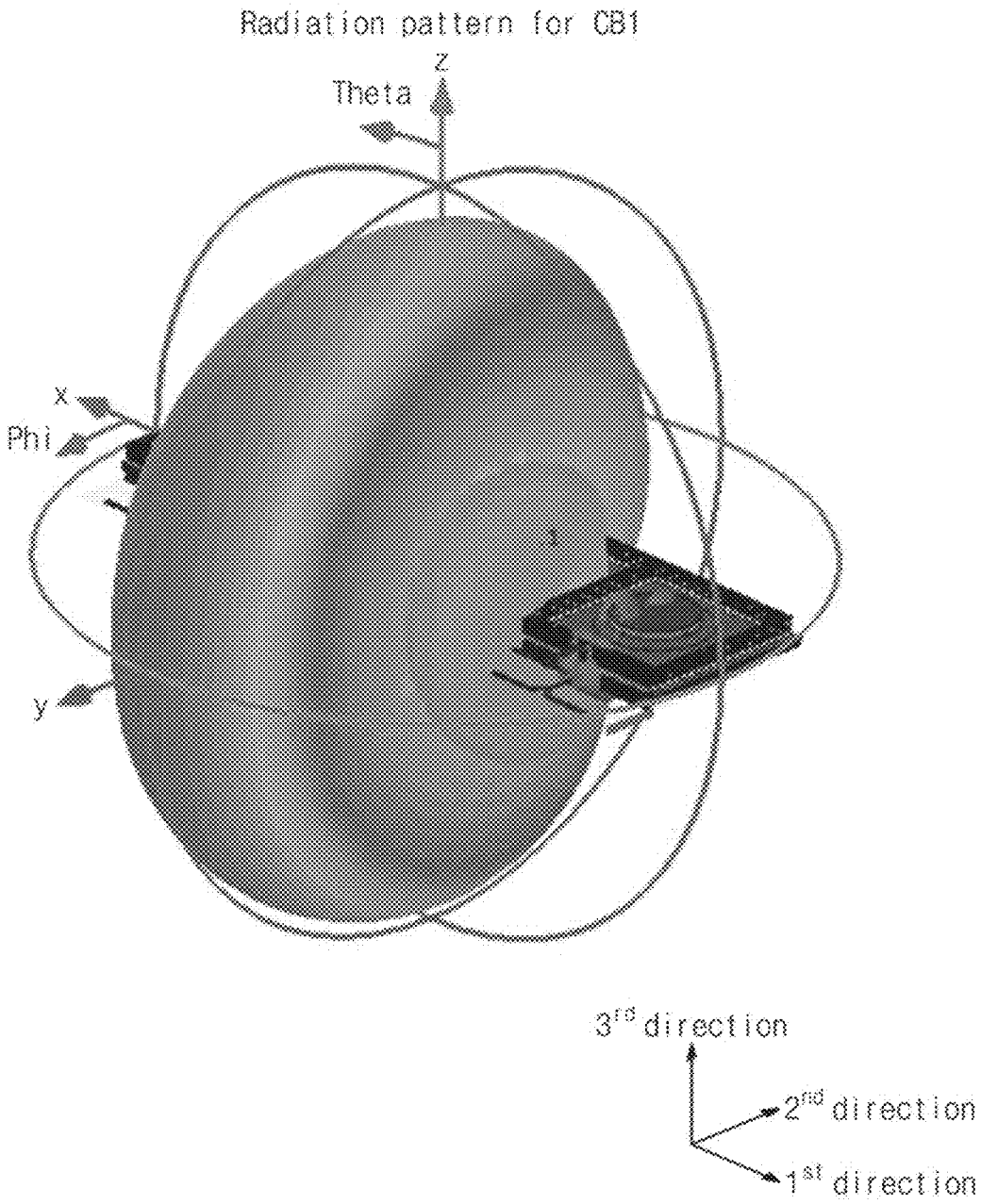

FIGS. 23A and 23B are graphs illustrating communication characteristics of the 4-bay antenna device of FIG. 22 in a first communication band. An S-parameter in the first communication band CB1 associated with the 4-bay antenna device of FIG. 22 is illustrated in FIG. 23A. A three-dimensional radiation pattern in the first communication band CB1 associated with the 4-bay antenna device of FIG. 22 is illustrated in FIG. 23B.

In some exemplary embodiments, an antenna device may operate in a frequency band having the S-parameter of the threshold value or less. For example, referring to FIG. 23A, an antenna having the S-parameter of −5 dB or less in the first communication band CB1 may be used for the communication using the first communication band CB1.

Figure 24A:
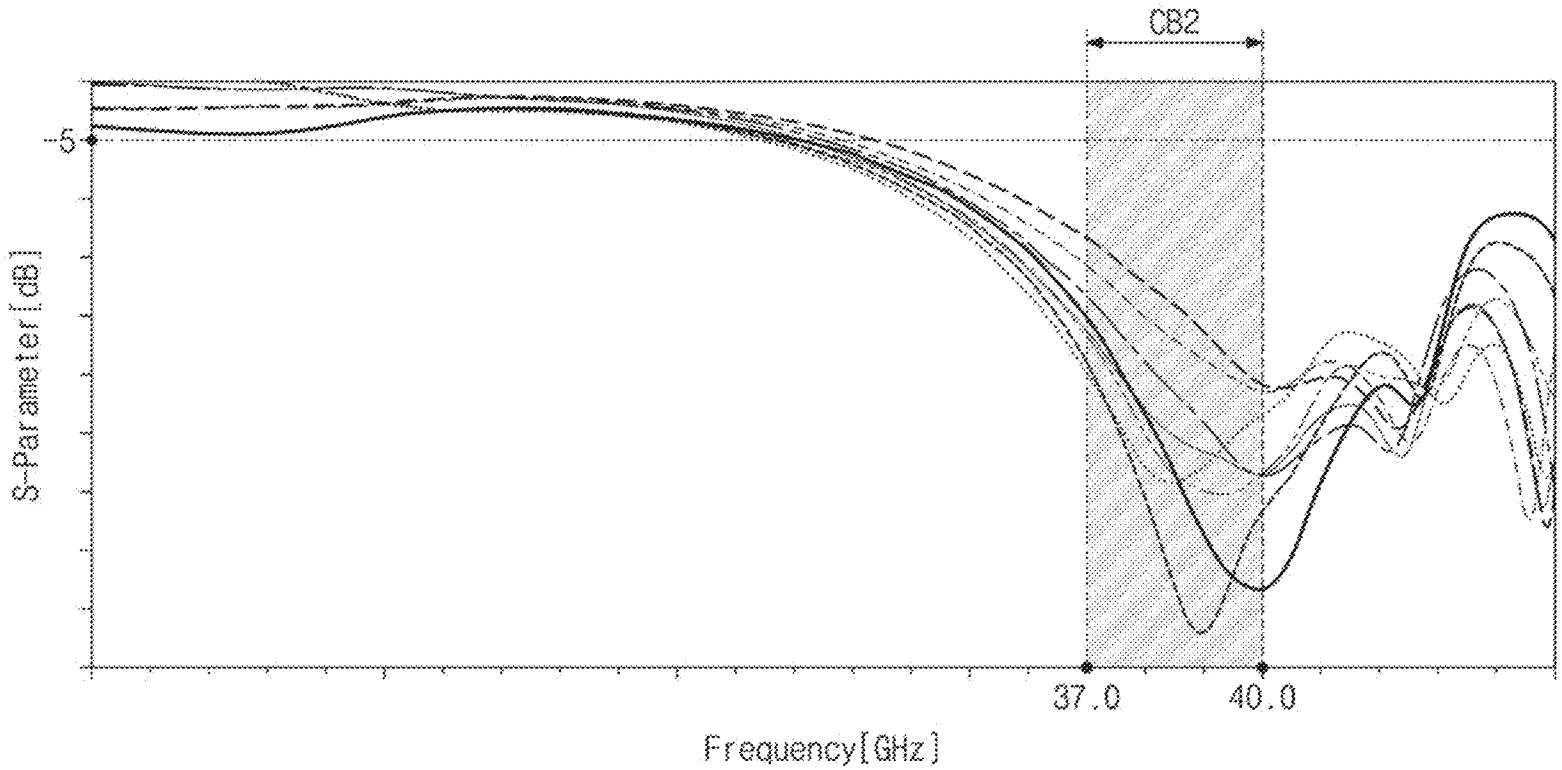
FIGS. 24A and 24B are graphs illustrating communication characteristics of the 4-bay antenna device of FIG. 22 in a second communication band.
Figure 24B:
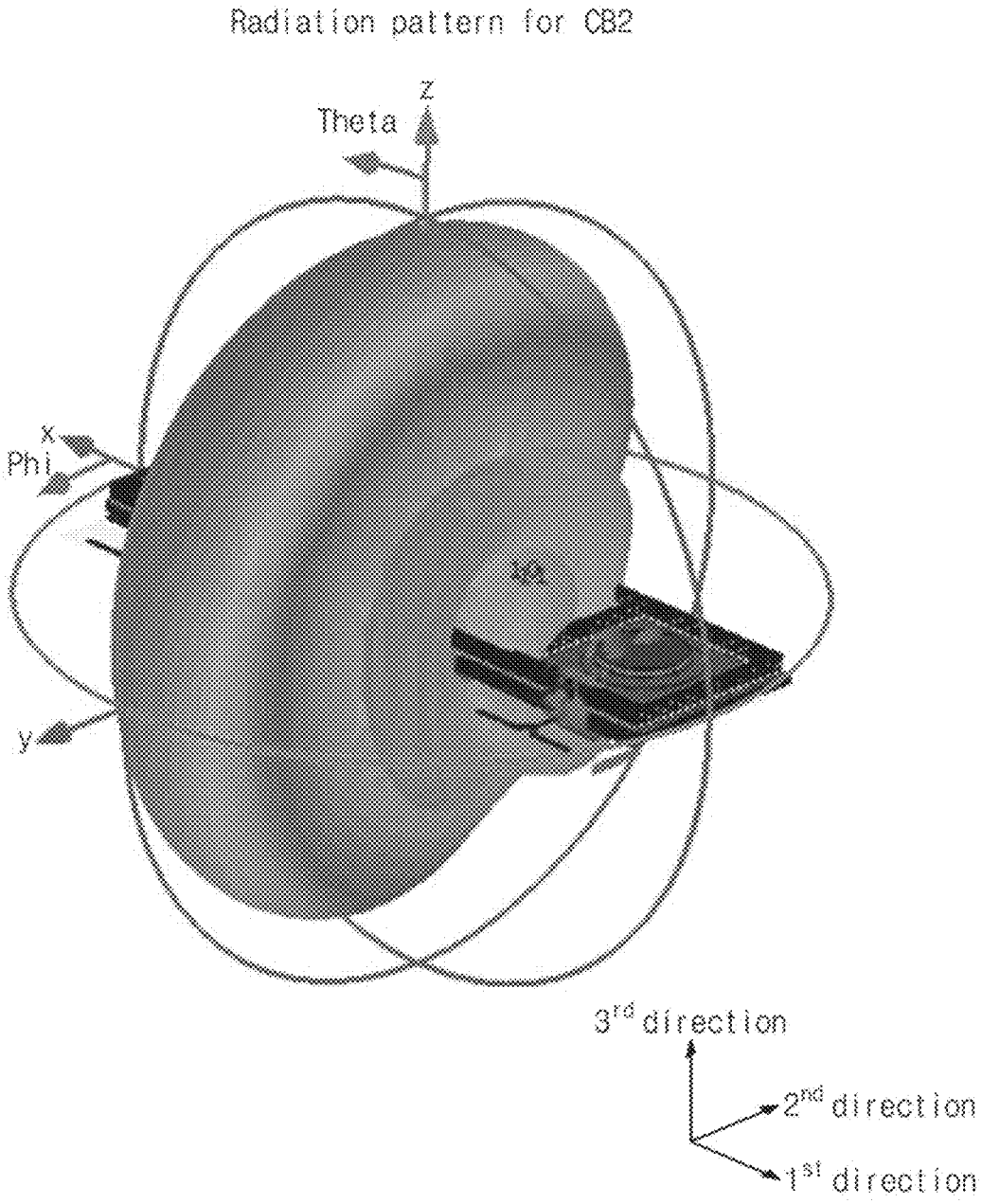

FIGS. 24A and 24B are graphs illustrating communication characteristics of the 4-bay antenna device of FIG. 22 in a second communication band. An S-parameter in the second communication band CB2 associated with the 4-bay antenna device of FIG. 22 is illustrated in FIG. 24A. A three-dimensional radiation pattern in the second communication band CB2 associated with the 4-bay antenna device of FIG. 22 is illustrated in FIG. 24B.

In some exemplary embodiments, an antenna device may operate in a frequency band having the S-parameter of the threshold value or less. For example, referring to FIG. 24A, an antenna having the S-parameter of −5 dB or less in the second communication band CB2 may be used for the communication using the second communication band CB2.

Figure 25:
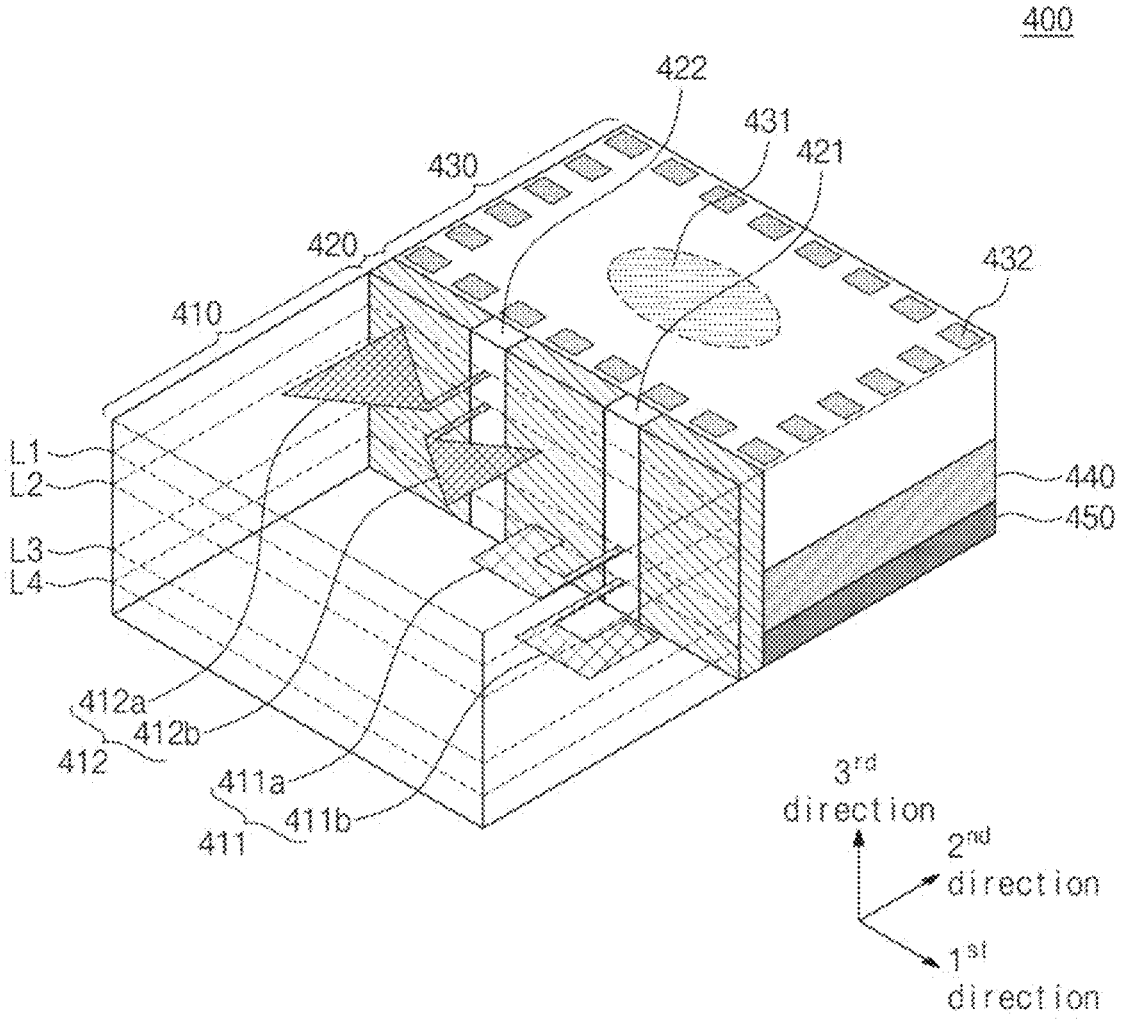
FIG. 25 is a perspective view illustrating an antenna device according to an embodiment.

FIG. 25 is a perspective view illustrating an antenna device according to an embodiment. Referring to FIG. 25, a perspective view of an antenna device 400 according to various exemplary embodiments is illustrated. A patch antenna space 430, a patch antenna 431, a feed space 440, and a signal processing device 450 are similar to the patch antenna space 130, the patch antenna 131, the feed space 140, and the signal processing device 150, respectively, and thus, repeated description will be omitted for conciseness and to avoid redundancy.

An endfire antenna space 410 may include first and second endfire antennas 411 and 412. The first endfire antenna 411 may be a dipole antenna configured to transmit/receive an RF signal in the first communication band. The first endfire antenna 411 may include first and second radiators 411*a* and 411*b* respectively formed at the third and fourth conductive layers L3 and L4.

The second endfire antenna 412 may be a dipole antenna configured to transmit/receive an RF signal in the second communication band. The second endfire antenna 412 may include third and fourth radiators 412*a* and 412*b* respectively formed at the first and second conductive layers L1 and L2.

In some exemplary embodiments, an endfire antenna may be a dipole antenna including a pair of radiators that are different in size and are symmetrical in shape. For example, a shape of the first radiator 411*a* may be similar to a shape of the second radiator 411*b*. The first radiator 411*a* may be smaller in size than the second radiator 411*b*. A shape of the third radiator 412*a* may be similar to a shape of the fourth radiator 412*b*. The third radiator 412*a* may be larger in size than the fourth radiator 412*b*.

In some exemplary embodiments, the first endfire antenna 411 and the second endfire antenna 412 may be different in a radiator shape. For example, the first radiator 411*a* of the first endfire antenna 411 may include a shape extended in the direction facing away from the second direction, a shape extended in the direction facing away from the first direction, and a shape extended in the second direction. The third radiator 412*a* of the second endfire antenna 412 may include a shape extended in the direction facing away from the second direction and a shape in which a width in the second direction widens in the direction facing away from the first direction.

A barrier 420 may be interposed between the endfire antenna space 410 and the patch antenna space 430. The barrier 420 may include a first penetration region 421 and a second penetration region 422. The first penetration region 421 may be a region of the barrier 420, through which the first and feed lines connected with the first and second radiators 411*a* and 411*b* pass. The second penetration region 422 may be a region of the barrier 420, through which the third and fourth feed lines connected with the third and fourth radiators 412*a* and 412*b* pass. That is, unlike the penetration region 121 illustrated in FIG. 1, according to various exemplary embodiments, a barrier including a plurality of penetration regions may be provided.

As described above, according to various exemplary embodiments, the first and second endfire antennas 411 and 412 of a differential type in which a shape of the first and second radiators 411*a* and 411*b* and a shape of the third and fourth radiators 412*a* and 412*b* are different may be provided.

Figure 26:
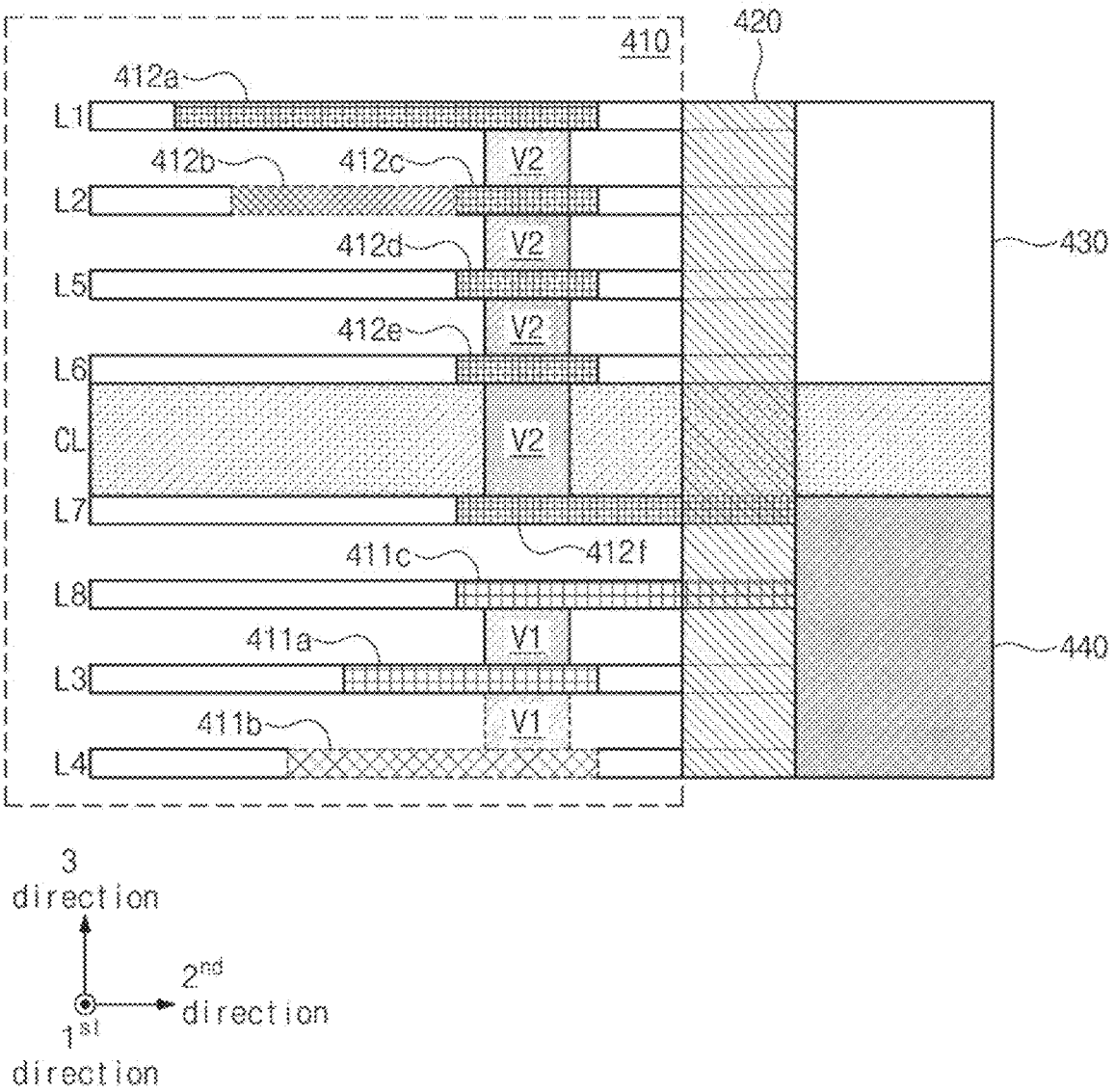
FIG. 26 is a cross-sectional view illustrating the antenna device of FIG. 25 in detail.

FIG. 26 is a cross-sectional view illustrating the antenna device of FIG. 25 in detail. For better understanding, the endfire antenna space 410 that is depicted in FIG. 26 has a scale different from that of FIG. 25. In some exemplary embodiments, because a shape of the first and second radiators 411*a* and 411*b* and a shape of the third and fourth radiators 412*a* and 412*b* are different, the first to fourth radiators 411*a*, 411*b*, 412*a*, and 412*b* may be different in a width in the second direction.

Figure 27:
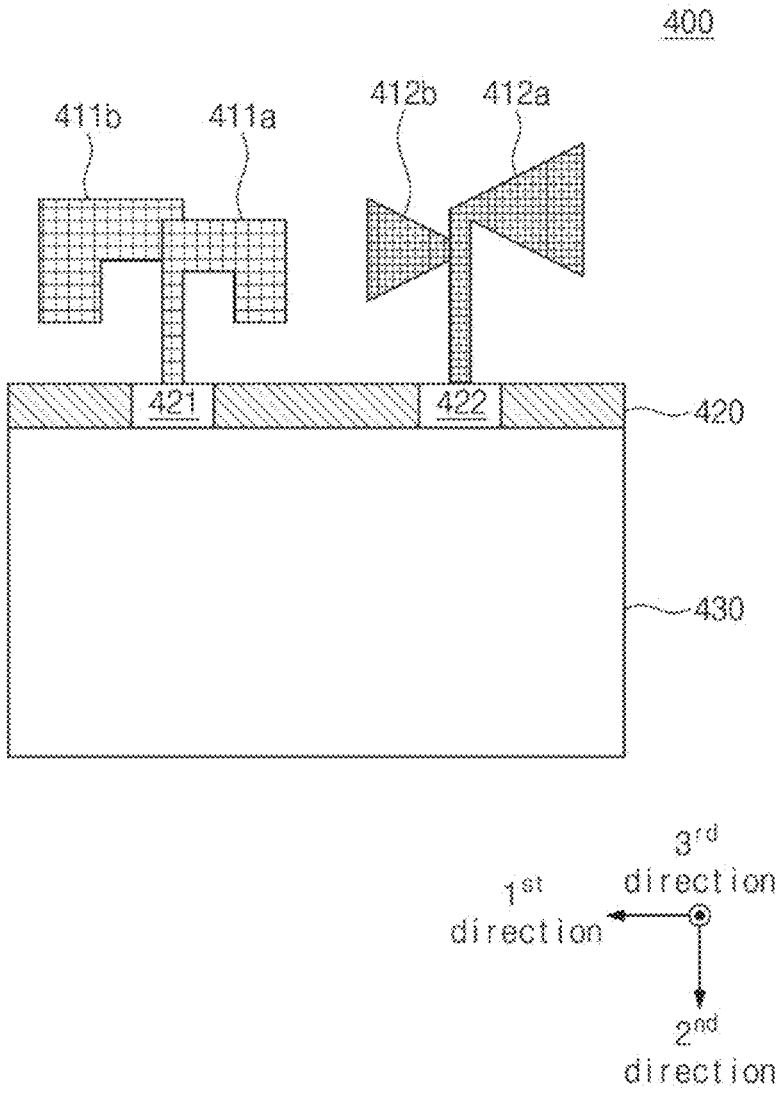
FIG. 27 is a plan view illustrating the antenna device of FIG. 25.

FIG. 27 is a plan view illustrating the antenna device of FIG. 25. Shapes and placement of the first and second radiators 411*a* and 411*b* of the first endfire antenna and the third and fourth radiators 412*a* and 412*b* of the second endfire antenna are illustrated in FIG. 27. A shape of the first radiator 411*a* may be different from a shape of the third radiator 412*a*. A shape of the second radiator 411*b* may be different from a shape of the fourth radiator 412*b*.

Figure 28:
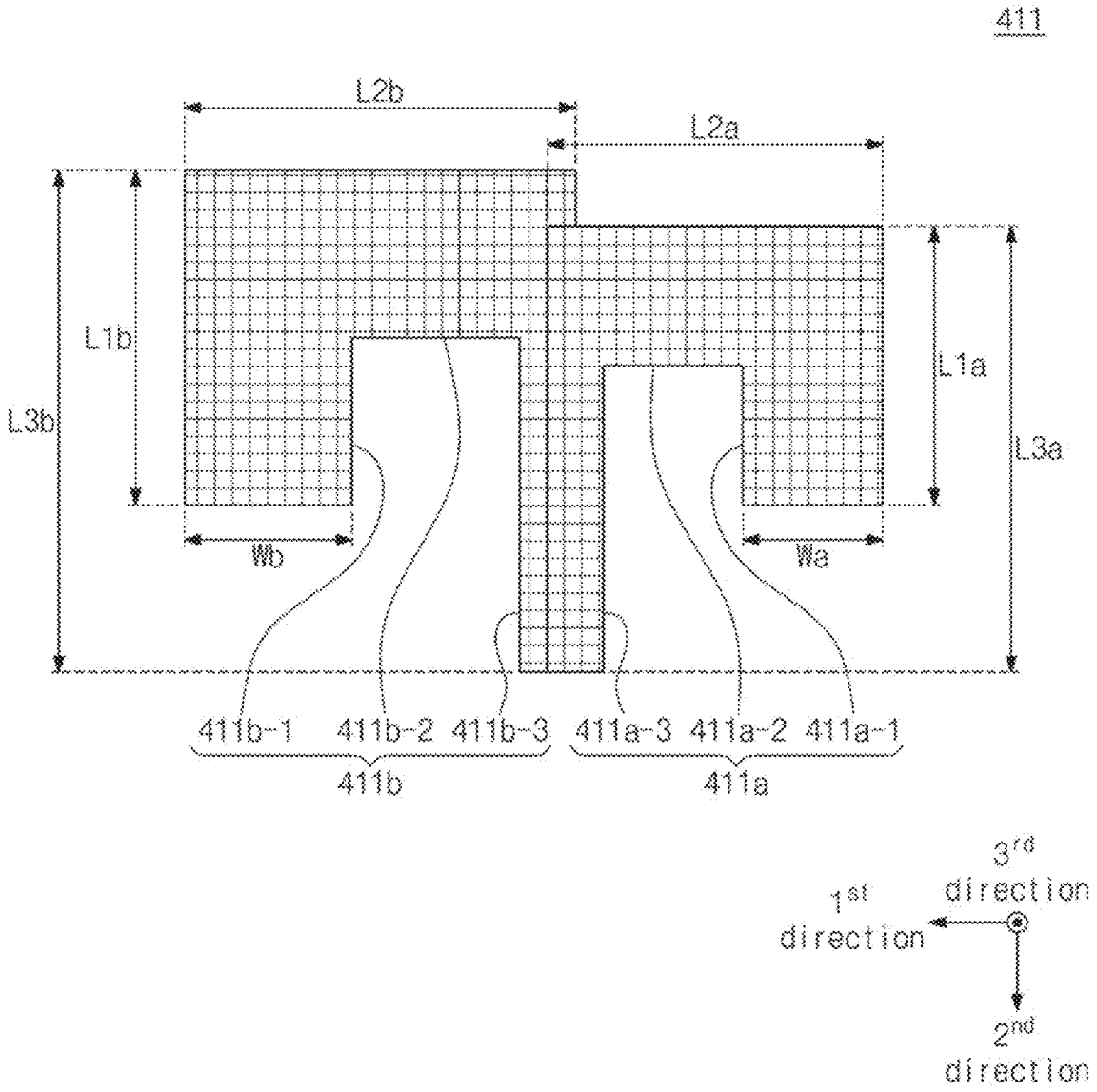
FIG. 28 is a view illustrating an endfire antenna of the antenna device of FIG. 25 in detail.

FIG. 28 is a view illustrating the endfire antenna of FIG. 25 in detail. The first endfire antenna 411 of FIG. 25 is illustrated in FIG. 28. The first endfire antenna 411 may be a dipole antenna operating in the first communication band. The first endfire antenna 411 may include the first and second radiators 411*a* and 411*b*.

The first radiator 411*a* may include a first shape 411*a*-1, a second shape 411*a*-2, and a third shape 411*a*-3 that are connected continuously (or seamlessly). The first shape 411*a*-1 may be a shape that is extended in the second direction with a first width Wa. The second shape 411*a*-2 may be a shape that is connected with the first shape 411*a*-1 and is extended in the first direction. The third shape 411*a*-3 may be a shape that is connected with the second shape 411*a*-2 and is extended in the second direction. The third shape 411*a*-3 may be connected with the first feed line.

The second radiator 411*b* may include a first shape 411*b*-1, a second shape 411*b*-2, and a third shape 411*b*-3 that are connected continuously (or seamlessly). The first shape 411*b*-1 may be a shape that is extended in the second direction with a second width Wb. The second shape 411*b*-2 may be a shape that is connected with the first shape 411*b*-1 and is extended in the direction facing away from the first direction. The third shape 411*b*-3 may be a shape that is connected with the second shape 411*b*-2 and is extended in the second direction. The third shape 411*b*-3 may be connected with the second feed line.

In some exemplary embodiments, the first and second radiators 411*a* and 411*b* may have sizes corresponding to first and second frequencies included in the first communication band. For example, the first communication band may include the first and second frequencies. The first and second shapes 411*a*-1 and 411*a*-2 that are connected may resonate with a signal of the first frequency. The first and second shapes 411*b*-1 and 411*b*-2 that are connected may resonate with a signal of the second frequency. In this case, the first width Wa and the second width Wb may be different. Lengths L1*a* and L2*a* may be different from lengths L1*b* and L2*b*, respectively.

Figure 29:
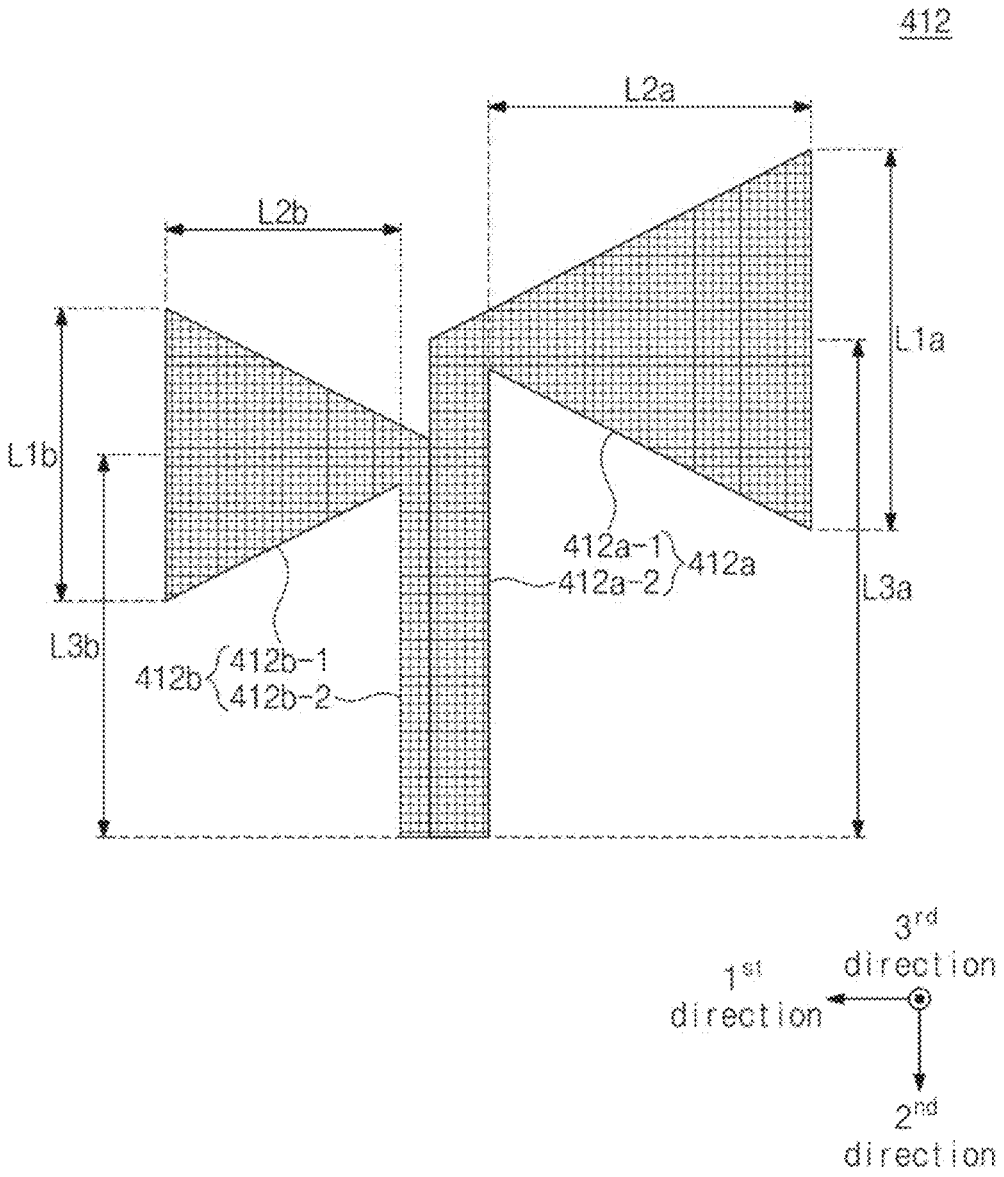
FIG. 29 is a view illustrating an endfire antenna of FIG. 25 in detail.

FIG. 29 is a view illustrating the endfire antenna of FIG. 25 in detail. The second endfire antenna 412 of FIG. 25 is illustrated in FIG. 29. The second endfire antenna 412 may be a dipole antenna operating in the second communication band. The second endfire antenna 412 may include the third and fourth radiators 412*a* and 412*b*.

The third radiator 412*a* may include a first shape 412*a*-1 and a second shape 412*a*-2 that are connected continuously (or seamlessly). The first shape 412*a*-1 may be a shape in which a width in the second direction widens in the direction facing away from the first direction. The second shape 412*a*-2 may be a shape that is connected with the first shape 412*a*-1 and is extended in the second direction. The second shape 412*a*-2 may be connected with the third feed line.

The fourth radiator 412*b* may include a first shape 412*b*-1 and a second shape 412*b*-2 that are connected continuously (or seamlessly). The first shape 412*b*-1 may be a shape in which a width in the second direction widens in the first direction. The second shape 412*b*-2 may be a shape that is connected with the first shape 412*b*-1 and is extended in the second direction. The second shape 412*b*-2 may be connected with the fourth feed line.

In some exemplary embodiments, the third and fourth radiators 412*a* and 412*b* may have sizes corresponding to third and fourth frequencies included in the second communication band. For example, the second communication band may include the third and fourth frequencies. The first shape 412*a*-1 may resonate with a signal of the third frequency. The first shape 412*b*-1 may resonate with a signal of the fourth frequency. In this case, the lengths L1*a* and L2*a* may be different from the lengths L1*b* and L2*b*, respectively.

Figure 30A:
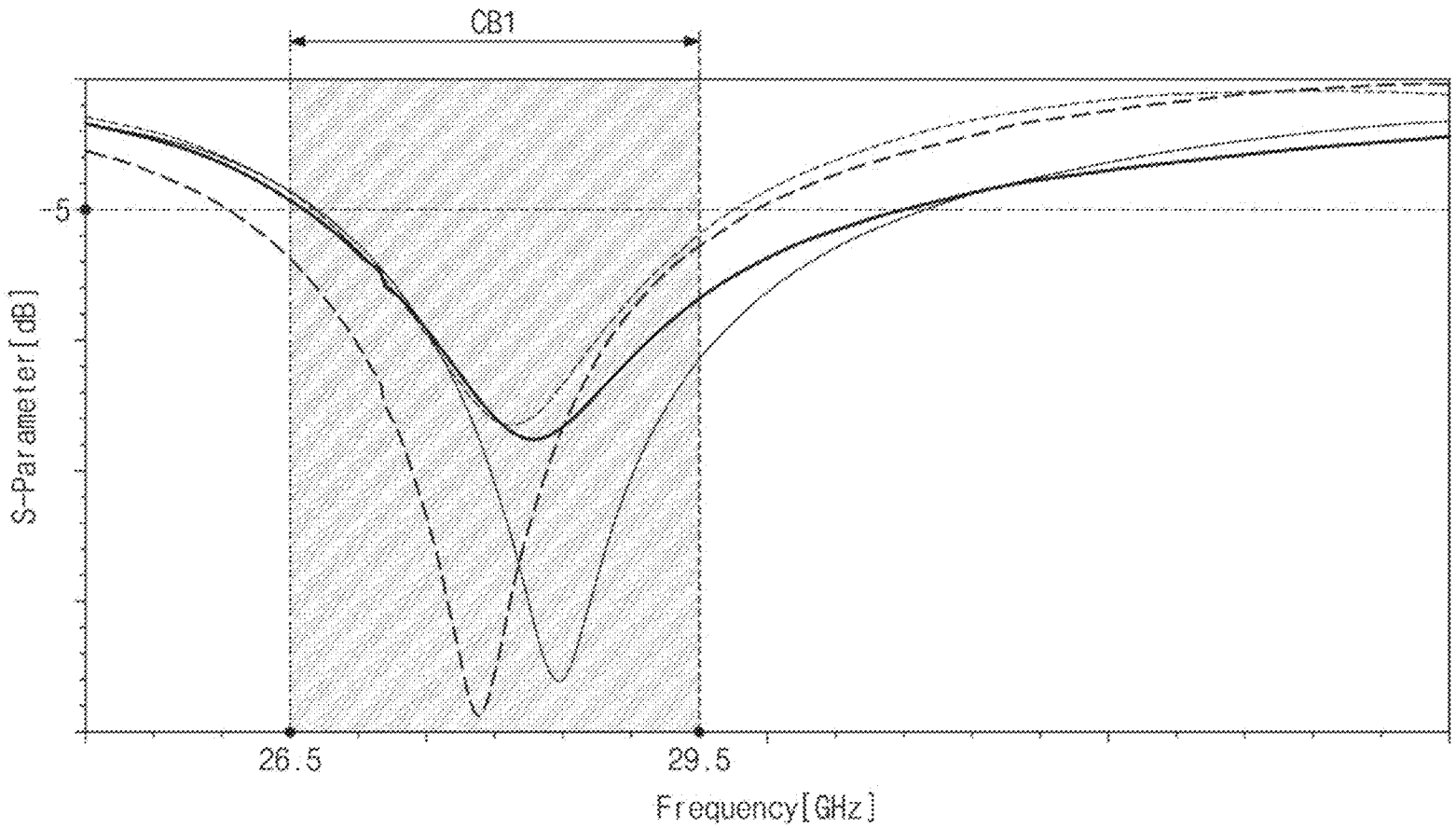
FIGS. 30A to 30C are graphs illustrating communication characteristics of the antenna device of FIG. 25 in a first communication band.
Figure 30B:
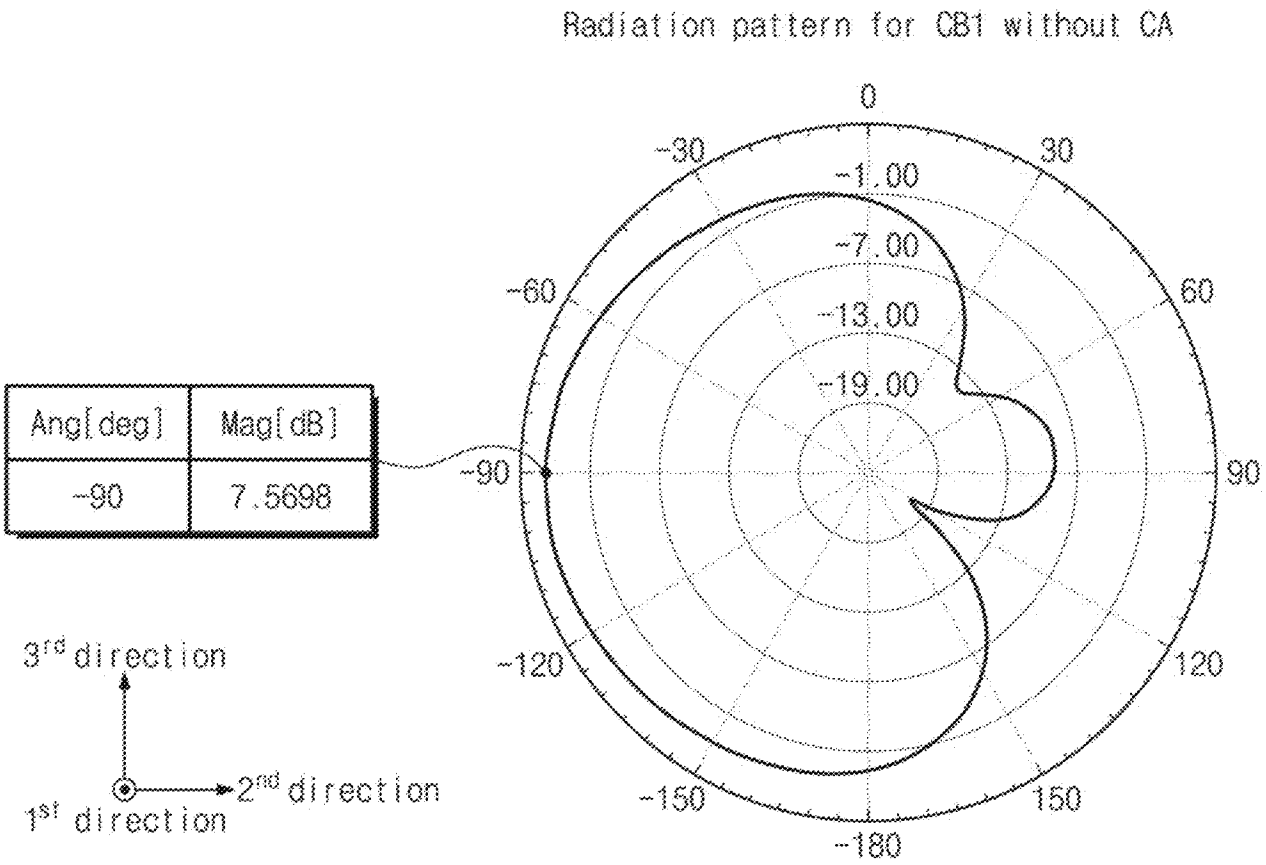
Figure 30C:
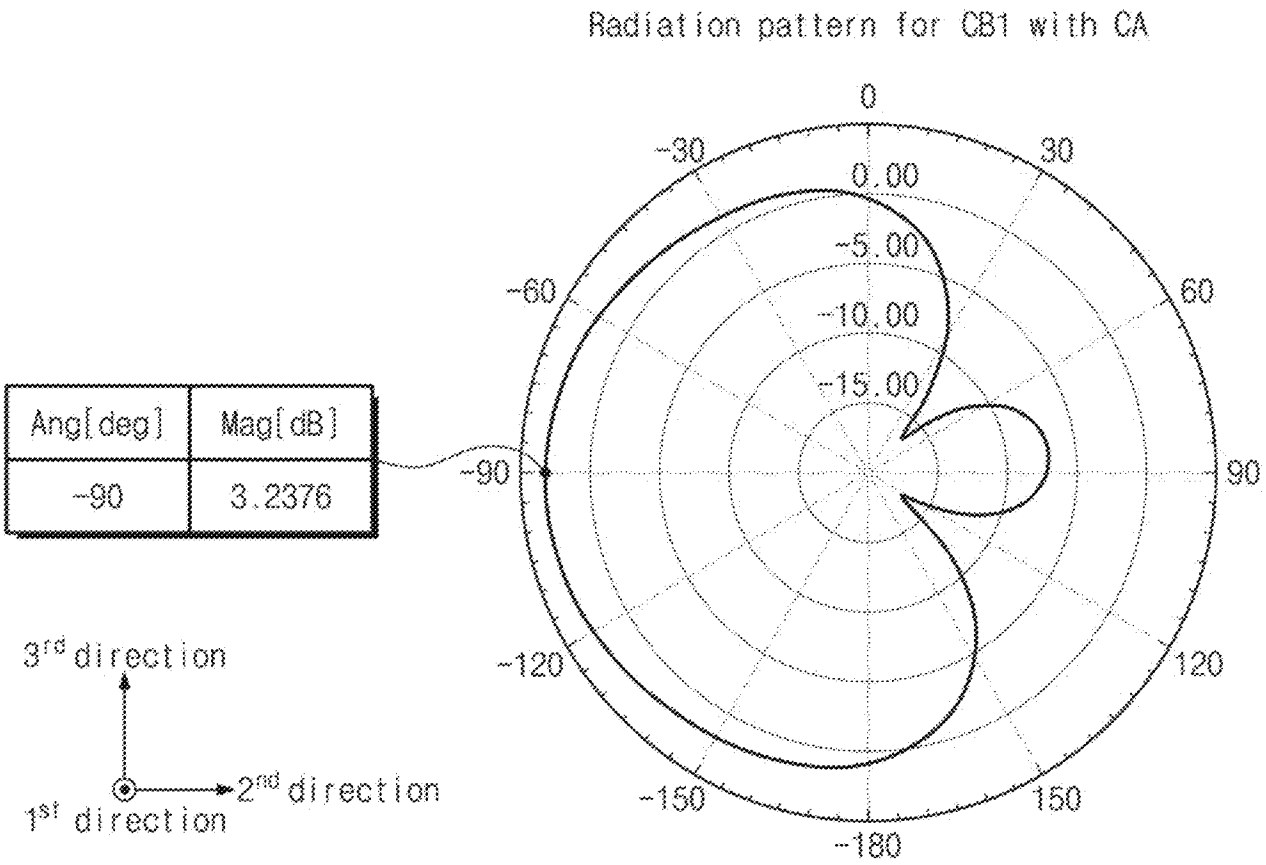

FIGS. 30A to 30C are graphs illustrating communication characteristics of the antenna device of FIG. 25 in the first communication band. An S-parameter in the first communication band CB1 associated with the antenna device 400 of FIG. 25 is illustrated in FIG. 30A. A radiation pattern in the first communication band CB1 associated with the antenna device 400 of FIG. 25, to which the CA is not applied, is illustrated in FIG. 30B. A radiation pattern in the first communication band CB1 associated with the antenna device 400 of FIG. 25, to which the CA is applied, is illustrated in FIG. 30C.

In some exemplary embodiments, an antenna device may operate in a frequency band having the S-parameter of the threshold value or less. For example, referring to FIG. 30A, an antenna having the S-parameter of −5 dB or less in the first communication band CB1 may be used for the communication using the first communication band CB1.

Figure 31A:
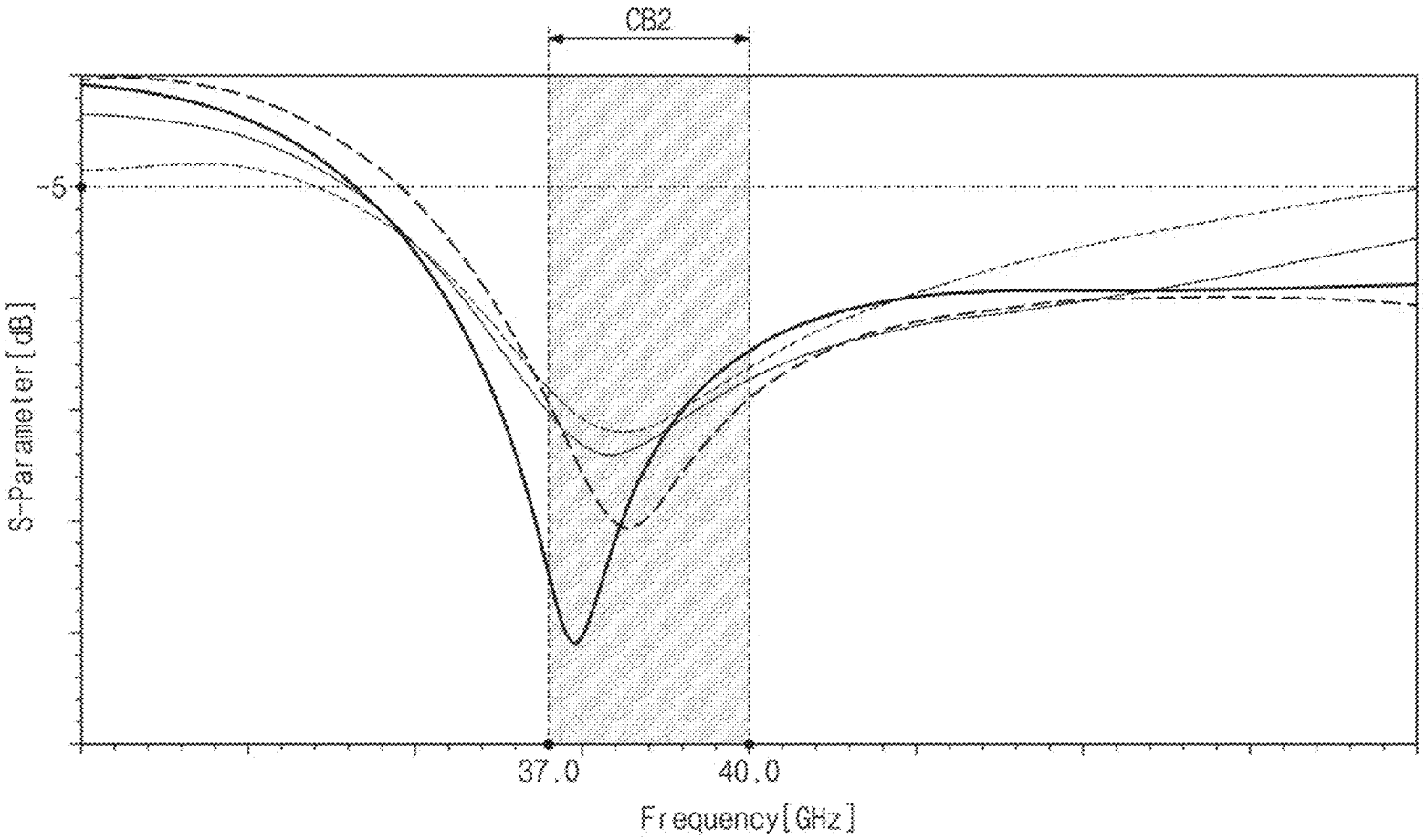
FIGS. 31A to 31C are graphs illustrating communication characteristics of the antenna device of FIG. 25 in a second communication band.
Figure 31B:
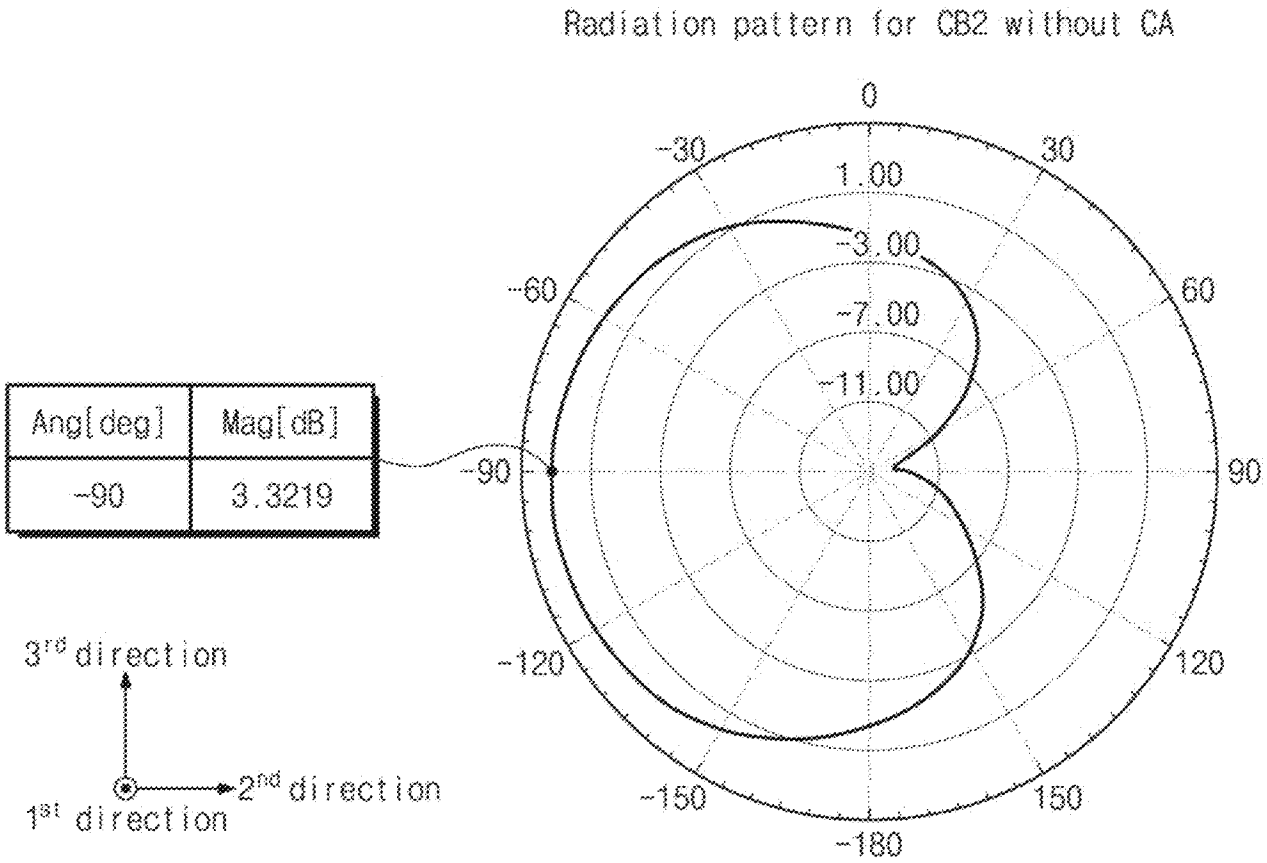
Figure 31C:
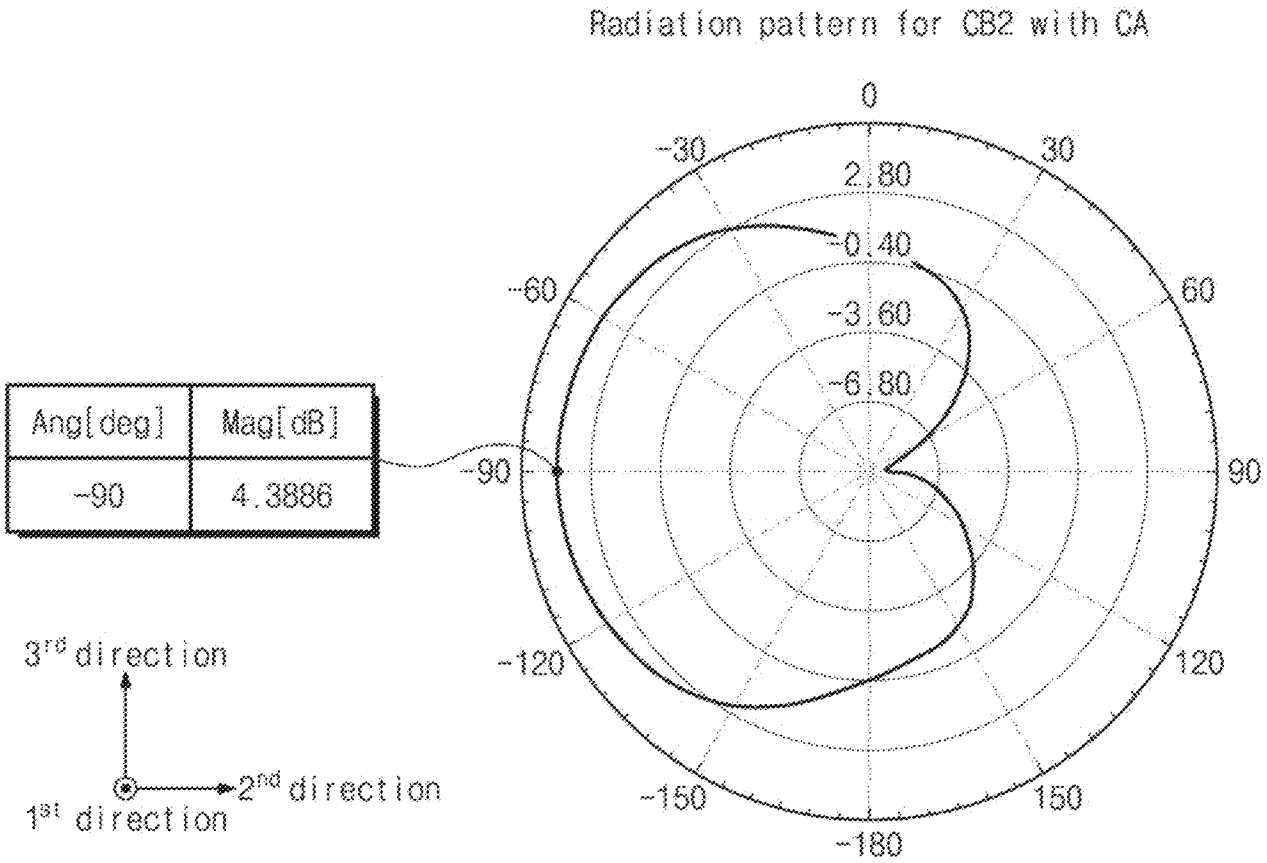

FIGS. 31A to 31C are graphs illustrating communication characteristics of the antenna device of FIG. 25 in the second communication band. An S-parameter in the second communication band CB2 associated with the antenna device 400 of FIG. 25 is illustrated in FIG. 31A. A radiation pattern in the second communication band CB2 associated with the antenna device 400 of FIG. 25, to which the CA is not applied, is illustrated in FIG. 31B. A radiation pattern in the second communication band CB2 associated with the antenna device 400 of FIG. 25, to which the CA is applied, is illustrated in FIG. 31C.

In some exemplary embodiments, an antenna device may operate in a frequency band having the S-parameter of the threshold value or less. For example, referring to FIG. 31A, an antenna having the S-parameter of −5 dB or less in the second communication band CB2 may be used for the communication using the second communication band CB2.

Figure 32:
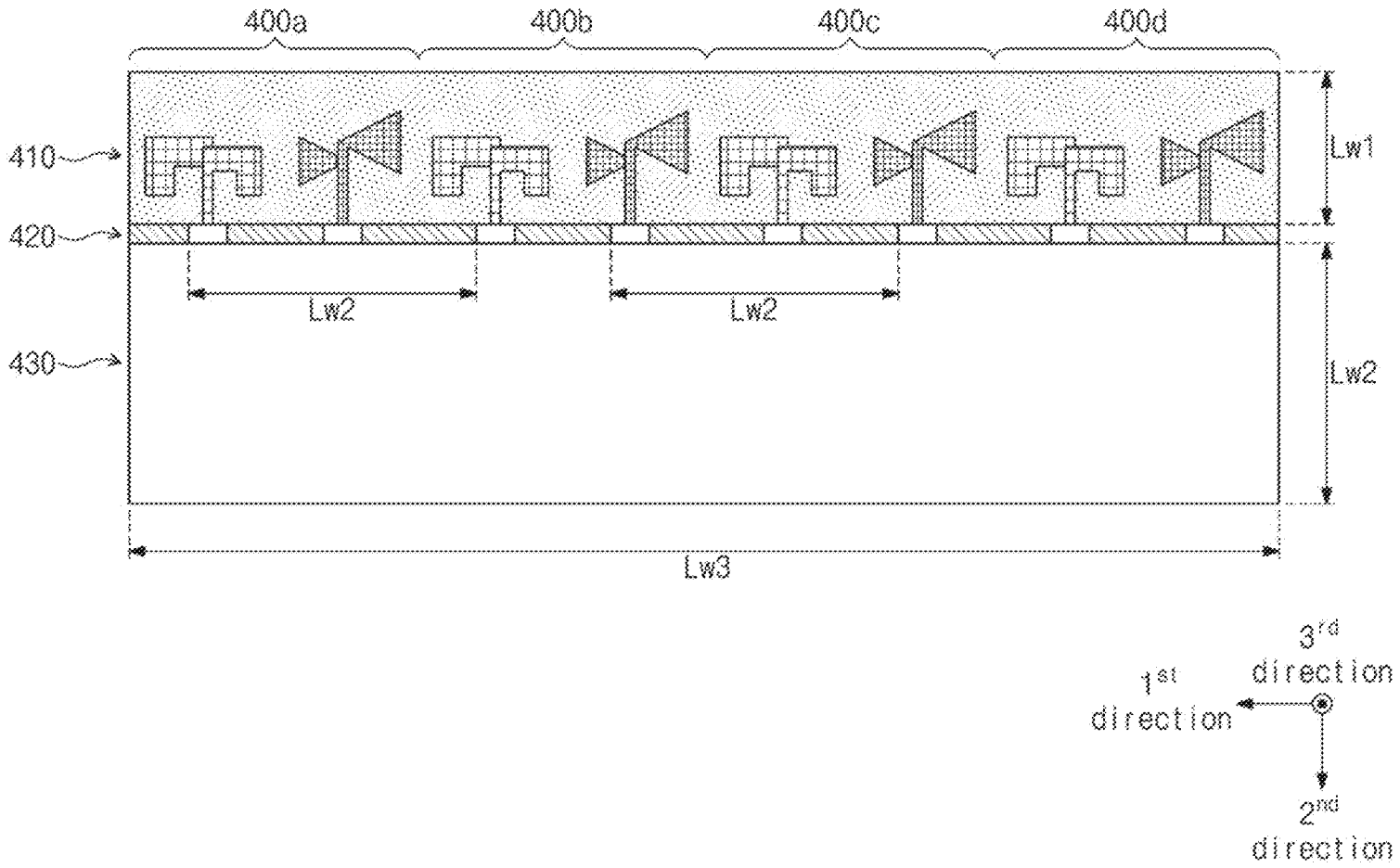
FIG. 32 is a plan view illustrating a 4-bay antenna device according to an embodiment.

FIG. 32 is a plan view illustrating a 4-bay antenna device according to an embodiment. A 4-bay antenna device of a differential type is illustrated in FIG. 32. Each of antenna devices 400*a* to 400*d* included in the 4-bay antenna device may have a configuration similar to that of the antenna device 400 of FIG. 25.

Adjacent endfire antennas having similar shapes may be spaced from each other in the first direction by a width Lw2. For example, the first endfire antenna of the antenna device 400*a* may be spaced from the first endfire antenna of the antenna device 400*b* in the first direction by the width Lw2. The second endfire antenna of the antenna device 400*b* may be spaced from the second endfire antenna of the antenna device 400*c* in the first direction by the width Lw2. For example, the width Lw2 may be about 5 mm.

Figure 33A:
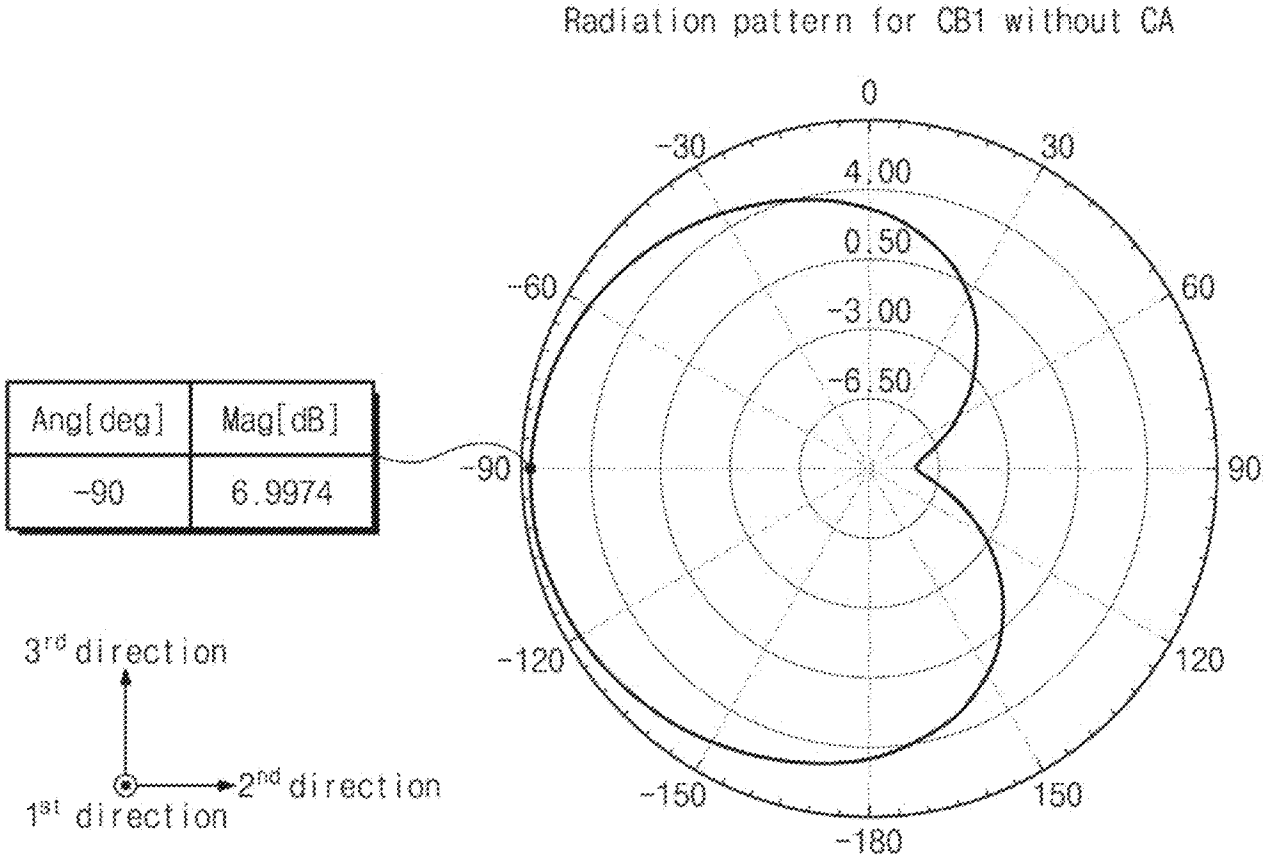
FIGS. 33A to 36B are graphs illustrating communication characteristics of the 4-bay antenna device of FIG. 32.
Figure 33B:
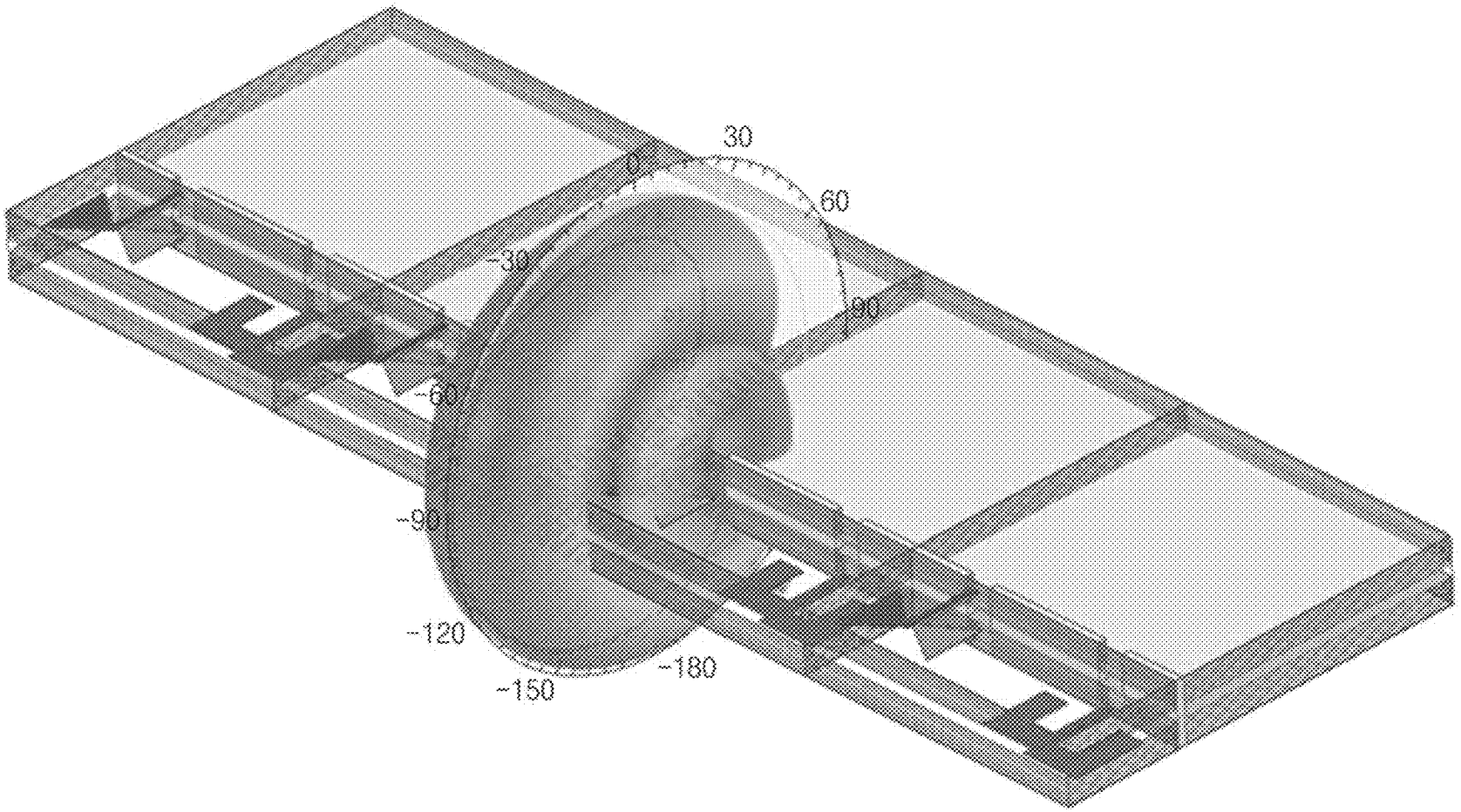

FIGS. 33A to 36B are graphs illustrating communication characteristics of the 4-bay antenna device of FIG. 32. A radiation pattern in the first communication band CB1 associated with the 4-bay antenna device of FIG. 32, to which the CA is not applied, is illustrated in FIG. 33A. A three-dimensional radiation pattern corresponding to the radiation pattern of FIG. 33A is illustrated in FIG. 33B.

Figure 34A:
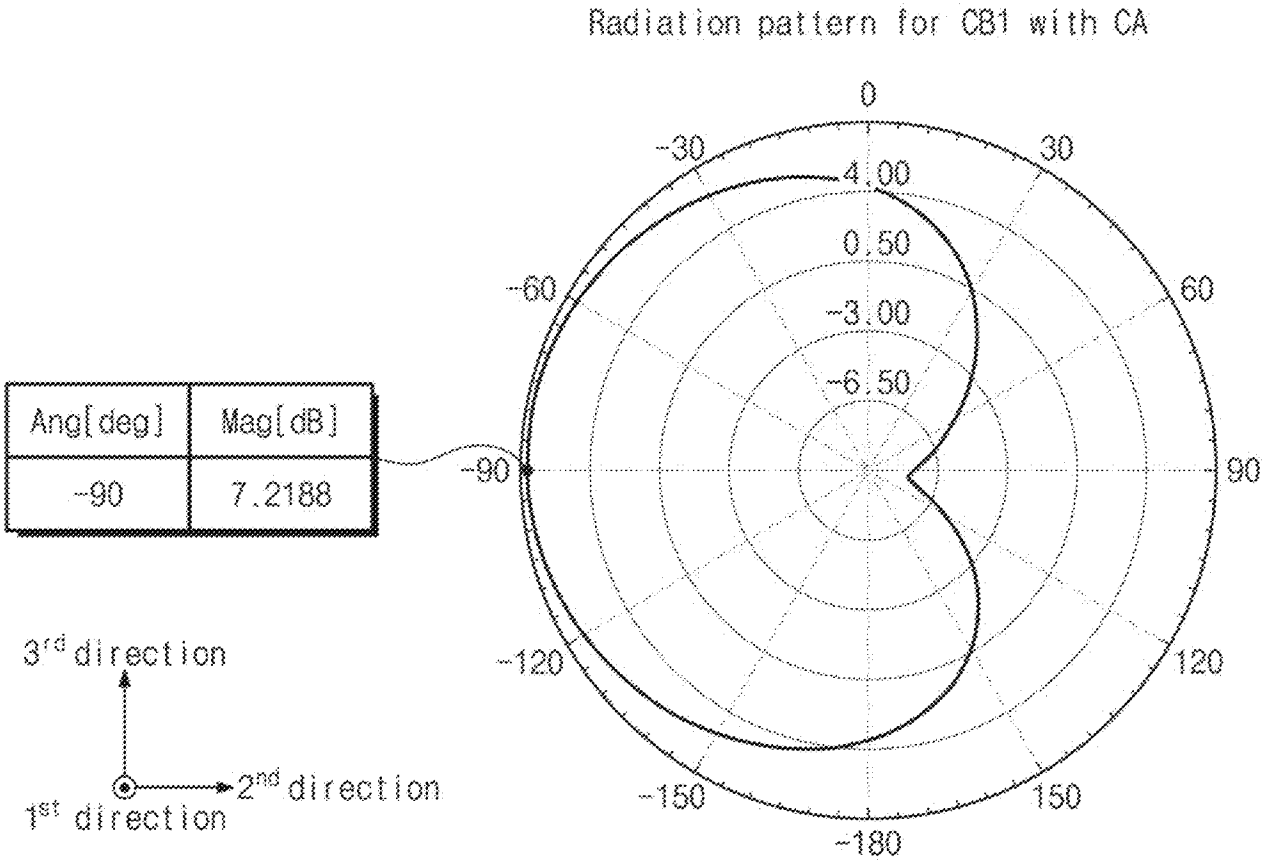
Figure 34B:
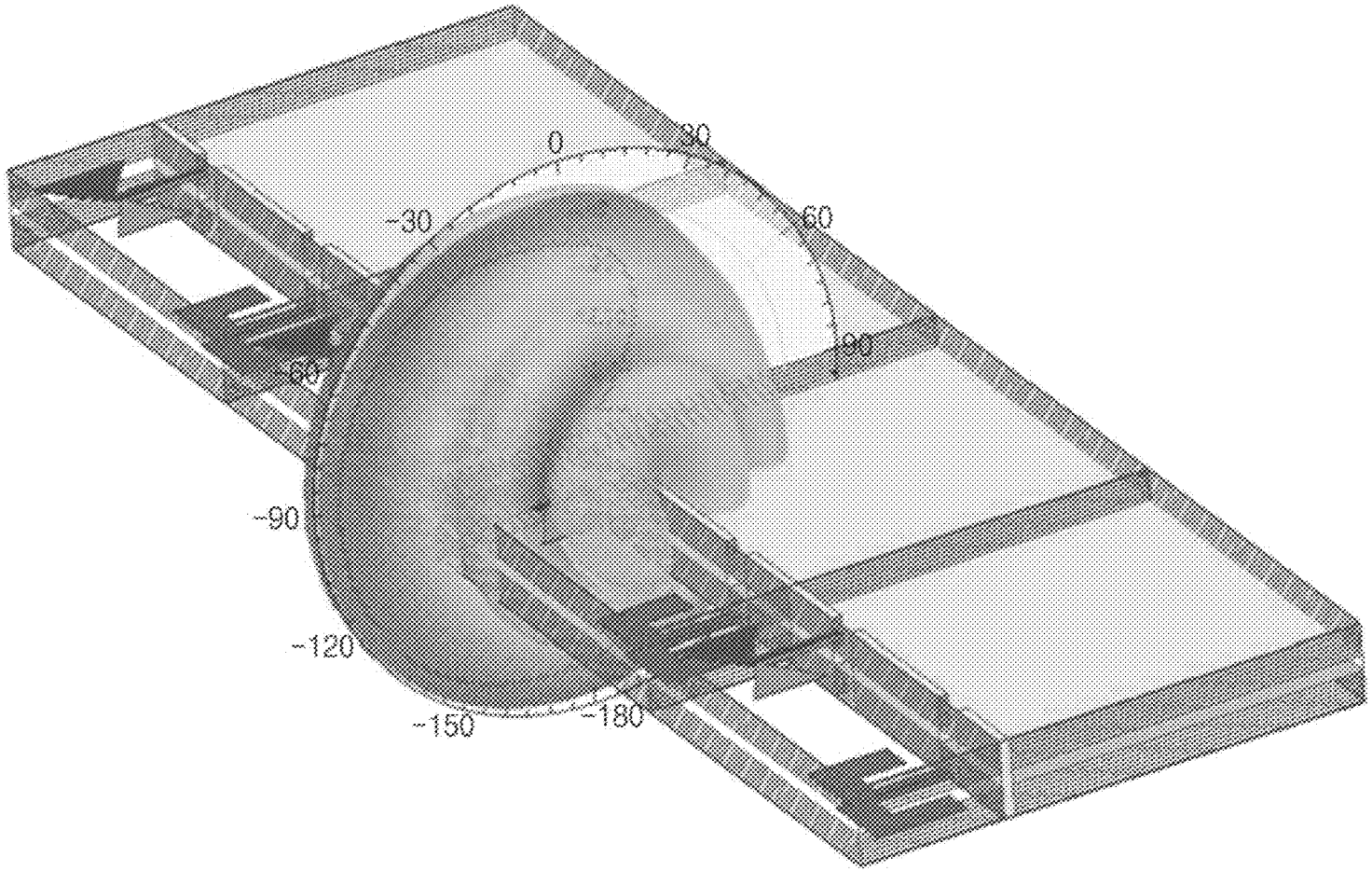

A radiation pattern in the first communication band CB1 associated with the 4-bay antenna device of FIG. 32, to which the CA is applied, is illustrated in FIG. 34A. A three-dimensional radiation pattern corresponding to the radiation pattern of FIG. 34A is illustrated in FIG. 34B.

Figure 35A:
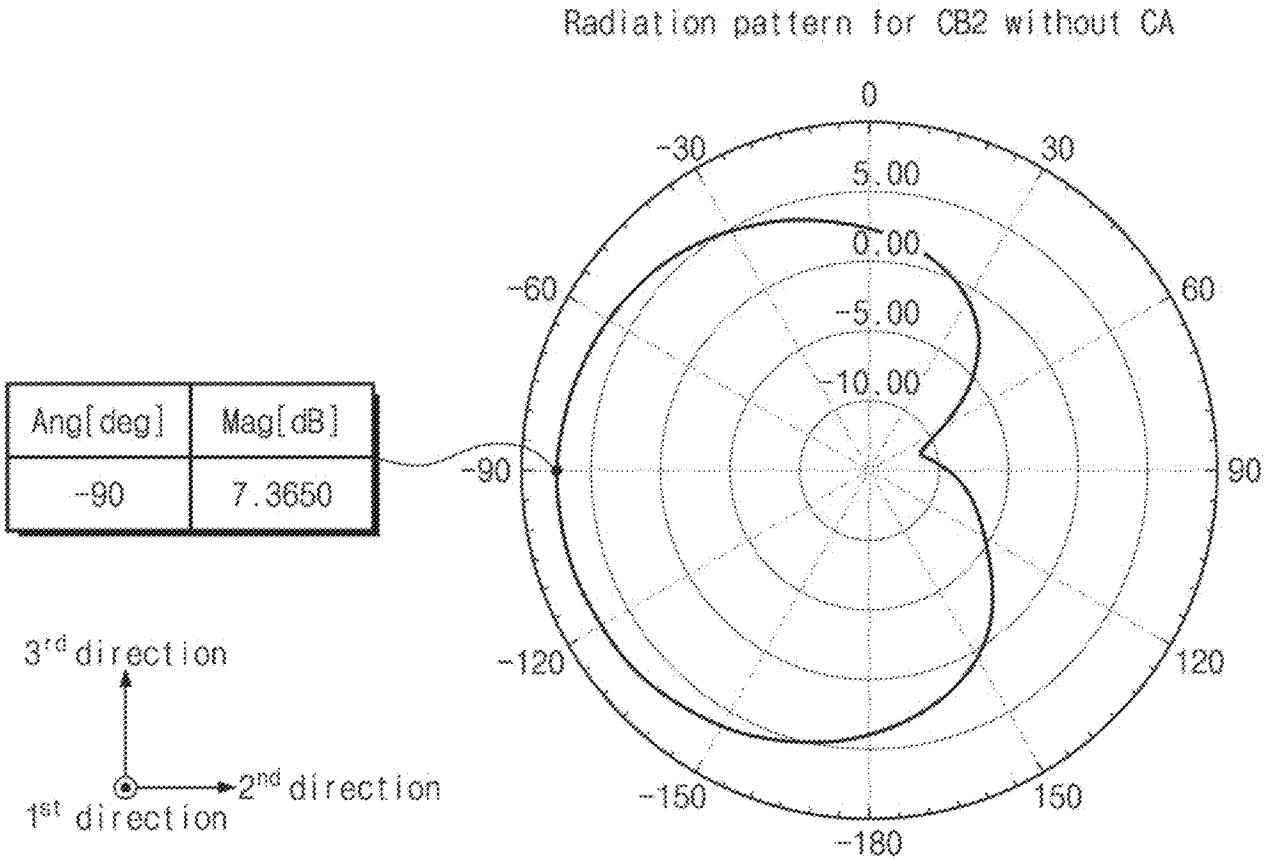
Figure 35B:
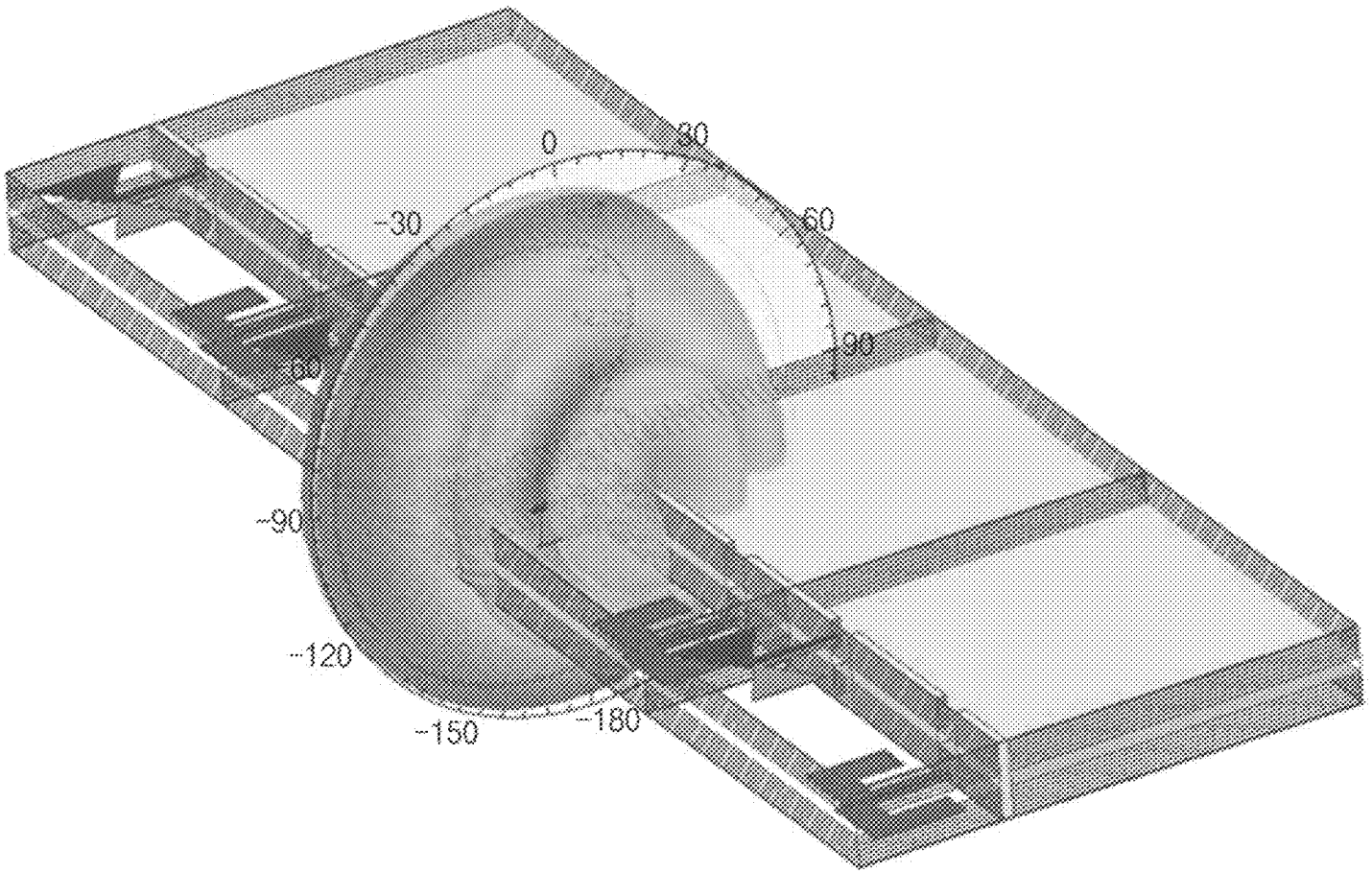

A radiation pattern in the second communication band CB2 associated with the 4-bay antenna device of FIG. 32, to which the CA is not applied, is illustrated in FIG. 35A. A three-dimensional radiation pattern corresponding to the radiation pattern of FIG. 35A is illustrated in FIG. 35B.

Figure 36A:
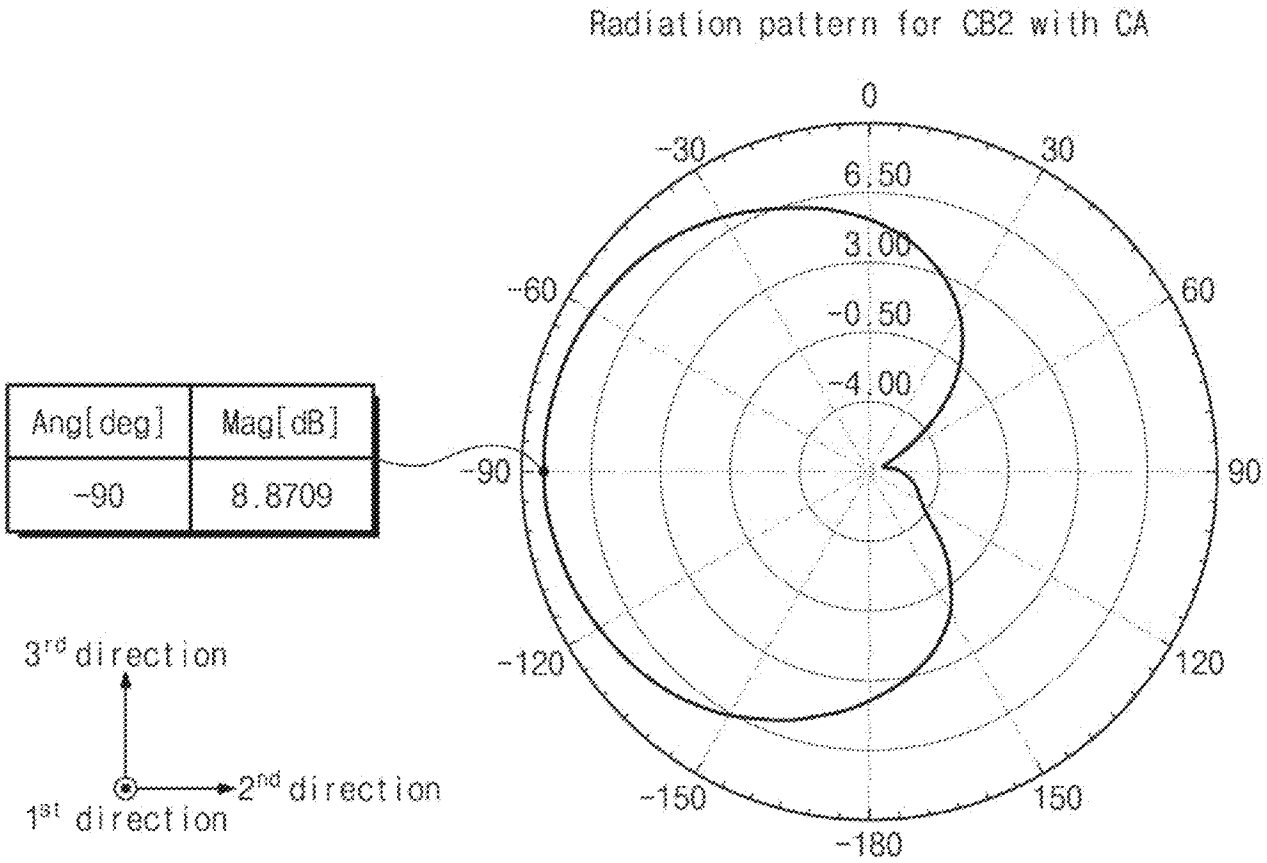
Figure 36B:
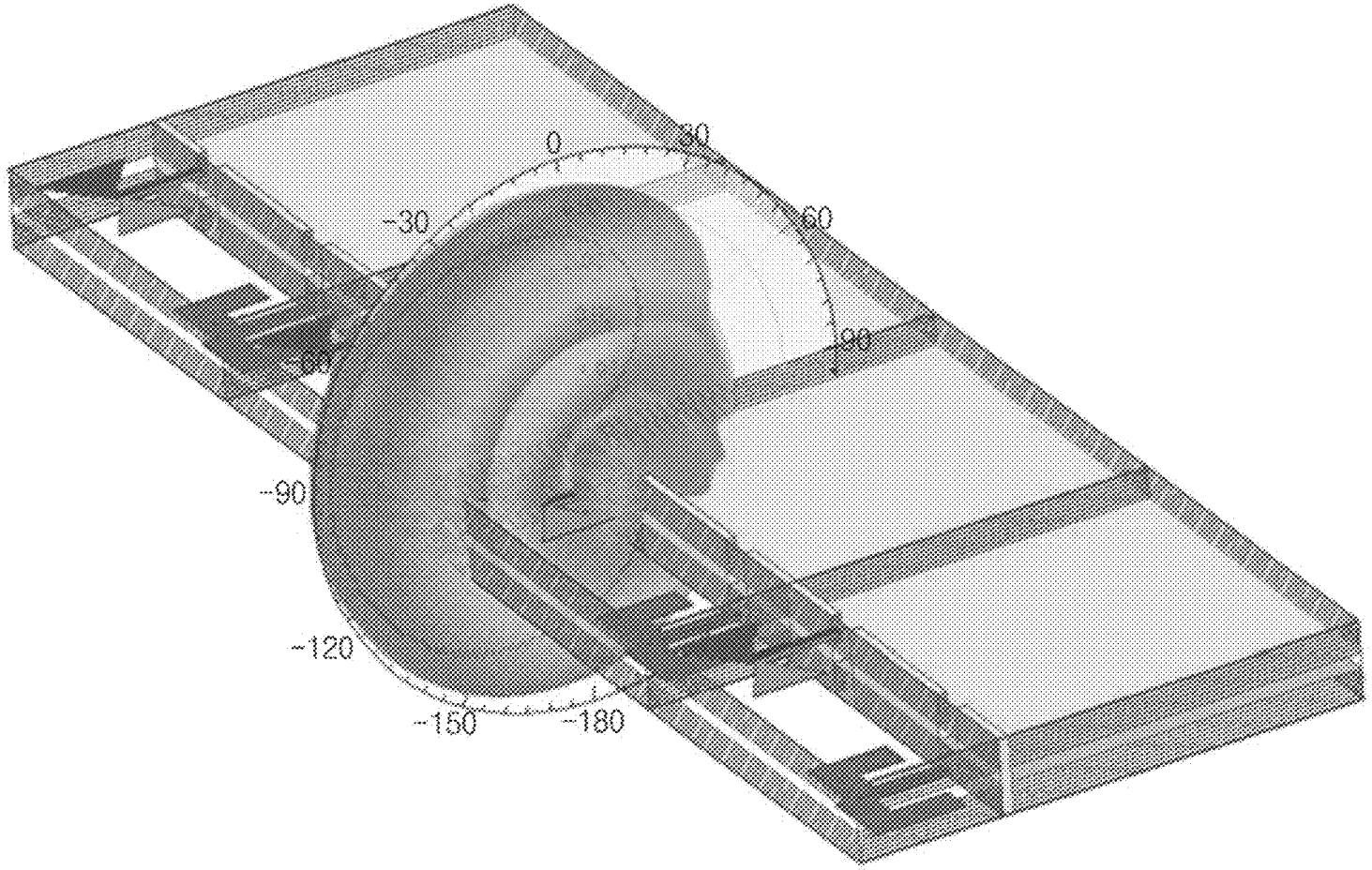

A radiation pattern in the second communication band CB2 associated with the 4-bay antenna device of FIG. 32, to which the CA is applied, is illustrated in FIG. 36A. A three-dimensional radiation pattern corresponding to the radiation pattern of FIG. 36A is illustrated in FIG. 36B.

Figure 37:
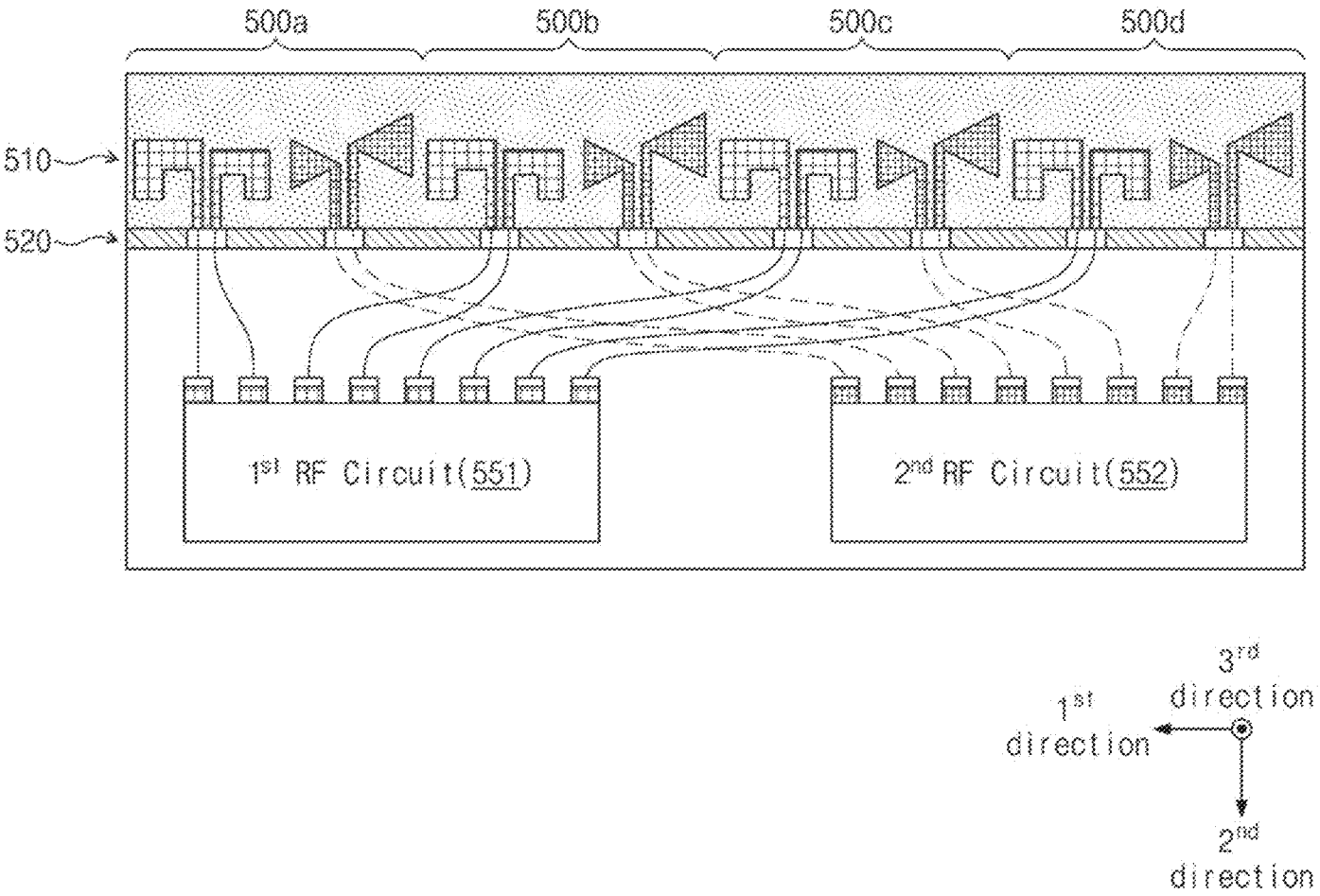
FIG. 37 is a plan view illustrating feed lines of a 4-bay antenna device according to an embodiment.

FIG. 37 is a plan view illustrating feed lines of a 4-bay antenna device according to an embodiment. A 4-bay antenna device according to various exemplary embodiments is illustrated in FIG. 37. The 4-bay antenna device may include a plurality of antenna devices 500*a* to 500*d*.

Each of the plurality of antenna devices 500*a* to 500*d* may include first and second endfire antennas. The first endfire antenna may include a pair of radiators that transmit/receive an RF signal in the first communication band. The second endfire antenna may include a pair of radiators that transmit/receive an RF signal in the second communication band.

The 4-bay antenna device may further include a first RF circuit 551 and a second RF circuit 552. The first RF circuit 551 may be connected with the first endfire antennas through feed lines. The first RF circuit 551 may be a circuit configured to process RF signals in the first communication band to be transmitted or received through the first endfire antennas.

The second RF circuit 552 may be connected with the second endfire antennas through feed lines. The second RF circuit 552 may be a circuit configured to process RF signals in the second communication band to be transmitted or received through the second endfire antennas.

As illustrated in FIG. 37, it may be complicated to place the feed lines connecting radiators included in the endfire antennas and the first and second RF circuits 551 and 552. Alternatively, after the placement of endfire antennas and the ports of the first and second RF circuits 551 and 552 are completed, due to the limitation on a physical structure, it may be impossible to place the feed lines connecting the endfire antennas and the first and second RF circuits 551 and 552. As such, a way to place the feed lines connecting the radiators included in the endfire antennas and the first and second RF circuits 551 and 552 within a limited space may be required.

According to various exemplary embodiments, there may be provided a way to place feed lines such that feed lines for connection with the first RF circuit 551 and feed lines for connection with the second RF circuit 552 are formed at different conductive layers.

For example, the feed lines (marked by a solid line) for connection with the first RF circuit 551 may be formed at a first feed layer. The feed lines (marked by a broken line) for connection with the second RF circuit 552 may be formed at a second feed layer. As such, the feed lines for connection with the first RF circuit 551 and the feed lines for connection with the second RF circuit 552 may be placed to overlap each other in the third direction. This will be more fully described with reference to FIG. 38.

Figure 38:
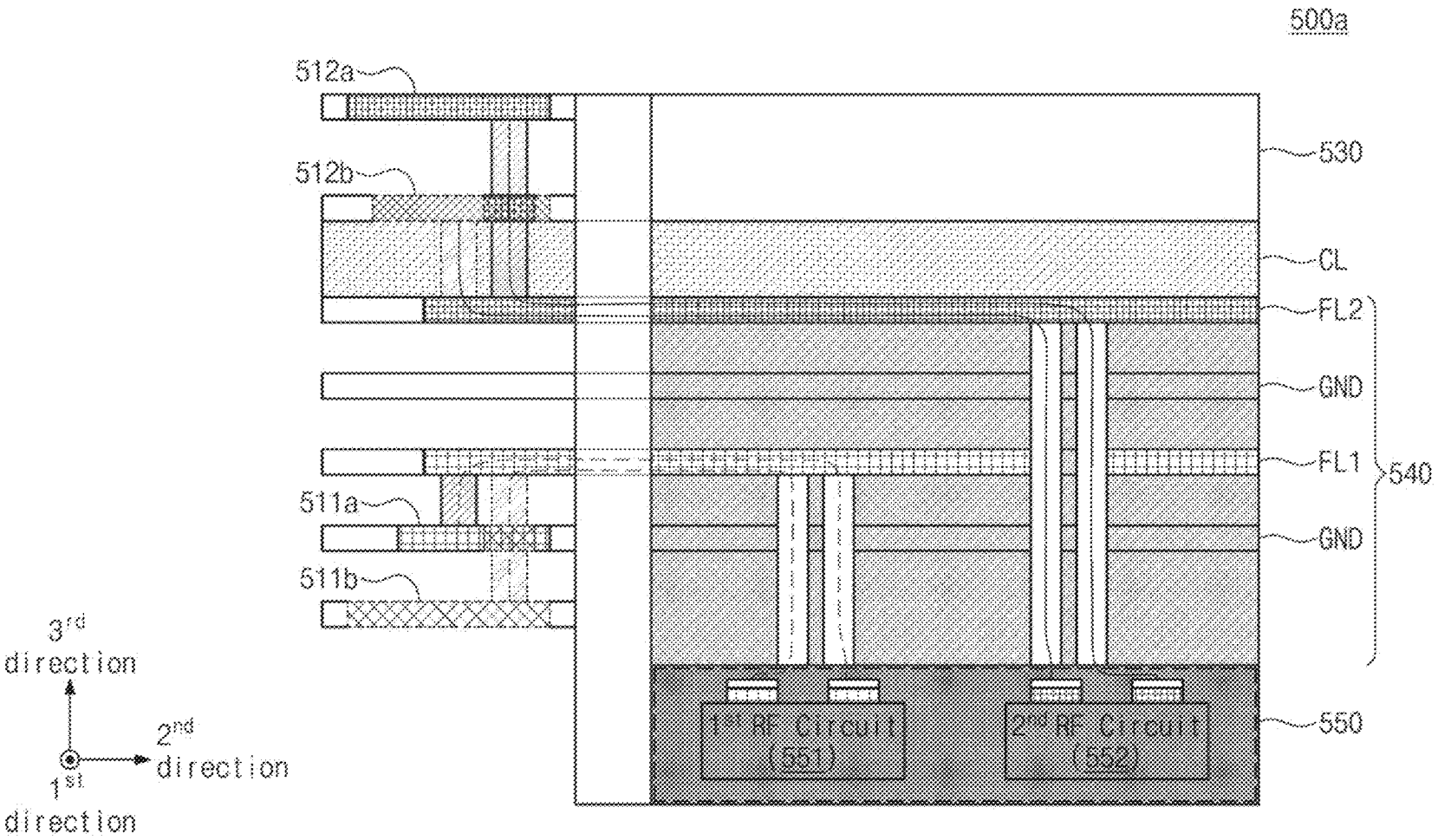
FIG. 38 is a cross-sectional view illustrating an antenna device including the 4-bay antenna device of FIG. 37 in detail.

FIG. 38 is a cross-sectional view illustrating an antenna device including the 4-bay antenna device of FIG. 37 in detail. A cross-sectional view of the antenna device 500*a* including the 4-bay antenna device of FIG. 37 is illustrated in FIG. 38. For better understanding, a cross-sectional view of the antenna device 500*a* is illustrated in FIG. 38 with a scale different from that of FIG. 37.

The antenna device 500*a* may include the core layer CL, a patch antenna space 530, and a feed space 540. The feed space 540 of the antenna device 500*a* may be connected with a signal processing device 550. The patch antenna space 530 may be placed above the core layer CL in the third direction. The feed space 540 and the signal processing device 550 may be placed below the core layer CL in the third direction, as illustrated in FIG. 38. The signal processing device 550 may include the first RF circuit 551 and the second RF circuit 552.

The feed space 540 may include a first feed layer FL1, a second feed layer FL2, and a plurality of ground layers GND. In this case, a feed layer may be a conductive layer where a radiator constituting at least a portion of a feed line is formed. In some exemplary embodiments, the ground layer GND, the first feed layer FL1, the ground layer GND, and the second feed layer FL2 may be stacked in the third direction.

According to various exemplary embodiments, a feed layer through which a feed line for connection with the first RF circuit 551 passes may be different from a feed layer through which a feed line for connection with the second RF circuit 552 passes. For example, the first and second feed lines connected with first and second radiators 511*a* and 511*b* of the first endfire antenna may pass through the first feed layer FL1 and may be connected with the first RF circuit 551. The third and fourth feed lines connected with third and fourth radiators 512*a* and 512*b* of the second endfire antenna may pass through the second feed layer FL2 and may be connected with the second RF circuit 552.

Figure 39:
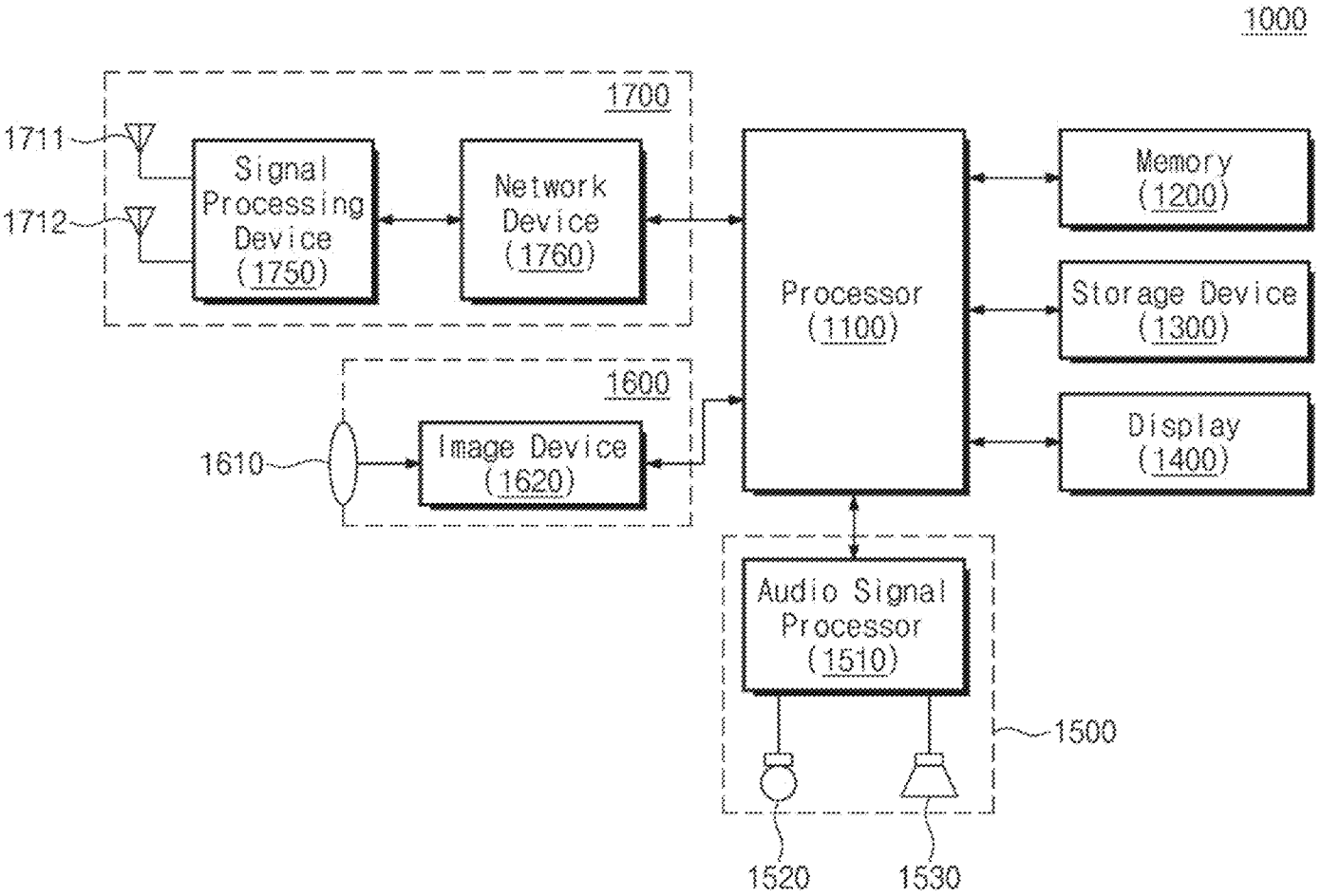
FIG. 39 is a diagram illustrating an electronic system to which an antenna device according to various embodiments is applied.

FIG. 39 is a diagram illustrating an electronic system to which an antenna device according to various exemplary embodiments is applied. Referring to FIG. 39, an electronic system 1000 may include a processor 1100, a memory 1200, a storage device 1300, a display 1400, an audio device 1500, a camera device 1600, and an antenna device 1700. In some exemplary embodiments, the electronic system 1000 may be one of various electronic devices, such as a smartphone, a tablet personal computer (PC), a laptop computer, a server, a workstation, a black box, and a digital camera, or an electronic system applied to a vehicle.

The processor 1100 may control overall operations of the electronic system 1000. The processor 1100 may control or manage operations of the components of the electronic system 1000. The processor 1100 may process various operations for the purpose of operating the electronic system 1000. In some exemplary embodiments, the processor 1100 may be an application processor (AP), or the like.

The memory 1200 may store data to be used for an operation of the electronic system 1000. For example, the memory 1200 may be used as a buffer memory, a cache memory, or a working memory of the electronic system 1000. For example, the memory 1200 may include a volatile memory such as a static random access memory (SRAM), a dynamic RAM (DRAM), or a synchronous DRAM (SDRAM), or a nonvolatile memory such as a phase-change RAM (PRAM), a magneto-resistive RAM (MRAM), a resistive RAM (ReRAM), or a ferroelectric RAM (FRAM), or the like.

The storage device 1300 may be used as a high-capacity storage medium of the electronic system 1000. The storage device 1300 may include at least one of various nonvolatile memories such as a flash memory, a PRAM, an MRAM, a ReRAM, or a FRAM, or the like. In some exemplary embodiments, the storage device 1300 may be embedded in the electronic system 1000 or may be removable from the electronic system 1000.

The display 1400 may be configured to output a variety of information under control of the processor 1100. The audio device 1500 includes an audio signal processor 1510, a microphone 1520, and a speaker 1530. The audio device 1500 may process an audio signal through an audio signal processor 1510. The audio device 1500 may receive an audio signal through the microphone 1520 or may output an audio signal through the speaker 1530.

The camera device 1600 may include a lens 1610 and an image device 1620. The camera device 1600 may receive a light corresponding to a subject through the lens 1610. The image device 1620 may generate image information about the subject based on the light received through the lens 1610.

The antenna device 1700 may include a first endfire antenna 1711, a second endfire antenna 1712, a signal processing device 1750, and a network device 1760. The network device 1760 may process an RF signal to be transmitted or received to or from an external device or system, in compliance with at least one of various wireless communication protocols: long term evolution (LTE), worldwide interoperability for microwave access (WiMax), global system for mobile communication (GSM), code division multiple access (CDMA), Bluetooth, near field communication (NFC), wireless fidelity (Wi-Fi), or radio frequency identification (RFID), or the like. In some exemplary embodiments, the antenna device 1700 may include at least a part of components of an antenna device operating in a multi-band described with reference to FIGS. 1 to 38.

In some exemplary embodiments, at least a part of the components of the electronic system 1000 described with reference to FIG. 39 may be implemented with a system-on-chip (SoC).

According to various exemplary embodiments, a multi-band antenna device that transmits/receives radio frequency signals in a multi-band within a limited space is provided.

Also, an antenna device in which the intensity of a signal is secured in a specific communication band, a radiation pattern is focused in a specific direction, and a chip size is reduced is provided.

While various exemplary embodiments have been described, it will be apparent to those of ordinary skill in the art that various changes and modifications may be made thereto without departing from the spirit and scope of the present disclosure as set forth in the following claims.

What is claimed is:

1. An antenna device comprising:

an antenna space including a first antenna configured to transmit/receive a first radio frequency (RF) signal in a first communication band and a second antenna configured to transmit/receive a second RF signal in a second communication band different from the first communication band;

a barrier including a penetration region, the barrier disposed adjacent to the antenna space and reflecting the first RF signal and the second RF signal;

a signal processing device disposed adjacent to the barrier, the signal processing device including a first RF circuit configured to process the first RF signal and a second RF circuit configured to process the second RF signal; and a feed space comprising a first feed layer and a second feed layer, the feed space being disposed adjacent to and stacked on the signal processing device and adjacent to the barrier, wherein a first feed line connecting the first RF circuit to the first antenna passes through the first feed layer and the penetration region of the barrier, and a second feed line connecting the second RF circuit to the second antenna passes through the second feed layer and the penetration region of the barrier.

2. The antenna device of claim 1, wherein the first antenna is separated from the second antenna in a stacking direction of the first feed layer and the second feed layer on the signal processing device.

3. The antenna device of claim 1, wherein the first antenna comprises a first radiator and a second radiator which, when viewed in a plan view, together have a bow-tie shape.

4. The antenna device of claim 3, wherein the second antenna comprises a third radiator and a fourth radiator which, when viewed in the plan view, together have the bow-tie shape.

5. The antenna device of claim 1, wherein the first antenna has a first radiation pattern of a first dipole shape, and the second antenna has a second radiation pattern of a second dipole shape.

6. The antenna device of claim 1, wherein the first communication band is a band using a frequency between 26.5 GHz and 29.5 GHz, and the second communication band is a band using a frequency between 37 GHz to 40 GHz.

7. The antenna device of claim 1, wherein the first antenna comprises a first radiator and a second radiator which, when viewed in a plan view, together have a half bow-tie shape, and wherein the second antenna comprises a third radiator and a fourth radiator which, when viewed in the plan view, together have the half bow-tie shape.

8. The antenna device of claim 1, wherein the first antenna comprises a first radiator and a second radiator which, when viewed in a plan view, together have a first shape, and wherein the second antenna comprises a third radiator and a fourth radiator which, when viewed in the plan view, together have a second shape different from the first shape.

9. The antenna device of claim 1, wherein the first antenna comprises a first radiator and a second radiator, and the second antenna comprises a third radiator and a fourth radiator, and wherein the first radiator, the second radiator, the third radiator, and the fourth radiator are placed to at least partially overlap each other in a stacking direction of the first feed layer and the second feed layer on the signal processing device.

10. The antenna device of claim 9, wherein the antenna space further includes a first conductive layer, a second conductive layer, a third conductive layer, and a fourth conductive layer disposed perpendicular to the barrier and stacked in the stacking direction, and wherein the first radiator, the second radiator, the third radiator, and the fourth radiator are respectively formed at the first conductive layer, the second conductive layer, the third conductive layer, and the fourth conductive layer.

11. The antenna device of claim 1, further comprising:

a core layer disposed perpendicular to the barrier and interposed between the first antenna and the second antenna.

12. An antenna device comprising:

a first antenna configured to transmit/receive a first radio frequency (RF) signal in a first communication band;

a second antenna configured to transmit/receive a second RF signal in a second communication band different from the first communication band;

a barrier including a penetration region, the barrier disposed adjacent to the first antenna and the second antenna and reflecting the first RF signal and the second RF signal;

a signal processing device disposed adjacent to the barrier, the signal processing device configured to process the first RF signal and the second RF signal; and a feed space comprising a first feed layer and a second feed layer, the feed space being disposed adjacent to and stacked on the signal processing device and adjacent to the barrier, wherein a first feed line connecting the signal processing device to the first antenna passes through the first feed layer and the penetration region of the barrier, and a second feed line connecting the signal processing device to the second antenna passes through the second feed layer and the penetration region of the barrier.

13. The antenna device of claim 12, wherein the first antenna is separated from the second antenna in a stacking direction of the first feed layer and the second feed layer on the signal processing device.

14. The antenna device of claim 12, wherein the first antenna comprises a first radiator and a second radiator which, when viewed in a plan view, together have a bow-tie shape, and wherein the second antenna comprises a third radiator and a fourth radiator which, when viewed in the plan view, together have the bow-tie shape.

15. The antenna device of claim 12, wherein the first antenna comprises a first radiator and a second radiator which, when viewed in a plan view, together have a half bow-tie shape, and wherein the second antenna comprises a third radiator and a fourth radiator which, when viewed in the plan view, together have the half bow-tie shape.

16. An antenna device comprising:

a first radiator;

a second radiator;

a third radiator;

a fourth radiator;

a barrier including a penetration region, the barrier disposed adjacent to the first to fourth radiators and reflecting a first radio frequency (RF) signal in a first communication band and a second RF signal in a second communication band different from the first communication band;

a signal processing device disposed adjacent to the barrier, the signal processing device including a first RF circuit configured to process the first RF signal and a second RF circuit configured to process the second RF signal; and a feed space comprising a first feed layer and a second feed layer, the feed space being disposed adjacent to and stacked on the signal processing device and adjacent to the barrier, wherein:

a first feed line connecting the first RF circuit to the first radiator passes through the first feed layer and the penetration region of the barrier, a second feed line connecting the first RF circuit to the second radiator passes through the first feed layer and the penetration region of the barrier, a third feed line connecting the second RF circuit to the third radiator passes through the second feed layer and the penetration region of the barrier, and a fourth feed line connecting the second RF circuit to the fourth radiator passes through the second feed layer and the penetration region of the barrier.

17. The antenna device of claim 16, wherein the first radiator, the second radiator, the third radiator, and the fourth radiator are separated from each other in a stacking direction of the first feed layer and the second feed layer on the signal processing device, and wherein the first radiator, the second radiator, the third radiator, and the fourth radiator are placed to at least partially overlap each other in the stacking direction.

18. The antenna device of claim 16, further comprising a first conductive layer, a second conductive layer, a third conductive layer, and a fourth conductive layer disposed perpendicular to the barrier and stacked in a stacking direction of the first feed layer and the second feed layer on the signal processing device, and wherein the first to fourth radiators are respectively formed at the first to fourth conductive layers.

19. The antenna device of claim 16, further comprising:

a core layer disposed perpendicular to the barrier and interposed between the second radiator and the third radiator.

20. The antenna device of claim 16, wherein the first communication band is a band using a frequency between 26.5 GHz and 29.5 GHz, and the second communication band is a band using a frequency between 37 GHz to 40 GHz.

* * * * *